US009576526B2

(12) United States Patent
Kimura

(10) Patent No.: US 9,576,526 B2
(45) Date of Patent: Feb. 21, 2017

(54) SEMICONDUCTOR DEVICE

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 325 days.

(21) Appl. No.: 13/557,299

(22) Filed: Jul. 25, 2012

(65) Prior Publication Data

US 2012/0286697 A1 Nov. 15, 2012

Related U.S. Application Data

(60) Continuation of application No. 12/327,883, filed on Dec. 4, 2008, now Pat. No. 8,289,238, which is a (Continued)

(30) Foreign Application Priority Data

May 14, 2003 (JP) ..... 2003-136612

(51) Int. Cl.
*G09G 3/32* (2016.01)
*G05F 3/24* (2006.01)

(52) U.S. Cl.
CPC ..... *G09G 3/3233* (2013.01); *G05F 3/242* (2013.01); *G09G 2300/0809* (2013.01); (Continued)

(58) Field of Classification Search
CPC ..... G09G 2330/021; G09G 2330/02; G09G 3/3696; G09G 3/3648; G09G 3/3688 (Continued)

(56) References Cited

U.S. PATENT DOCUMENTS 4,742,292 A 5/1988 Hoffman
5,585,749 A 12/1996 Pace et al.
(Continued)

FOREIGN PATENT DOCUMENTS

EP 0282725 A1 9/1988
EP 1103946 A1 5/2001
(Continued)

OTHER PUBLICATIONS

International Search Report (Application No. PCT/JP2004/005001), Aug. 10, 2004, 3 pages.
(Continued)

*Primary Examiner* — Shaheda Abdin
(74) *Attorney, Agent, or Firm* — Fish & Richardson P.C.

(57) ABSTRACT

A semiconductor device in which a transistor can supply an accurate current to a load (EL pixel and signal line) without being influenced by variations is provided.
A voltage at each terminal of a transistor is adjusted by a feedback circuit using an amplifier circuit. A current Idata is input from a current source circuit to the transistor, and a gate-source voltage is set by the feedback circuit so that the transistor can flow the current Idata. The feedback circuit controls the transistor to operate in a saturation region. Thus, a gate voltage required for flowing the current Idata is set. With the use of the set transistor, a current can be supplied to a load (EL pixel and signal line) with accuracy. Note that a desired gate voltage can be set quickly since the amplifier circuit is utilized.

12 Claims, 44 Drawing Sheets

Related U.S. Application Data division of application No. 10/843,680, filed on May 12, 2004, now Pat. No. 7,463,223.

(52) U.S. Cl.
CPC ..... *G09G 2300/0833* (2013.01); *G09G 2300/0842* (2013.01); *G09G 2300/0861* (2013.01); *G09G 2310/0251* (2013.01); *G09G 2320/0295* (2013.01); *G09G 2320/043* (2013.01)

(58) Field of Classification Search
USPC ..... 345/204, 96, 99, 87, 88, 89; 315/169.3, 315/169.1, 169.4
See application file for complete search history.

(56) References Cited

U.S. PATENT DOCUMENTS

| | | | | |
|---|---|---|---|---|
| 5,614,848 | A | 3/1997 | Kaminaga et al. | |
| 5,646,518 | A | 7/1997 | Lakshmikumar et al. | |
| 5,663,659 | A | 9/1997 | Kaminaga et al. | |
| 5,666,035 | A | 9/1997 | Basire et al. | |
| 5,703,534 | A | 12/1997 | Kim | |
| 5,744,984 | A | 4/1998 | Drapac et al. | |
| 5,905,677 | A | 5/1999 | Casagrande et al. | |
| 6,087,821 | A | 7/2000 | Kojima | |
| 6,222,357 | B1 | 4/2001 | Sakuragi | |
| 6,229,506 | B1 | 5/2001 | Dawson et al. | |
| 6,285,177 | B1 | 9/2001 | Mallikarjunaswamy et al. | |
| 6,316,990 | B1 | 11/2001 | Tanizawa | |
| 6,323,848 | B1 * | 11/2001 | Abe | 345/204 |
| 6,373,419 | B1 | 4/2002 | Nakao | |
| 6,373,454 | B1 | 4/2002 | Knapp et al. | |
| 6,437,550 | B2 | 8/2002 | Andoh et al. | |
| 6,483,384 | B1 | 11/2002 | Chimura | |
| 6,489,835 | B1 | 12/2002 | Yu et al. | |
| 6,556,475 | B2 | 4/2003 | Yamazaki et al. | |
| 6,567,327 | B2 | 5/2003 | Tsuchi | |
| 6,600,305 | B2 | 7/2003 | Andoh et al. | |
| 6,661,180 | B2 | 12/2003 | Koyama | |
| 6,693,388 | B2 | 2/2004 | Oomura | |
| 6,710,641 | B1 | 3/2004 | Yu et al. | |
| 6,873,200 | B2 | 3/2005 | Evers et al. | |
| 6,952,083 | B2 | 10/2005 | Fukuzako | |
| 7,378,882 | B2 | 5/2008 | Kimura | |
| 7,463,223 | B2 | 12/2008 | Kimura | |
| RE40,773 | E | 6/2009 | Hashimoto | |
| 8,289,238 | B2 | 10/2012 | Kimura | |
| 2001/0020844 | A1 | 9/2001 | Andoh et al. | |
| 2001/0032990 | A1 | 10/2001 | Koyama et al. | |
| 2002/0135312 | A1 * | 9/2002 | Koyama | 315/169.3 |
| 2002/0153844 | A1 | 10/2002 | Koyama | |
| 2002/0175664 | A1 | 11/2002 | Andoh et al. | |
| 2003/0020413 | A1 * | 1/2003 | Oomura | 315/169.3 |
| 2003/0128199 | A1 | 7/2003 | Kimura | |
| 2003/0128200 | A1 | 7/2003 | Yumoto | |
| 2003/0156102 | A1 | 8/2003 | Kimura | |
| 2003/0169250 | A1 | 9/2003 | Kimura | |
| 2003/0205993 | A1 | 11/2003 | Andoh et al. | |
| 2004/0085029 | A1 | 5/2004 | Kimura | |
| 2004/0085270 | A1 | 5/2004 | Kimura | |
| 2004/0100202 | A1 | 5/2004 | Koyama | |
| 2005/0162206 | A1 | 7/2005 | Kimura | |
| 2005/0168905 | A1 | 8/2005 | Kimura | |
| 2005/0259054 | A1 | 11/2005 | Wu | |
| 2009/0278868 | A1 | 11/2009 | Nakahira et al. | |

FOREIGN PATENT DOCUMENTS

| | | | |
|---|---|---|---|
| EP | 1130565 | A1 | 9/2001 |
| EP | 1333422 | A1 | 8/2003 |
| EP | 1 624 358 | A1 | 2/2006 |
| EP | 2 299 429 | A1 | 3/2011 |
| JP | 62-061410 | A | 3/1987 |
| JP | 63-229509 | A | 9/1988 |
| JP | 08-242130 | A | 9/1996 |
| JP | 11-149783 | A | 6/1999 |
| JP | 2000-081920 | A | 3/2000 |
| JP | 2000-112548 | A | 4/2000 |
| JP | 2001-005426 | A | 1/2001 |
| JP | 2001-284464 | A | 10/2001 |
| JP | 2001-343933 | A | 12/2001 |
| JP | 2002-100936 | A | 4/2002 |
| JP | 2002-514320 | A | 5/2002 |
| JP | 2002-517806 | A | 6/2002 |
| JP | 2002-351357 | A | 12/2002 |
| JP | 2003-043993 | A | 2/2003 |
| JP | 2003-058106 | A | 2/2003 |
| JP | 2003-108069 | A | 4/2003 |
| JP | 2004-107078 | A | 12/2004 |
| WO | WO 98/48403 | A1 | 10/1998 |
| WO | WO 99/65011 | A2 | 12/1999 |
| WO | WO 01/06484 | A1 | 1/2001 |
| WO | WO 02/39420 | A1 | 5/2002 |
| WO | WO 03/038793 | A1 | 5/2003 |
| WO | WO 03/038794 | A1 | 5/2003 |
| WO | WO 03/038795 | A1 | 5/2003 |
| WO | WO 03/038796 | A1 | 5/2003 |
| WO | WO 03/038797 | A1 | 5/2003 |

OTHER PUBLICATIONS

Written Opinion (Application No. PCT/JP2004/005001), Aug. 10, 2004, 5 pages with partial translation.
Written Opinion (Application No. PCT/JP2004/005969), Aug. 31, 2004, 5 pages with partial translation.
International Search Report (Application No. PCT/JP2004/007367), Aug. 31, 2004, 2 pages.
Written Opinion (Application No. PCT/JP2004/007367), Aug. 31, 2004, 4 pages with partial translation.
International Search Report for European Patent Application No. 04731468.7 dated Jan. 2, 2008 (6 pages).
Taiwanese Office Action (Application No. 93113507) dated Jun. 10, 2011, with Full English translation.
Office Action (European Patent Application No. 04731468.7) dated Feb. 14, 2011.
Search Report (European Patent Application No. 10015781.7) dated Feb. 18, 2011.
International Search Report (Applicatio No. PCT/JP2004/005969), Aug. 31, 2004, 2 pages.

* cited by examiner

SEMICONDUCTOR DEVICE

CROSS-REFERENCE TO RELATED APPLICATIONS

This application is a continuation of U.S. application Ser. No. 12/327,883, filed Dec. 4, 2008, now allowed, which is a divisional of U.S. application Ser. No. 10/843,680, filed May 12, 2004, now U.S. Pat. No. 7,463,223, which claims the benefit of a foreign priority application filed in Japan as Serial No. 2003-136612 on May 14, 2003, all of which are incorporated by reference.

TECHNICAL FIELD

The present invention relates to a semiconductor device provided with a function for controlling a current supplied to a load by a transistor. In particular, the invention relates to a semiconductor device that includes a pixel having a current-driven light emitting element whose luminance varies depending on a current and a signal line driver circuit for driving the pixel.

BACKGROUND ART

In recent years, a so-called self luminous type display device that includes a pixel having a light emitting element such as a light emitting diode (LED) attracts attention. As a light emitting element used for such a self luminous type display device, an organic light emitting diode (also called an OLED, an organic EL element, an electro luminescence (EL) element, or the like) draws attention and has been used for an organic EL display and the like.

Since a light emitting element such as an OLED is self luminous type, it does not require a backlight, and has the advantages of higher visibility of pixels, faster response and the like as compared with a liquid crystal display. Luminance of a light emitting element is controlled by a current value flowing into it.

As a driving method of a display device using such a self luminous type light emitting element, a passive matrix method and an active matrix method are known. The former has a problem in that a large and high luminance display cannot be realized easily, though its simple structure. Therefore, in recent years, the active matrix method has been actively developed, in which a current flowing into a light emitting element is controlled by thin film transistors (TFTs) provided in a pixel circuit.

In the case of a display device adopting such an active matrix method, there are problems in that a current flowing into a light emitting element changes due to variations in current characteristics of driving TFTs, resulting in variations in luminance.

That is, in the case of a display device adopting the active matrix method, driving TFTs for driving a current flowing into light emitting elements are used in a pixel circuit, and there are problems in that a current flowing into the light emitting elements changes due to variations in characteristics of these driving TFTs, resulting in variations in luminance. Thus, suggested are various circuits for suppressing variations in luminance, in which a current flowing into light emitting elements does not change even when characteristics of driving TFTs in a pixel circuit vary.

(Patent Document 1)
Patent Application Laid-Open No. 2002-517806
(Patent Document 2)
International Publication WO 01/06484

(Patent Document 3)
Patent Application Laid-Open No. 2002-514320
(Patent Document 4)
International Publication WO 02/39420

A configuration of an active matrix display device is disclosed in Patent Documents 1 to 4. Disclosed in Patent Documents 1 to 3 is a circuit configuration in which a current flowing into light emitting elements does not change due to variations in characteristics of driving TFTs disposed in a pixel circuit. This configuration is called a current writing pixel or a current input pixel. Meanwhile, disclosed in Patent Document 4 is a circuit configuration for suppressing changes in signal current due to variations in TFTs in a source driver circuit.

FIG. 6 shows a first configuration example of an existing active matrix display device that is disclosed in Patent Document 1. A pixel shown in FIG. 6 comprises a source signal line 601, first to third gate signal lines 602 to 604, a current supply line 605, TFTs 606 to 609, a capacitor element 610, an EL element 611, and an image signal inputting current source 612.

A gate electrode of the TFT 606 is connected to the first gate signal line 602, a first electrode thereof being connected to the source signal line 601 and a second electrode thereof being connected to a first electrode of the TFT 607, a first electrode of the TFT 608 and a first electrode of the TFT 609. A gate electrode of the TFT 607 is connected to the second gate signal line 603, a second electrode thereof being connected to a gate electrode of the TFT 608. A second electrode of the TFT 608 is connected to the current supply line 605. A gate electrode of the TFT 609 is connected to the third gate signal line 604, a second electrode thereof being connected to an anode of the EL element 611. The capacitor element 610 is connected between the gate electrode of the TFT 608 and the current supply line, and holds a gate-source voltage of the TFT 608. The current supply line 605 and a cathode of the EL element 611 are input with respective predetermined potentials and have a potential difference therebetween.

Operations from writing of a signal current to light emission are described with reference to FIGS. 7A to 7E. FIGS. 7A to 7C are schematic diagrams each showing a current flow. FIG. 7D shows a relationship between currents flowing in each path in writing a signal current. FIG. 7E shows a voltage that is held in the capacitor element 610 in writing a signal current also, namely the gate-source voltage of the TFT 608.

First, a pulse is input to the first gate signal line 602 and the second gate signal line 603, thereby the TFTs 606 and 607 are turned on. A current flowing in the source signal line 601 at this time, namely a signal current is referred to as Idata.

Since the current Idata flows in the source signal line 601, a current flows in a pixel through current paths I1 and I2 as shown in FIG. 7A. The relationship between the divided currents is shown in FIG. 7D. It is needless to say that Idata=I1+I2 is satisfied.

At the moment when the TFT 606 is turned on, electric charges have not been held in the capacitor element 610 yet, thus the TFT 608 is off. Accordingly, I2 is equal to 0 whereas Idata is equal to I1. That is, during this period, a current flows only to be accumulated in the capacitor element 610.

Then, electric charges are slowly accumulated in the capacitor element 610, and thereby a potential difference begins to occur between both electrodes (FIG. 7E). When a potential difference between both electrodes being equal to Vth (FIG. 7E, point A), the TFT 608 is turned on and I2 is generated. Since Idata=I1+I2 is satisfied as described above, I1 gradually decreases, though a current flows yet and electric charges are further accumulated in the capacitor element.

In the capacitor element 610, electric charges continue to be accumulated until a potential difference between both electrodes thereof, that is, the gate-source voltage of the TFT 608 becomes equal to a desired voltage, namely a voltage (Vgs) that allows the TFT 608 to supply the current Idata. When the accumulation of electric charges is completed (FIG. 7E, point B), the current I1 stops flowing, the TFT 608 supplies a current corresponding to the Vgs at this time, and thereby Idata becomes equal to I2 (FIG. 7B). Thus, the steady state is reached. That is the end of the writing operation of signals. Finally, the selection of the first gate signal line 602 and the second gate signal line 603 is completed and the TFTs 606 and 607 are turned off.

Subsequently, a light emitting operation starts. A pulse is input to the third gate signal line 604, thereby the TFT 609 is turned on. Since the capacitor element 610 holds the Vgs that has been written earlier, the TFT 608 is on and the current Idata is supplied from the current supply line 605. Accordingly, the EL element 611 emits light. When the TFT 608 is set to operate in a saturation region at this time, the current Idata can flow without changes even when a source-drain voltage of the TFT 608 varies.

Such an operation that outputs a set current is called an output operation herein. The current writing pixel shown above as an example has the advantages that even when there are variations in characteristics and the like of the TFT 608, the capacitor element 610 holds a gate-source voltage required for flowing the current Idata, a desired current can be supplied to the EL element with accuracy, thereby variations in luminance due to variations in characteristics of TFTs can be suppressed.

Described above is an example for correcting changes in current due to variations of driving TFTs in a pixel circuit. The same problem occurs in a source driver circuit. Disclosed in Patent Document 4 is a circuit configuration for preventing changes in signal current due to production variations of TFTs in a source driver circuit.

(Patent Document 5)

Patent Application Laid-Open No. 2003-108069

Furthermore, another method than those shown in Patent Documents 1 to 4 is disclosed in Patent Document 5. A configuration diagram thereof is shown in FIG. 44. FIG. 44 shows a driver circuit of a light emitting element, which includes a current supply circuit (1) and a driver control circuit (2*a*). In the driver circuit shown in FIG. 44, a current (Is) that is equal to a current (Ir) supplied from a supply transistor (M5) for supplying a current to drive a light emitting element (EL) flows into the driver control circuit (2*a*) through a reference transistor (M4). Then, depending on the current (Is), source-drain voltage data (Vs) of the reference transistor (M4), and source-drain voltage data (Vr, Vdrv) of the supply transistor (M5), the current (Is) can be controlled to be close to a desired predetermined current value (Idrv) and each source-drain voltage data (Vs, Vr) can be controlled to be equal to each other.

DISCLOSURE OF THE INVENTION

Problems to be Solved by the Invention

As set forth above, in the conventional technologies, a circuit is configured so that a signal current and a current for driving a TFT, or a signal current and a current flowing into a light emitting element in light emission may be equal or proportional to each other.

However, parasitic capacitance of a wiring used for supplying a signal current to a driving TFT and a light emitting element is considerably large. Therefore, there are problems in that in the case of a signal current being small, the time constant for charging parasitic capacitance of a wiring is increased, and thereby signal writing speed becomes slower. That is, the problem is that it takes a long time to develop at a gate terminal a voltage required for flowing a signal current supplied to a transistor, and signal writing speed becomes slower.

Furthermore, in the case of the configuration shown in FIG. 44, a transistor M7 and a transistor M9 need to have the same current characteristics. Variations in current characteristics lead to variations in current flowing into a light emitting element (EL). Similarly, a transistor M8 and a transistor M11, a transistor M10 and a transistor M12, and the like need to have the same current characteristics. In this manner, many transistors need to have the same current characteristics because variations in current characteristics lead to variations in current flowing into a light emitting element (EL). In addition, as seen by comparison of FIG. 44 and FIG. 6, the circuit in FIG. 44 has much more transistors and a more complicated configuration. Accordingly, reduced productive yield, increased cost, enlarged layout of circuit, and increased power consumption may occur.

In view of the foregoing problems, it is an object of the invention to provide a semiconductor device that can reduce the influences of variations in characteristics of transistors, and improve signal writing speed sufficiently even in the case of a signal current being small.

Means for Solving the Problems

In order to achieve the aforementioned object, according to the invention, a potential of a transistor that supplies a current to a load is controlled by an amplifier circuit, and a potential of a source or a drain of the transistor is stabilized by constituting a feedback circuit.

A semiconductor device of the invention is characterized by having a circuit in which a current supplied to a load is controlled by a transistor whose source or drain is connected to a current source circuit, and an amplifier circuit for controlling a source potential or a drain potential of the transistor so that the transistor may operate in a saturation region when a current is supplied from the current source circuit to the transistor.

A semiconductor device of the invention is characterized by having a circuit in which a current supplied to a load is controlled by a transistor whose source or drain is connected to a current source circuit, and an amplifier circuit for stabilizing a source potential or a drain potential of the transistor.

A semiconductor device of the invention is characterized by having a circuit in which a current supplied to a load is controlled by a transistor whose source or drain is connected to a current source circuit, and a feedback circuit for stabilizing a source potential or a drain potential of the transistor.

A semiconductor device of the invention is characterized by having a transistor for controlling a current supplied to a load and an operational amplifier, wherein an inverting input terminal of the operational amplifier is connected to a drain terminal side of the transistor connected to a current source circuit, a non-inverting input terminal of the operational amplifier is connected to a gate terminal side of the transistor, and an output terminal of the operational amplifier is connected to a source terminal side of the transistor.

A semiconductor device of the invention is characterized by having a transistor for controlling a current supplied to a load and an operational amplifier, wherein an inverting input terminal of the operational amplifier is connected to a drain terminal side of the transistor connected to a current source circuit, a non-inverting input terminal of the operational amplifier is connected to a gate terminal side of the transistor, and an output terminal of the operational amplifier is connected to the drain terminal side of the transistor.

A semiconductor device of the invention is characterized by having a transistor for controlling a current supplied to a load and a voltage follower circuit, wherein an input terminal of the voltage follower circuit is connected to a gate terminal side of the transistor connected to a current source circuit, and an output terminal of the voltage follower circuit is connected to a drain terminal side of the transistor. In this configuration of the invention, the voltage follower circuit may be constituted by a source follower circuit.

In the invention, the type of applicable transistor is not especially limited, and a thin film transistor (TFT) using a non-single crystalline semiconductor film typified by amorphous silicon and polycrystalline silicon, a MOS transistor formed by using a semiconductor substrate or an SOI substrate, a junction transistor, a transistor using an organic semiconductor or a carbon nanotube, and other transistors may be employed. Further, the type of substrate on which a transistor is disposed is not especially limited, and the transistor may be formed on a single crystalline substrate, an SOI substrate, a glass substrate, or the like.

Note that in the invention, connection means electrical connection. Accordingly, other elements, switch and the like may be disposed therebetween.

Effect of the Invention

According to the invention, a feedback circuit is constituted by an amplifier circuit in order to control a transistor. As a result, the transistor can output a constant current without being influenced by variations. Such a set operation can be carried out quickly since the amplifier circuit is used. Thus, an accurate current can be output in an output operation. In addition, the amplifier circuit allows a set operation to be carried out with accuracy even when current characteristics vary. Therefore, the amplifier circuit can be easily constituted by transistors such as TFTs with large variations in current characteristics.

BEST MODE FOR CARRYING OUT THE INVENTION

Embodiment modes of the invention will be described hereinafter with reference to the accompanying drawings. However, it is to be understood that various changes and modifications will be apparent to those skilled in the art. Therefore, unless such changes and modifications depart from the scope of the invention, they should be constructed as being included therein.

Embodiment Mode 1

According to the invention, a pixel comprises an element whose luminance can be controlled by a current value flowing into a light emitting element. Typically, an EL element can be adopted. Although various configurations of an EL element are known, any configuration of an EL element can be used in the invention as long as the luminance can be controlled by a current value. In other words, an EL element may be formed by freely combining a light emitting layer, an electron transporting layer, or an electron injection layer. As a material for forming an EL element, a low molecular weight organic material, a medium molecular weight organic material (an organic light emitting material that does not have subliming property and that has a molecular number of 20 or less, or a length of chained molecules of 10 μm or less), or a high molecular weight organic material may be employed. Alternatively, an inorganic material may be mixed or dispersed into these organic materials.

The invention can be applied to various analog circuits having a current source as well as to a pixel having a light emitting element such as an EL element. Thus, in this embodiment mode, the principle of the invention is described.

Figure 1:
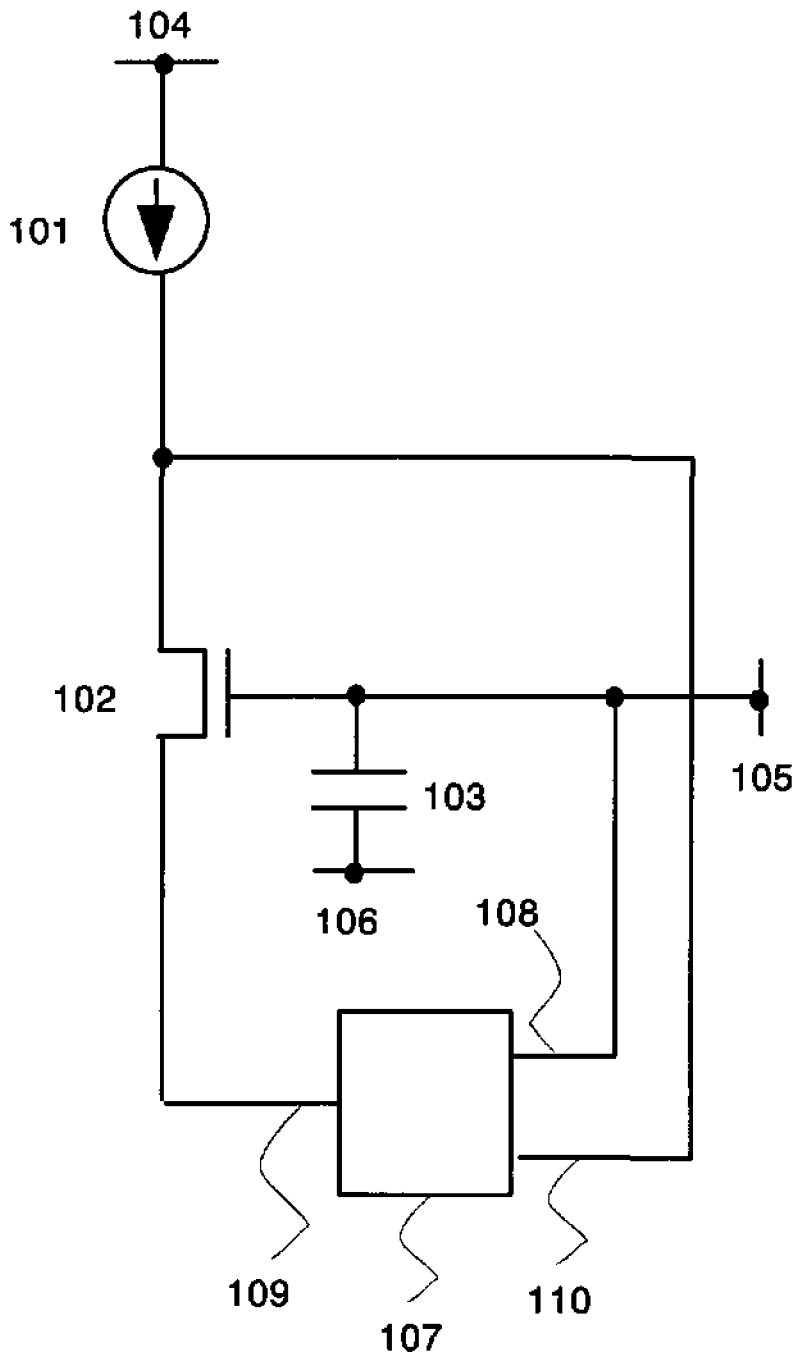
FIG. 1 shows a structure of a semiconductor device of the invention.

FIG. 1 shows a configuration based on the basic principle of the invention. A current source circuit 101 and a current source transistor 102 are connected to a wiring 104. FIG. 1 shows the case in which a current flows from the current source circuit 101 to the current source transistor 102. A first input terminal 108 of an amplifier circuit 107 is connected to a gate terminal of the current source transistor 102. A second input terminal 110 of the amplifier circuit 107 is connected to a drain terminal of the current source transistor 102. An output terminal 109 of the amplifier circuit 107 is connected to a source terminal of the current source transistor 102. Moreover, the gate terminal of the current source transistor 102 is connected to a wiring 105.

A capacitor element 103 is connected to the gate terminal of the current source transistor 102 and a wiring 106 in order to hold a gate voltage of the current source transistor 102. It is to be noted that the capacitor element 103 can be omitted when gate capacitance of the current source transistor 102, or the like is used instead.

In such a configuration, a current Idata is supplied and input from the current source circuit 101 and the current Idata flows into the current source transistor 102. The amplifier circuit 107 controls so that the current Idata supplied from the current source circuit 101 may flow into the current source transistor 102 and the steady state may be reached during a period in which the current source transistor 102 operates in a saturation region. Thus, a source potential of the current source transistor 102 is set to a level at which the current source transistor 102 can flow the current Idata. That is, the source potential of the current source transistor 102 is controlled so that a gate-source voltage may be set to a level at which the current source transistor 102 can flow the current Idata. At this time, the source potential of the current source transistor 102 is set to a proper value independently of current characteristics (mobility, threshold voltage and the like) and size (gate width W and gate length L) of the current source transistor 102. Therefore, even when there are variations in current characteristics and size of the current source transistor 102, the current source transistor 102 can supply the current Idata. As a result, the current source transistor 102 can operate as a current source and supply a current to various loads (another current source transistor, a pixel, a signal line driver circuit, and the like).

Since the output impedance of the amplifier circuit 107 is not high, a large current can be output. Thus, the source terminal of the current source transistor 102 can be charged quickly. In other words, writing of the current Idata can be carried out faster to be completed quickly, and thereby it takes a short time to reach the steady state.

An operation of the amplifier circuit 107 is described next. The amplifier circuit 107 has a function to detect voltages of the first input terminal 108 and the second input terminal 110, and amplify the input voltages to be output to the output terminal 109. In FIG. 1, the second input terminal 110 and the output terminal 109 are connected through the source and the drain of the current source transistor 102, namely they constitute a feedback circuit. Because of the feedback circuit, the voltage of the second input terminal 110 changes depending on the voltages of the output terminal 109 and the first input terminal 108 (the gate terminal of the current source transistor 102), and the voltage of the output terminal 109 changes also depending on the voltage of the second input terminal 110. Through such a feedback operation, a voltage to stabilize the state of each input terminal can be output.

In FIG. 1, the gate terminal of the current source transistor 102 is connected to the first input terminal 108, the source terminal thereof being connected to the output terminal 109, and the drain terminal thereof being connected to the second input terminal 110. Accordingly, a voltage to stabilize the voltage between the drain terminal and the gate terminal of the current source transistor 102 is output to the source terminal of the current source transistor 102 by the amplifier circuit 107. At this time, the current Idata is supplied from the current source circuit 101 to the current source transistor 102. As a result, a voltage that allows the current source transistor 102 to supply the current Idata is output from the current source circuit 101 to the source terminal of the current source transistor 102. That is, a voltage is output to the source terminal of the current source transistor 102 so that a gate-source voltage may be set to a level at which the current source transistor 102 can flow the current Idata.

In general, an operating region of a transistor (an NMOS transistor is taken as an example herein for simplicity) can be divided into a linear region and a saturation region. The boundary between these regions is, when a drain-source voltage is Vds, a gate-source voltage is Vgs and a threshold voltage is Vth, a point at which (Vgs−Vth)=Vds is satisfied. In the case of (Vgs−Vth)>Vds being satisfied, a transistor operates in a linear region and a current value is determined by the Vds and the Vgs. On the other hand, in the case of (Vgs−Vth)<Vds being satisfied, a transistor operates in a saturation region and a current value does not change much even when the Vds varies. That is, the current value is determined only by the Vgs.

As is evident from the foregoing, the amplifier circuit 107 may control the current source transistor 102 to operate in a saturation region. According to this, the gate-source voltage of the current source transistor 102 is set to a voltage at which the current Idata can be supplied. In order that the current source transistor 102 operates in a saturation region, (Vgs−Vth)<Vds has only to be satisfied. The threshold voltage Vth of an N-channel transistor is generally more than 0, therefore, the potential of the drain terminal of the current source transistor 102 has to be equal to or more than the potential of the gate terminal. The amplifier circuit 107 controls the current source transistor 102 so as to achieve such an operation.

As set forth above, with the use of the feedback circuit including the amplifier circuit 107, the gate-source voltage of the current source transistor 102 can be set so as to flow as large a current as that supplied from the current source circuit 101. The set operation can be completed quickly because the amplifier circuit 107 is used, and thereby writing is completed in a short time. The set current source transistor 102 can operate as a current source circuit and supply a current to various loads.

Figure 2:
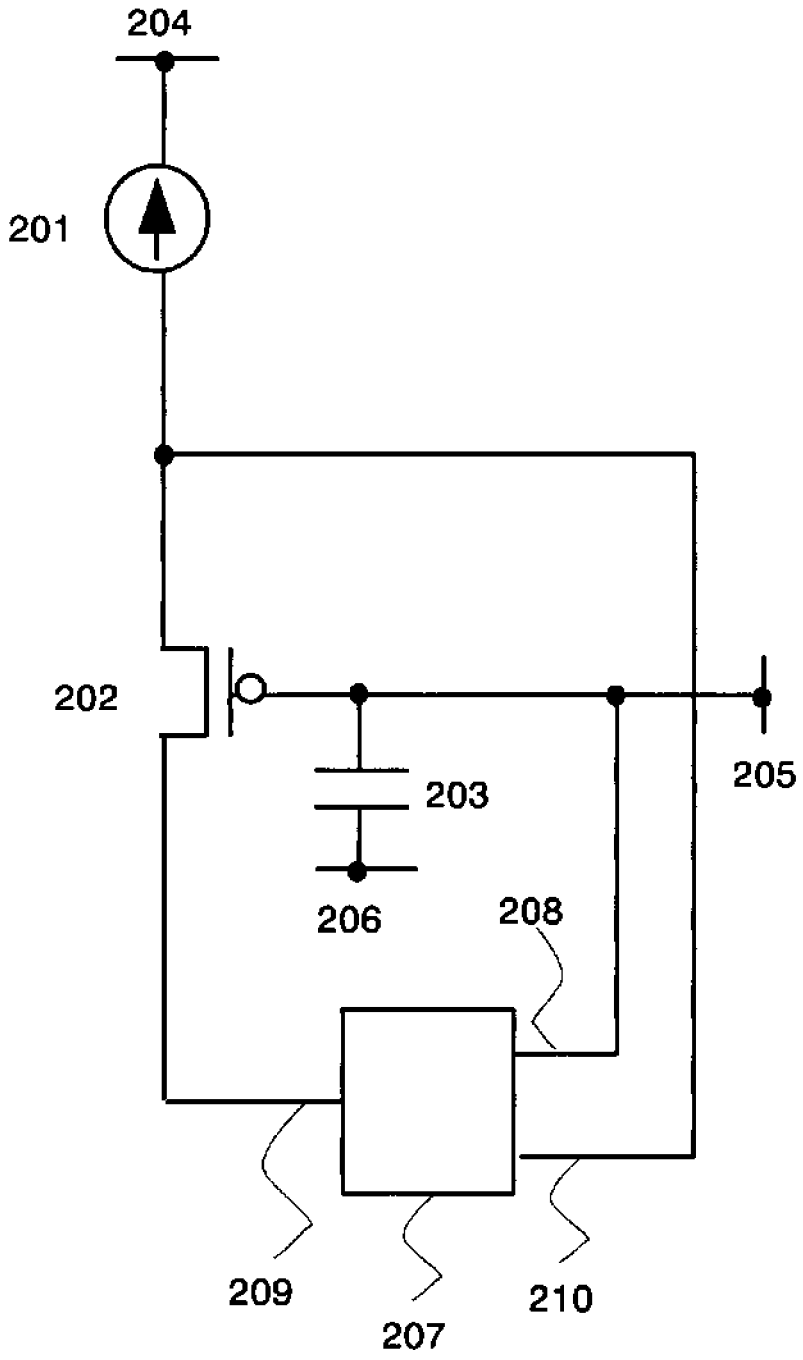
FIG. 2 shows a structure of a semiconductor device of the invention.

Although FIG. 1 shows the case in which a current flows from the current source circuit 101 to the current source transistor 102, the invention is not limited to this. FIG. 2 shows the case in which a current flows from a current source transistor 202 to a current source circuit 201. As mentioned above, when the polarity of the current source transistor 202 is changed, it is possible to change the direction of current without modifying the connection of the circuit. Note that a reference numeral 203 denotes a capacitor element, 204 to 206 denote wirings, 207 denotes an amplifier circuit, 208 denotes a first input terminal, 209 denotes an output terminal, and 210 denotes a second input terminal.

Figure 3:
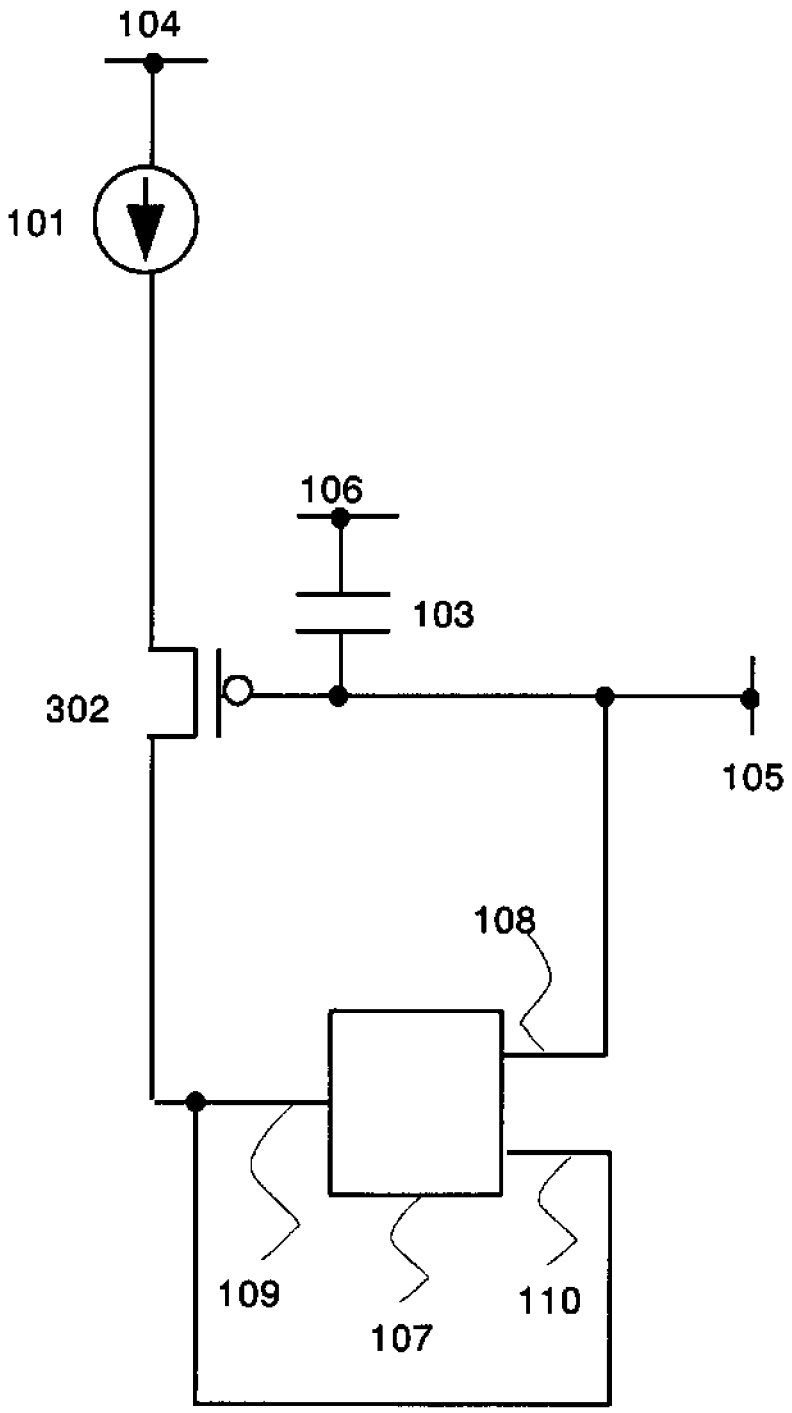
FIG. 3 shows a structure of a semiconductor device of the invention.

Although an N-channel transistor is used for the current source circuit 101 in FIG. 1, the invention is not limited to this, and a P-channel transistor may be used as well. However, when the polarity of the transistor is changed without modifying the direction of current, a source terminal and a drain terminal are changed over. Therefore, the connection of the circuit has to be changed. A configuration in that case is shown in FIG. 3. The current source circuit 101 and a current source transistor 302 are connected to the wiring 104. FIG. 3 shows the case in which a current flows from the current source circuit 101 to the current source transistor 302, though the direction of current can be changed as the case shown in FIG. 2. The first input terminal 108 of the amplifier circuit 107 is connected to a gate terminal of the current source transistor 302. The second input terminal 110 of the amplifier circuit 107 is connected to a drain terminal of the current source transistor 302. The output terminal 109 of the amplifier circuit 107 is connected to the drain terminal of the current source transistor 302.

Accordingly, a voltage to stabilize the voltages of the drain terminal and the gate terminal of the current source transistor 302 is output to the drain terminal of the current source transistor 302 by the amplifier circuit 107. At this time, the current Idata is supplied from the current source circuit 101 to the current source transistor 302. As a result, a voltage at which the current source transistor 302 can supply the current Idata (in other words, a voltage required in order that the current source transistor 302 operates in a saturation region) is output from the current source circuit 101 to the drain terminal of the current source transistor 302. Then, a source potential of the current source transistor 302 is set so that a gate-source voltage may be a level at which the current source transistor 302 can supply the current Idata.

It is to be noted that in FIG. 1, the capacitor element 103 is only required to hold the gate potential of the current source transistor 102, thus a potential of the wiring 106 may be set arbitrarily. Therefore, potentials of the wiring 105 and the wiring 106 may be equal or different. However, a current value of the current source transistor 102 is determined by the gate-source voltage thereof. Accordingly, it is more preferable that the capacitor element 103 holds the gate-source voltage of the current source transistor 102, and the wiring 106 is thus preferably connected to the source terminal of the current source transistor 102. As a result, influences of wiring resistance and the like can be suppressed.

Similarly in FIG. 2, it is desirable that a wiring 206 be connected to a source terminal of the current source transistor 202. Furthermore, in FIG. 3, the wiring 106 is preferably connected to a source terminal of the current source transistor 302.

Embodiment Mode 2

Shown in Embodiment Mode 2 is an example of the amplifier circuit used in FIGS. 1 to 3.

Figure 4:
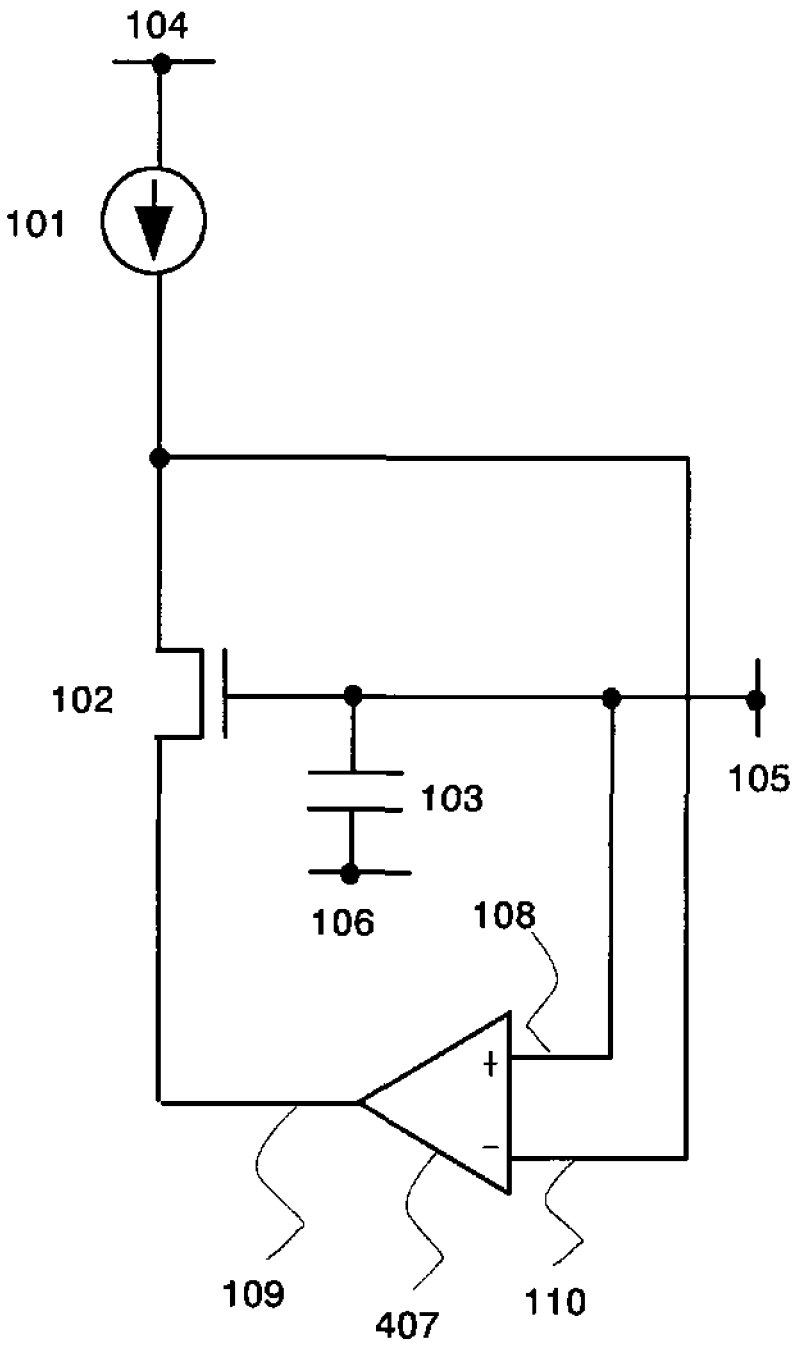
FIG. 4 shows a structure of a semiconductor device of the invention.

First, an operational amplifier is taken as an example of the amplifier circuit. FIG. 4 is a configuration diagram corresponding to FIG. 1, which shows the case of adopting an operational amplifier as an amplifier circuit. The first input terminal 108 of the amplifier circuit 107 corresponds to a non-inverting (positive phase) input terminal of an operational amplifier 407 whereas the second input terminal 110 corresponds to an inverting input terminal.

The operational amplifier normally operates so that a potential of a non-inverting (positive phase) input terminal may be equal to a potential of an inverting input terminal. Accordingly, in FIG. 4, the source potential of the current source transistor 102 is controlled so that the gate potential of the current source transistor 102 may be equal to the drain potential thereof. Thus, Vgs=Vds is satisfied, and thereby the current source transistor 102 operates in a saturation region in the case of Vth being more than 0.

Figure 5:
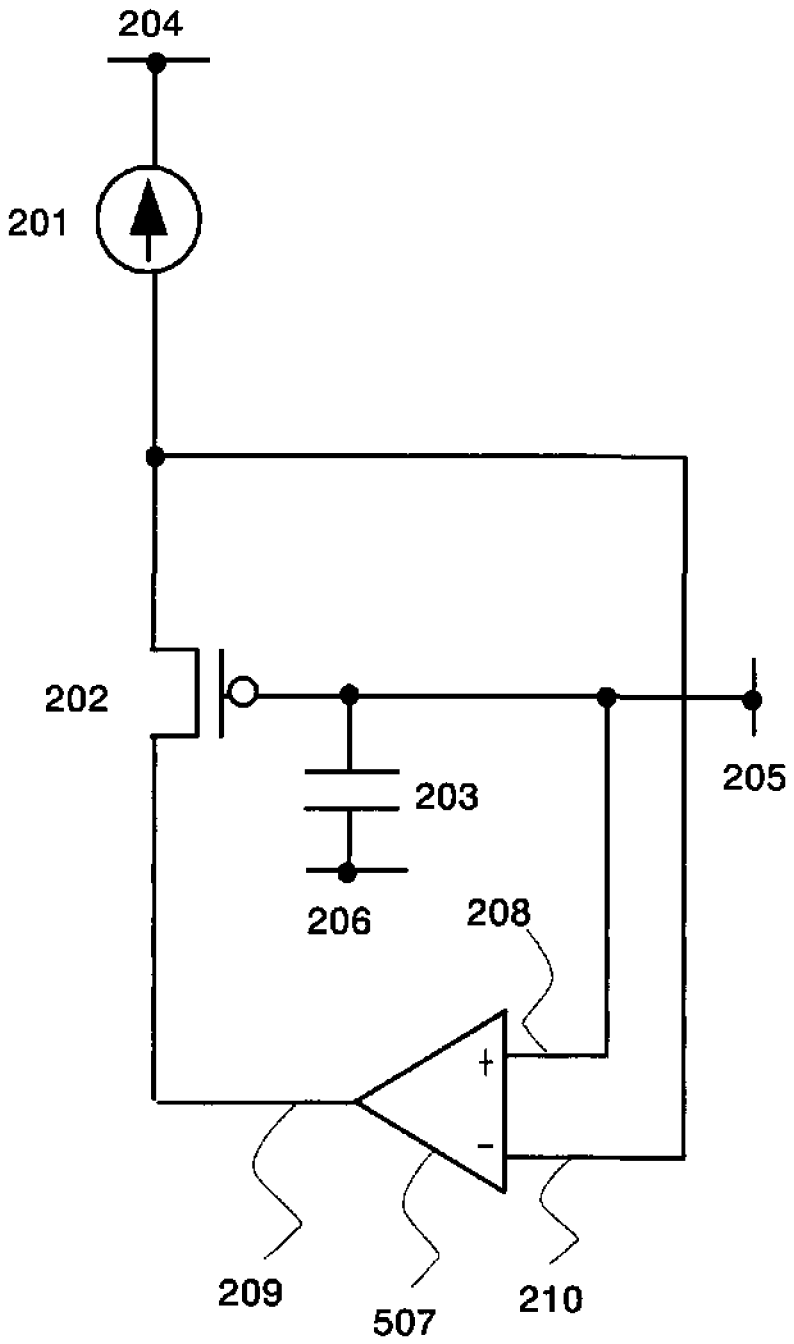
FIG. 5 shows a structure of a semiconductor device of the invention.
Figure 6:
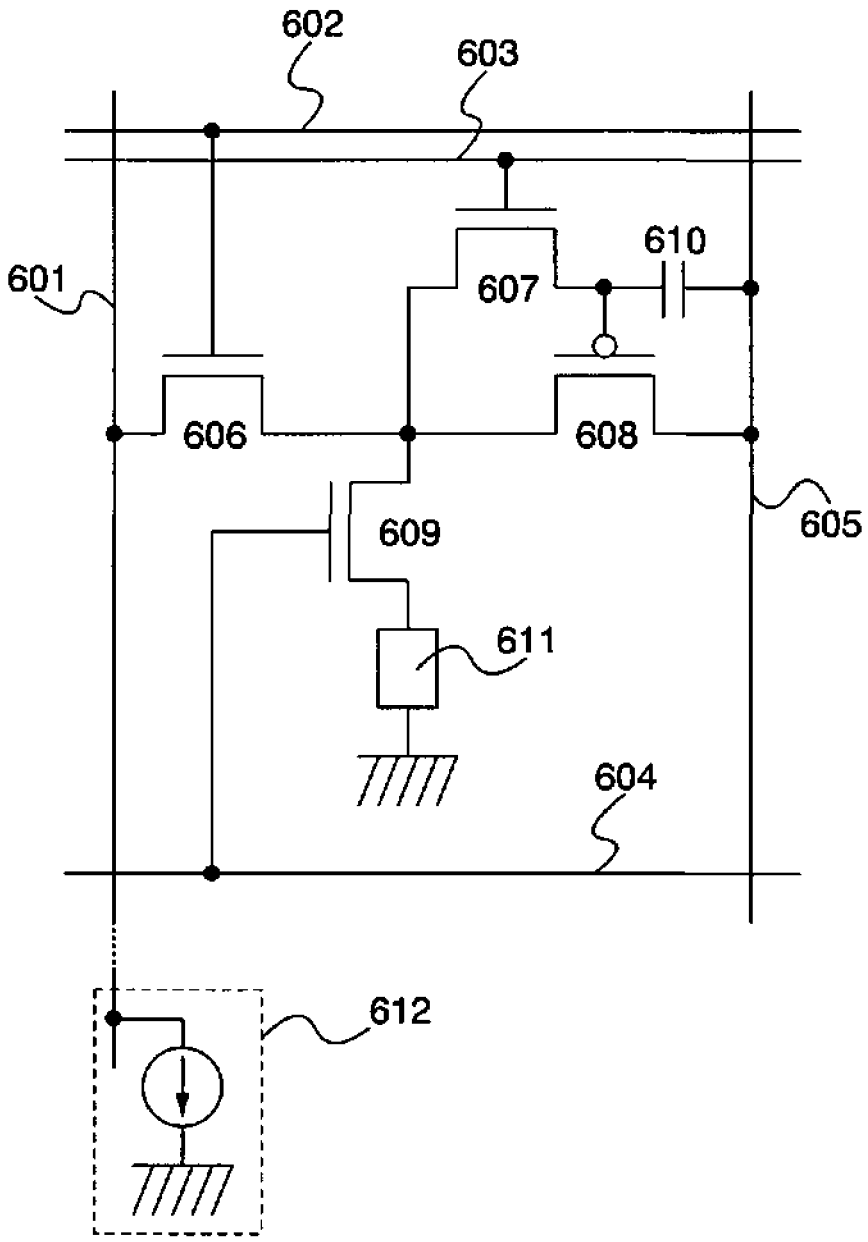
FIG. 6 shows an existing pixel configuration.
Figure 7A:
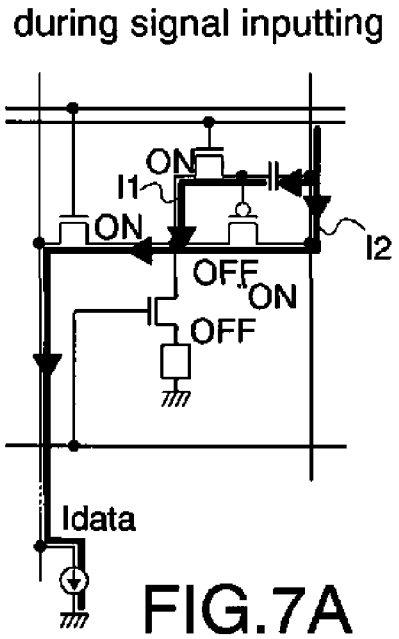
FIGS. 7A to 7E show operations of an existing pixel.
Figure 7B:
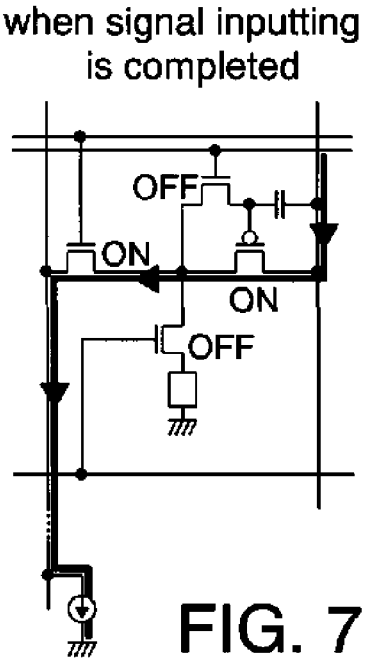
Figure 7C:
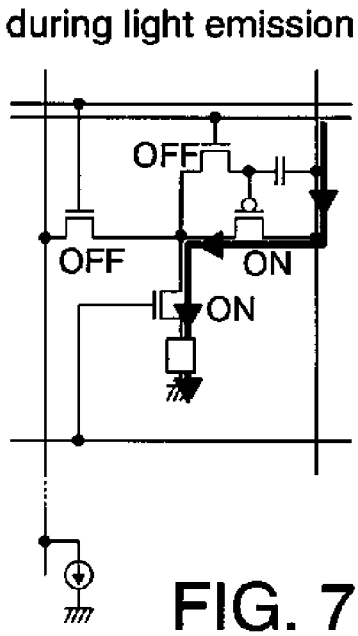
Figure 7D:
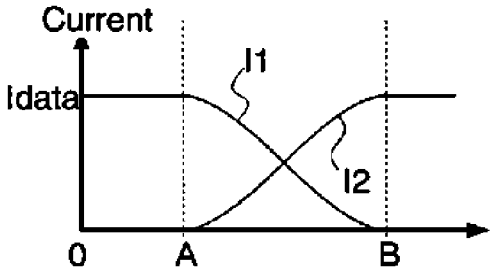
Figure 7E:
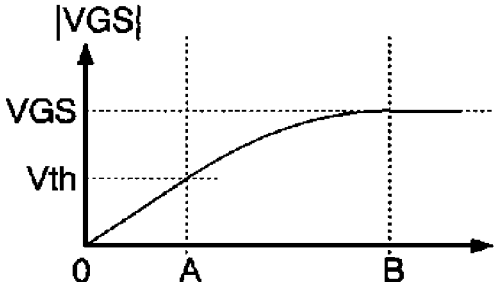
Figure 8:
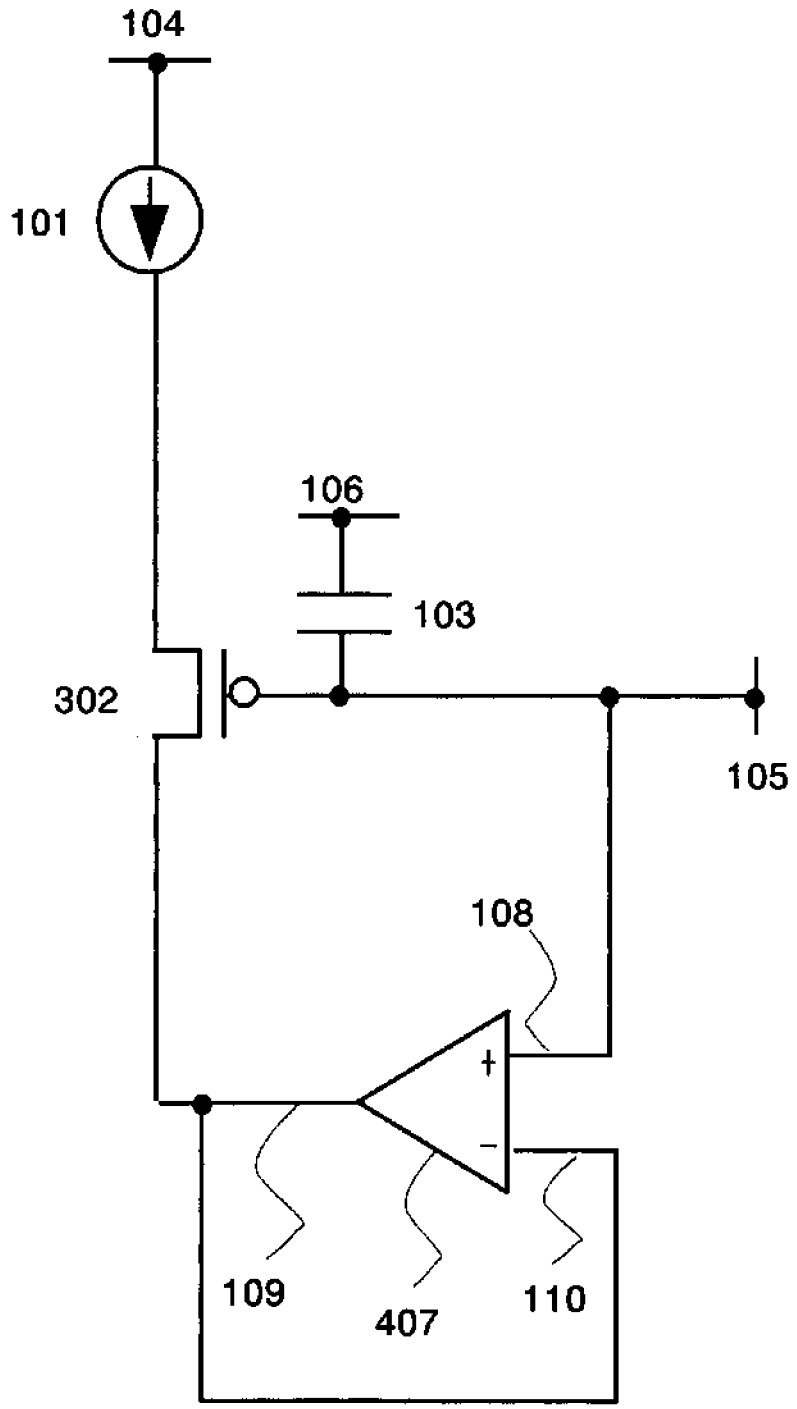
FIG. 8 shows a structure of a semiconductor device of the invention.

Similarly to FIG. 4, FIG. 5 shows a configuration diagram corresponding to FIG. 2 and FIG. 8 shows a configuration diagram corresponding to FIG. 3. Reference numeral 507 denotes an operational amplifier herein.

In the case of FIG. 8, the drain potential of the current source transistor 302 is controlled so that the gate potential of the current source transistor 302 may be equal to the drain potential thereof. Since the gate potential and the drain potential are equal to each other, Vgs=Vds is satisfied, and thereby the current source transistor 302 operates in a saturation region in the case of Vth being more than 0.

It is to be noted that any type of operational amplifier may be used as the operational amplifier used in FIG. 4, FIG. 5, and FIG. 8. A voltage feedback operational amplifier or a current feedback operational amplifier may be used. Alternatively, an operational amplifier added with various correction circuits such as a phase compensation circuit may be employed.

The operational amplifier normally operates so that a potential of a non-inverting (positive phase) input terminal may be equal to a potential of an inverting input terminal, though the potentials of the non-inverting (positive phase)

input terminal and the inverting input terminal may not be equal due to variations in characteristics and the like. In other words, an offset voltage may be generated. In that case, similarly to a normal operational amplifier, potentials of a non-inverting (positive phase) input terminal and an inverting input terminal may be adjusted to be equal to each other. In the case of the invention, however, the current source transistor 102 is only required to be controlled to operate in a saturation region. Therefore, as long as the current source transistor 102 operates in a saturation region, an offset voltage may be generated in the operational amplifier and variations in offset voltages do not have an effect. Accordingly, even when the operational amplifier is constituted by transistors whose current characteristics vary significantly, it can operate normally.

When focusing on the connection of the circuit shown in FIG. 8, the second input terminal 110 of the operational amplifier (inverting input terminal) is connected to the output terminal 109. This circuit configuration is generally called a voltage follower circuit. That is, a voltage of the first input terminal 108 (the non-inverting (positive phase) input terminal) is output to the output terminal, and the input and output impedance is converted. Therefore, not only the operational amplifier connected as shown in FIG. 8 but also a circuit having a function similar to the voltage follower circuit may be utilized as the amplifier circuit 107 used in FIG. 3.

Figure 9:
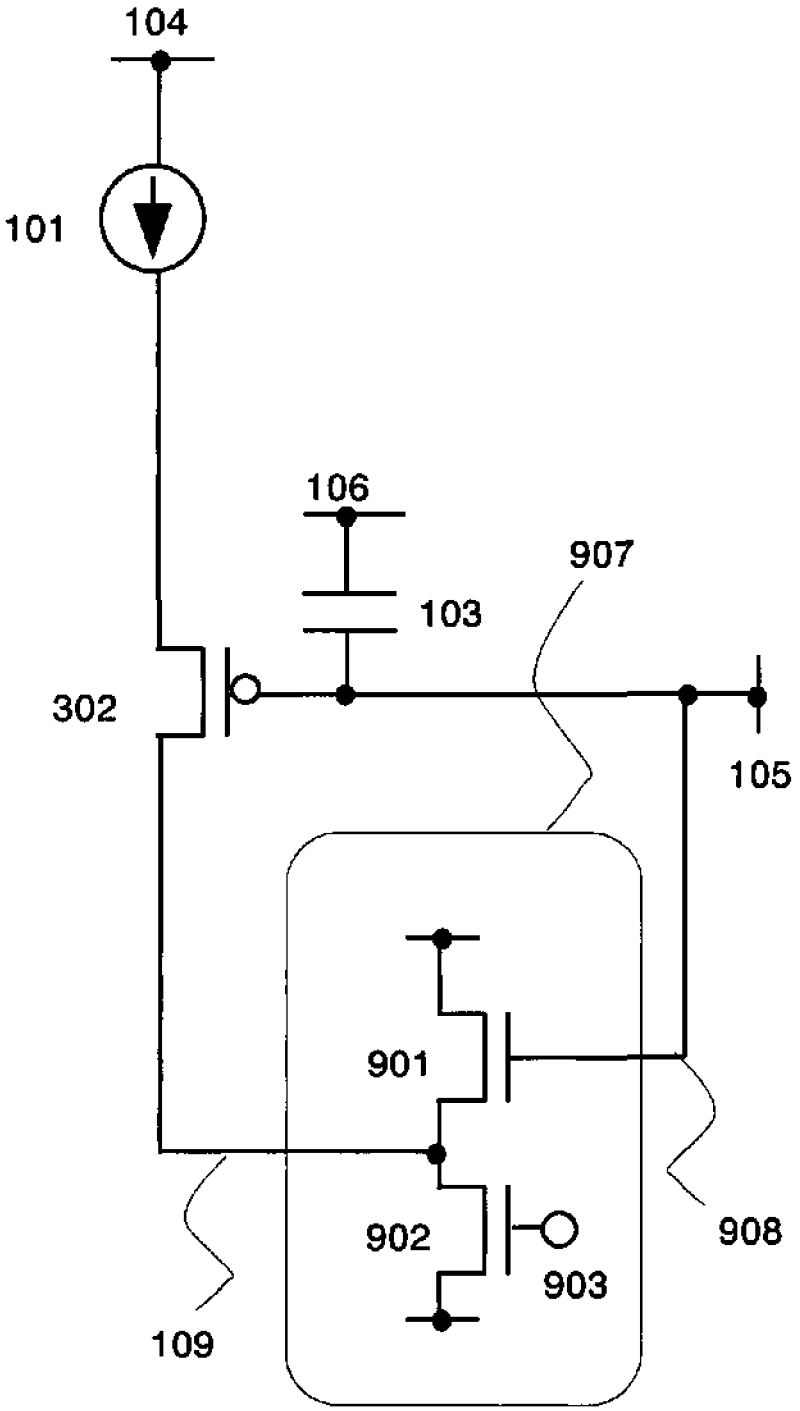
FIG. 9 shows a structure of a semiconductor device of the invention.

There is a source follower circuit as a circuit for converting the input and output impedance. In a normal source follower circuit, an input potential and an output potential are not equal to each other. However, in the amplifier circuit 107 used in FIG. 3, the input potential and the output potential thereof are not required to be equal to each other. That is, the amplifier circuit has to be a circuit that can control the current source transistor 302 to operate in a saturation region. Thus, FIG. 9 shows a configuration in the case of using a source follower circuit 907 as the amplifier circuit 107. When a potential of an input terminal 908 (gate terminal of an amplifying transistor 901), namely a potential of the gate terminal of the current source transistor 302 changes, a potential of the output terminal 109 (source terminal of the amplifying transistor 901), namely a potential of the drain terminal of the current source transistor 302 also changes. When the potential of the drain terminal of the current source transistor 302 changes, a potential of the source terminal of the current source transistor 302 also changes.

Figure 10:
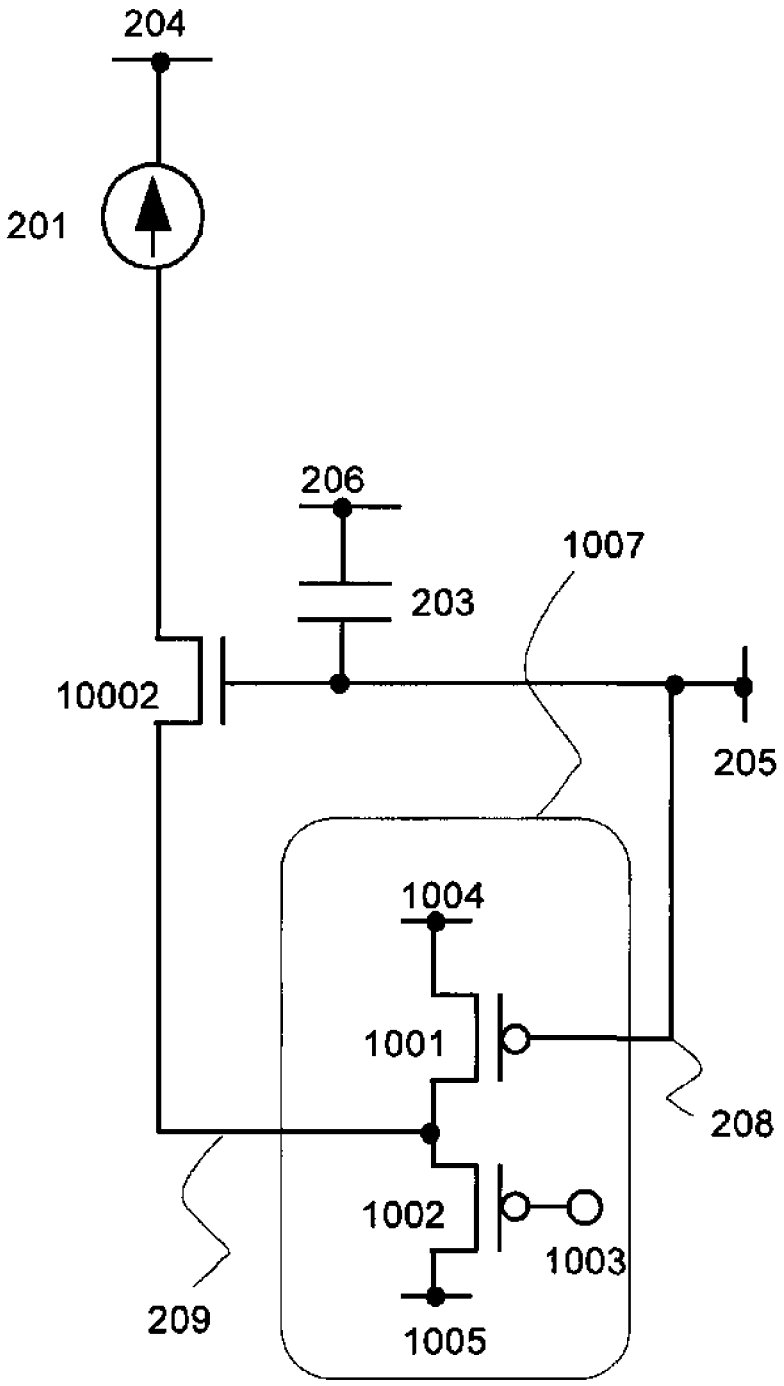
FIG. 10 shows a structure of a semiconductor device of the invention.

In FIG. 9, an N-channel transistor is used as the amplifying transistor 901. Accordingly, the potential of the output terminal 109 (source terminal of the amplifying transistor 901) is lower than the potential of the input terminal 908 (gate terminal of the amplifying transistor 901) by a gate-source voltage of the amplifying transistor 901. Thus, the current source transistor 302 operates in a saturation region. As is evident from the foregoing, in the case of a source follower circuit 907 being used as the amplifying circuit 107 in FIG. 3, it is preferable to adopt a configuration in which the current source transistor 302 can operate in a saturation region easily (in the case of FIG. 9, the amplifying transistor 901 is an N-channel transistor). However, a P-channel transistor may be employed for the amplifying transistor 901 in FIG. 9, as long as it operates normally. FIG. 10 shows a configuration diagram corresponding to FIG. 9, in which the direction of current is inverted. As shown in FIG. 10, the polarity of each transistor may be changed.

Although biasing transistors 902 and 1002 are used and a bias voltage is applied to gate terminals thereof 903 and 1003 in FIG. 9 and FIG. 10, the invention is not limited to this. A resistor element and the like may be used instead of the biasing transistors 902 and 1002. Alternatively, a push-pull circuit may be constituted by a transistor that has the opposite polarity to amplifying transistors 901 and 1001.

In the case of source follower circuits 907 and 1007, similarly to the case of the operational amplifier, variations in output voltages do not have an effect as long as the current source transistors 302 and 10002 operate in a saturation region. Accordingly, even when the source follower circuits 907 and 1007 are constituted by transistors whose current characteristics vary significantly, it can operate normally.

As described above, as long as the current source transistor operates in a saturation region, variations in output voltages of the amplifier circuit do not have an effect. Therefore, in the voltage follower circuit, the source follower circuit and the like, an input voltage does not have to be proportional to an output voltage. That is, any circuit may be adopted as long as the current source transistor can be controlled to operate in a saturation region.

As set forth above, as long as the current source transistors 102, 202, 302, and 10002 operate in a saturation region, variations in characteristics of the amplifier circuits 107 and 207, the operational amplifiers 407 and 507, and the source follower circuits 907 and 1007 used in FIGS. 1 to 5 and FIGS. 8 to 10 do not have an effect. Therefore, even in the case of the amplifier circuits 107 and 207, the operational amplifiers 407 and 507, and the source follower circuits 907 and 1007 being constituted by transistors whose current characteristics vary significantly, a normal operation can be performed.

Accordingly, a thin film transistor (including a transistor using amorphous or polycrystalline as an active layer), an organic transistor or the like may be effectively used instead of a transistor whose channel portion is formed of single crystalline.

Although the operational amplifier and the source follower circuit are used as an example of the amplifier circuits 107 and 207, the invention is not limited to this. The amplifier circuit can be constituted by other various circuits such as a differential circuit, a common drain amplifier circuit and a common source amplifier circuit.

It is to be noted that the description in this embodiment mode corresponds to a detailed description of a part of the configuration shown in Embodiment Mode 1. However, various changes and modifications are possible unless such changes and modifications depart from the scope of the invention.

Embodiment Mode 3

According to the invention, a current Idata is supplied from a current source circuit, and a current source transistor is set to flow the current Idata. Then, the set current source transistor operates as a current source circuit and supplies a current to various loads. Described in this embodiment are a connection between a load and a current source transistor, a configuration of a transistor when supplying a current to a load, and the like.

Although this embodiment mode will be described, for simplicity, with reference to the configuration shown in FIG. 1, and more particularly the configuration using the operational amplifier 407 as the amplifier circuits 107 and 207 (FIG. 4), the invention is not limited to this. This embodiment mode can be easily applied to other configurations as shown in FIGS. 2 to 5, FIGS. 8 to 10 and the like.

In addition, described in this embodiment mode is the case where a current flows from the current source circuit to the current source transistor and the current source transistor is an N-channel transistor, though the invention is not limited to this. This embodiment mode can be easily applied to other configurations as shown in FIGS. 2 to 5, FIGS. 8 to 10 and the like.

Figure 11:
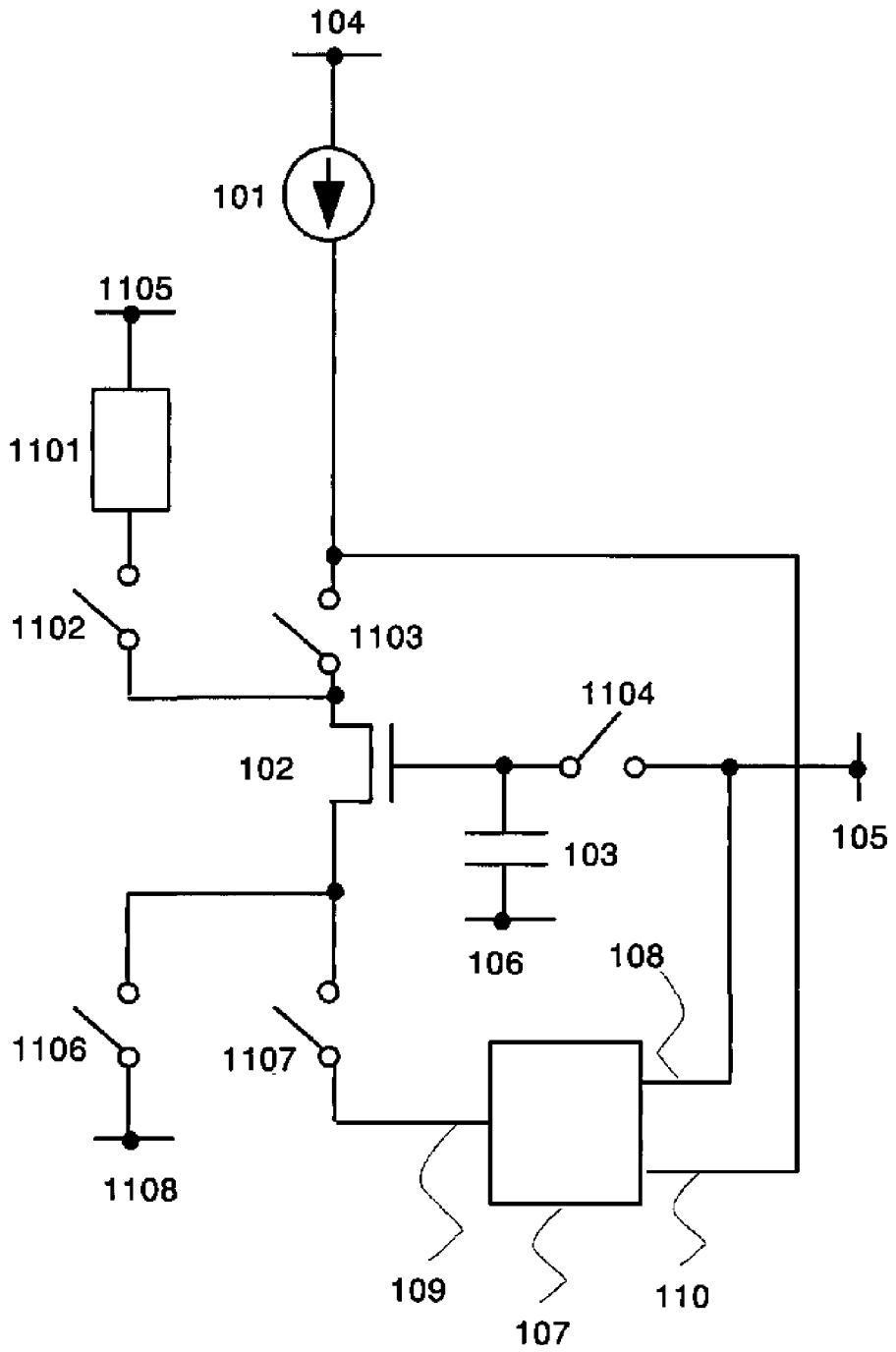
FIG. 11 shows a structure of a semiconductor device of the invention.

First, FIG. 11 shows a configuration in which a current is supplied to the load 1101 by using only the current source transistor 102 to which a current is supplied from the current source circuit 101.

Note that any type of load can be employed. It may be an element such as a resistor, a transistor, an EL element, other light emitting elements, a current source circuit including a transistor, a capacitor, a switch and the like, and a wiring connected to a certain circuit. In addition, a signal line may be used as well as a signal line and a pixel connected thereto. The pixel may comprise any display element such as an EL element and an element used for FED.

Figure 12:
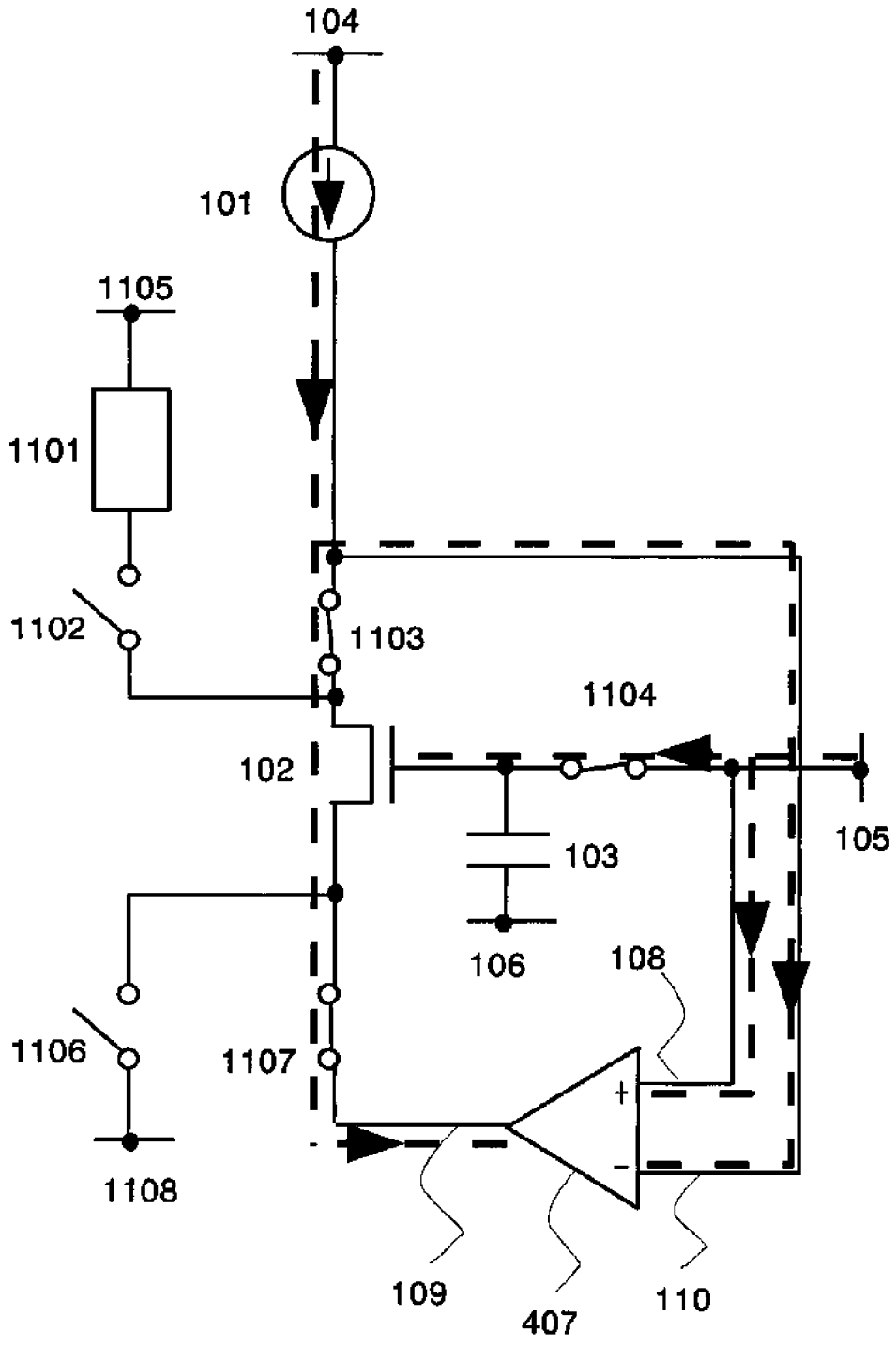
FIG. 12 shows an operation of a semiconductor device of the invention.
Figure 13:
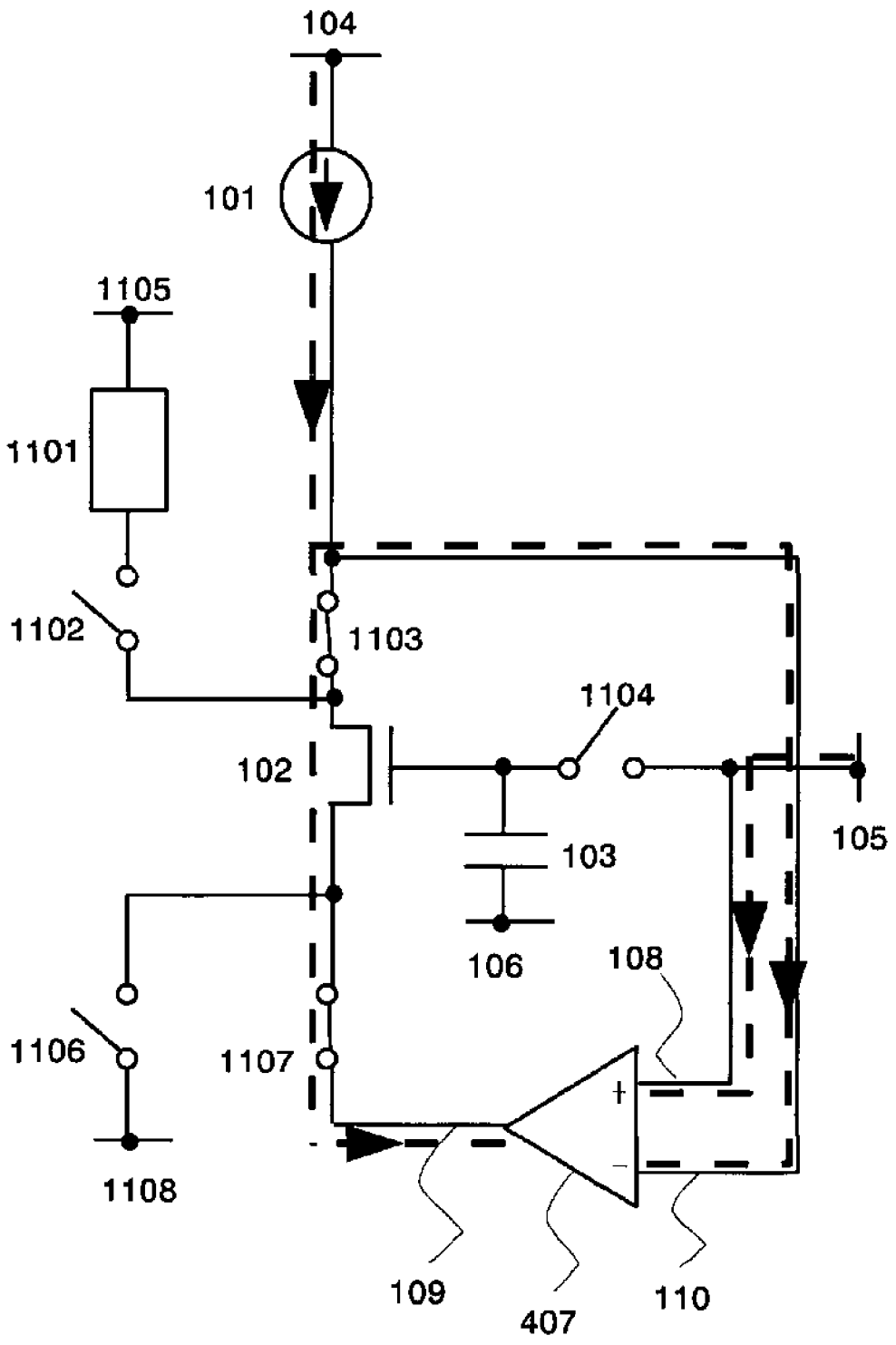
FIG. 13 shows an operation of a semiconductor device of the invention.
Figure 14:
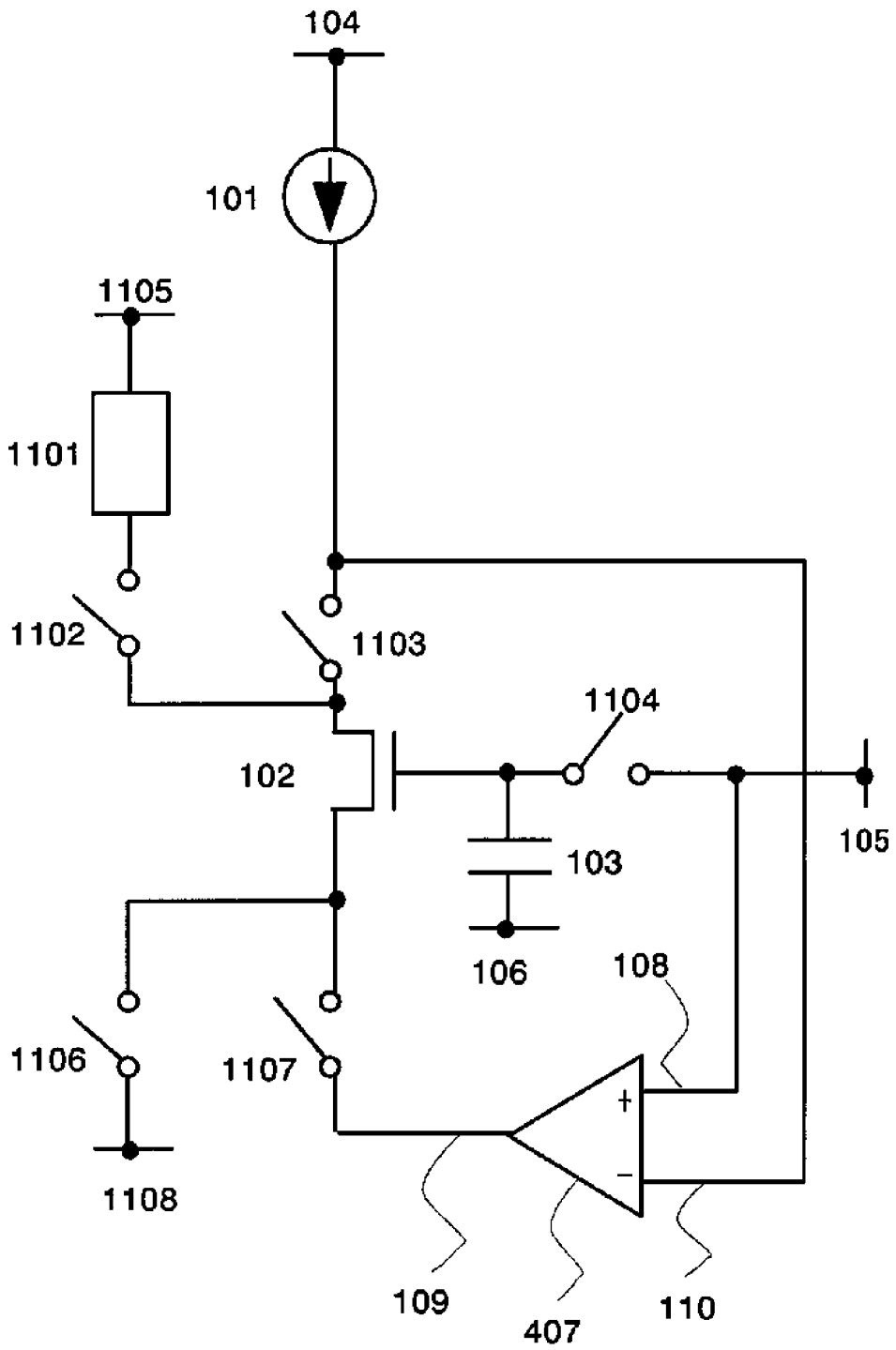
FIG. 14 shows an operation of a semiconductor device of the invention.
Figure 15:
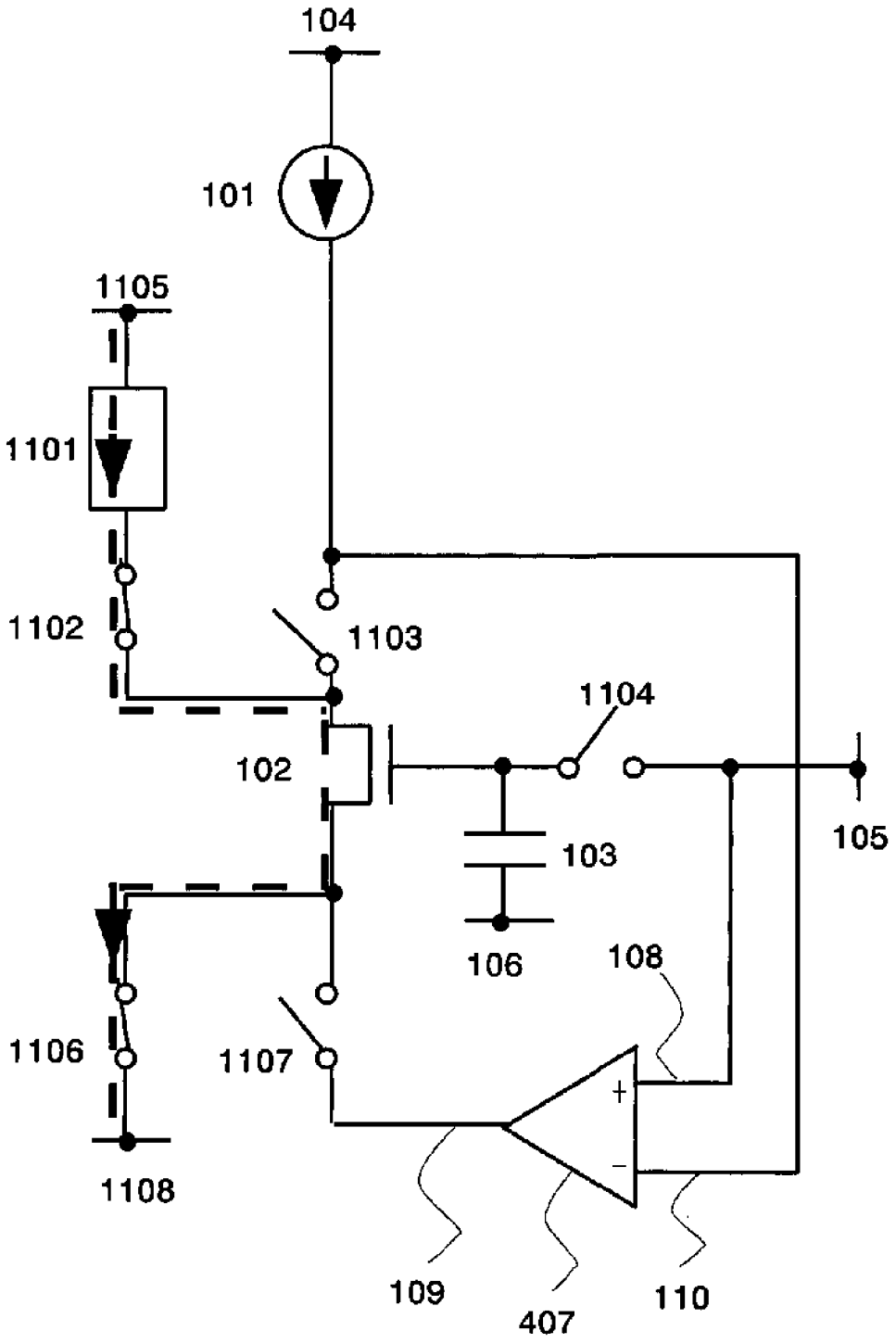
FIG. 15 shows an operation of a semiconductor device of the invention.

An operation of FIG. 11 is described taking for example the case of an operational amplifier being used as the amplifier circuit 107. First, as shown in FIG. 12, switches 1103, 1104 and 1107 are turned on. Then, an operational amplifier 407 controls a source potential of the current source transistor 102 so that the current source transistor 102 may flow a current Idata supplied from the current source circuit 101 while operating in a saturation region. Since the operational amplifier 407 is used at this time, writing can be carried out quickly. Subsequently, the switch 1104 is turned off as shown in FIG. 13, and thereby the gate potential of the current source transistor 102 is held in the capacitor element 103. When the switches 1103 and 1107 are turned off as shown in FIG. 14, current supply is stopped. Then, switches 1102 and 1106 are turned on as shown in FIG. 15, and thereby a current is supplied to a load 1101. The amount of current at this time is equal to the Idata when the current source transistor 102 operates in a saturation region. That is, even when there are variations in current characteristics and size of the current source transistor 102, influences thereof can be prevented.

In the case of the wiring 106 being added with a certain potential, the source potential of the current source transistor 102 in writing and setting a current (FIG. 12) may differ from that in outputting a current (FIG. 15). In that case, the gate-source voltage of the current source transistor 102 may vary. Variation of the gate-source voltage leads to variation of a current value. Thus, the gate-source voltage in writing and setting a current (FIG. 12) has to be equal to that in outputting a current (FIG. 15). In order to achieve this, for instance, the wiring 106 may be connected to the source terminal of the current source transistor 102. Accordingly, the gate-source voltage can be kept constant even when the source potential of the current source transistor 102 varies, since the gate potential varies depending on the variation of the source potential.

Alternatively, a potential of the wiring 1108 may be controlled so as to be equal to an output potential of the operational amplifier 407 in writing and setting a current. For instance, a voltage follower circuit or the like may be connected to the wiring 1108 to control the potential of the wiring 1108.

Figure 16:
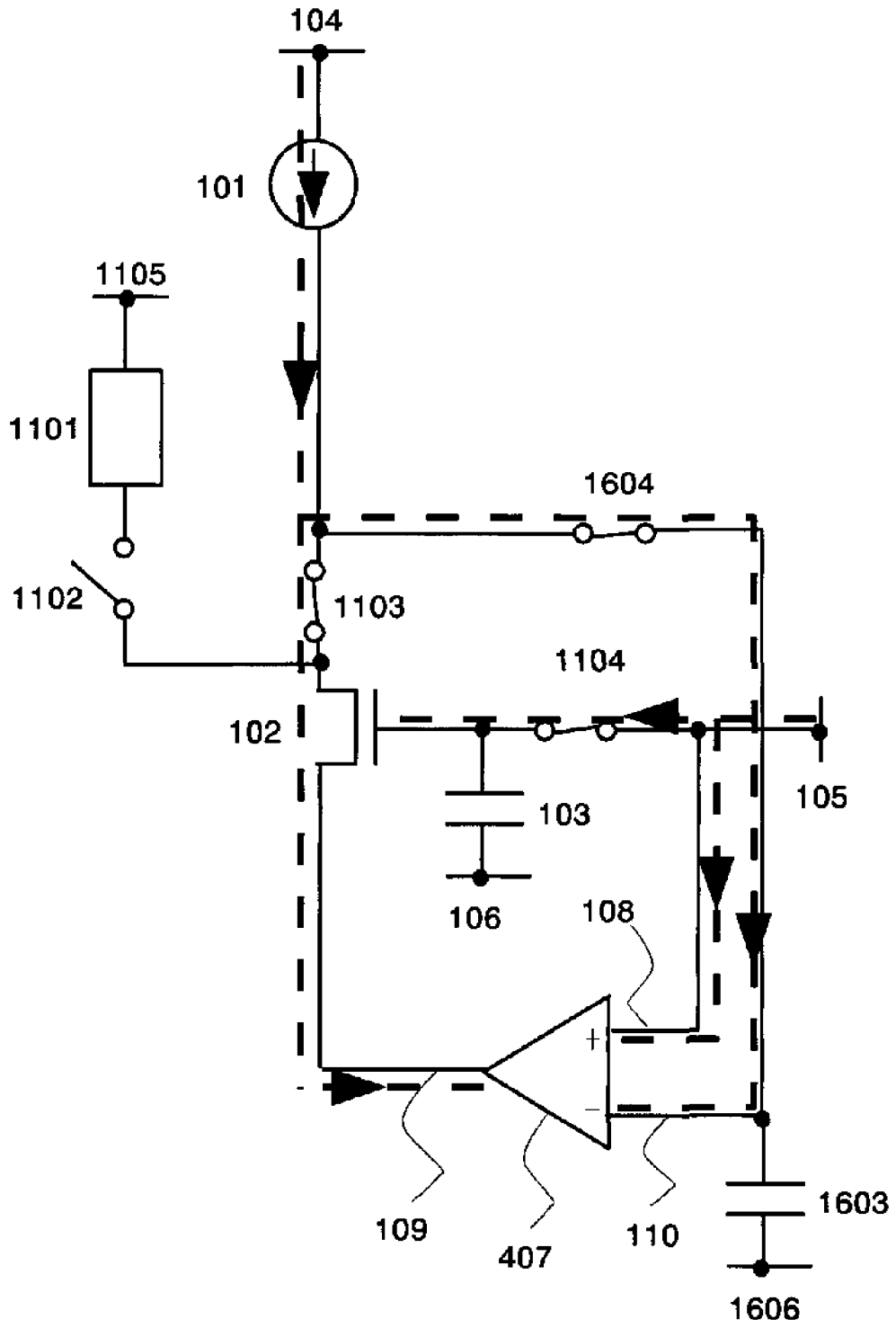
FIG. 16 shows an operation of a semiconductor device of the invention.
Figure 17:
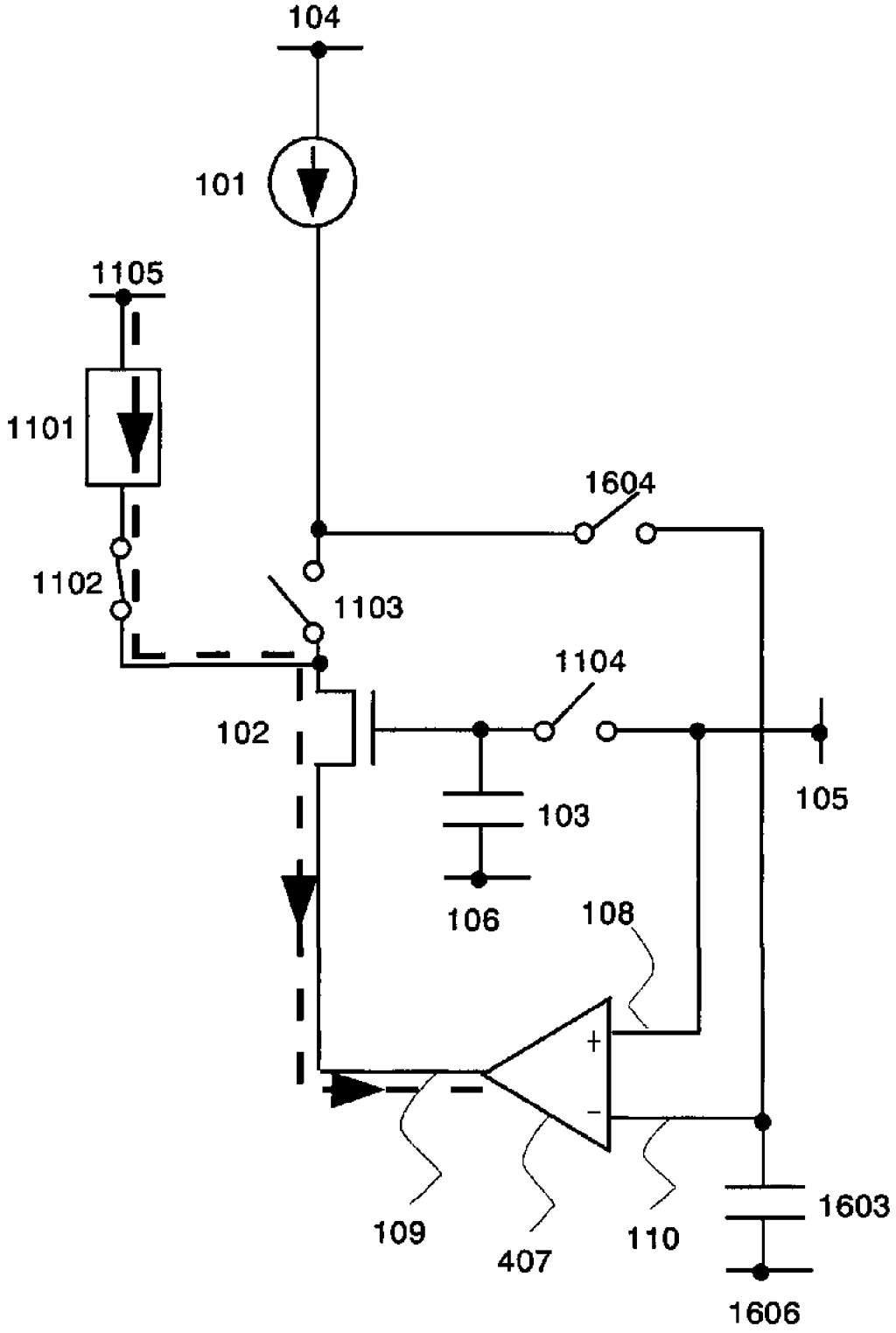
FIG. 17 shows an operation of a semiconductor device of the invention.

Instead, as shown in FIGS. 16 and 17, a capacitor element 1603 may be disposed between the second input terminal 110 and the wiring 1106, and electric charges may be held by a switch 1604, thereby a current may be supplied from the operational amplifier 407 in outputting a current (FIG. 17) as well as in writing and setting a current (FIG. 16).

Although various wirings (the wiring 105, the wiring 1108, the wiring 1105 and the like) are provided in the circuit shown in FIG. 11, these wirings may be connected as long as a normal operation can be performed. For example, the wiring 105 and the wiring 1108 operate at nearly equal potentials, thus, the wirings can be connected to each other to simplify the circuit configuration and reduce the layout area. Furthermore, the wiring 1105 and the wiring 104 may be connected to each other, because the operation is not much influenced by the connection.

Figure 18:
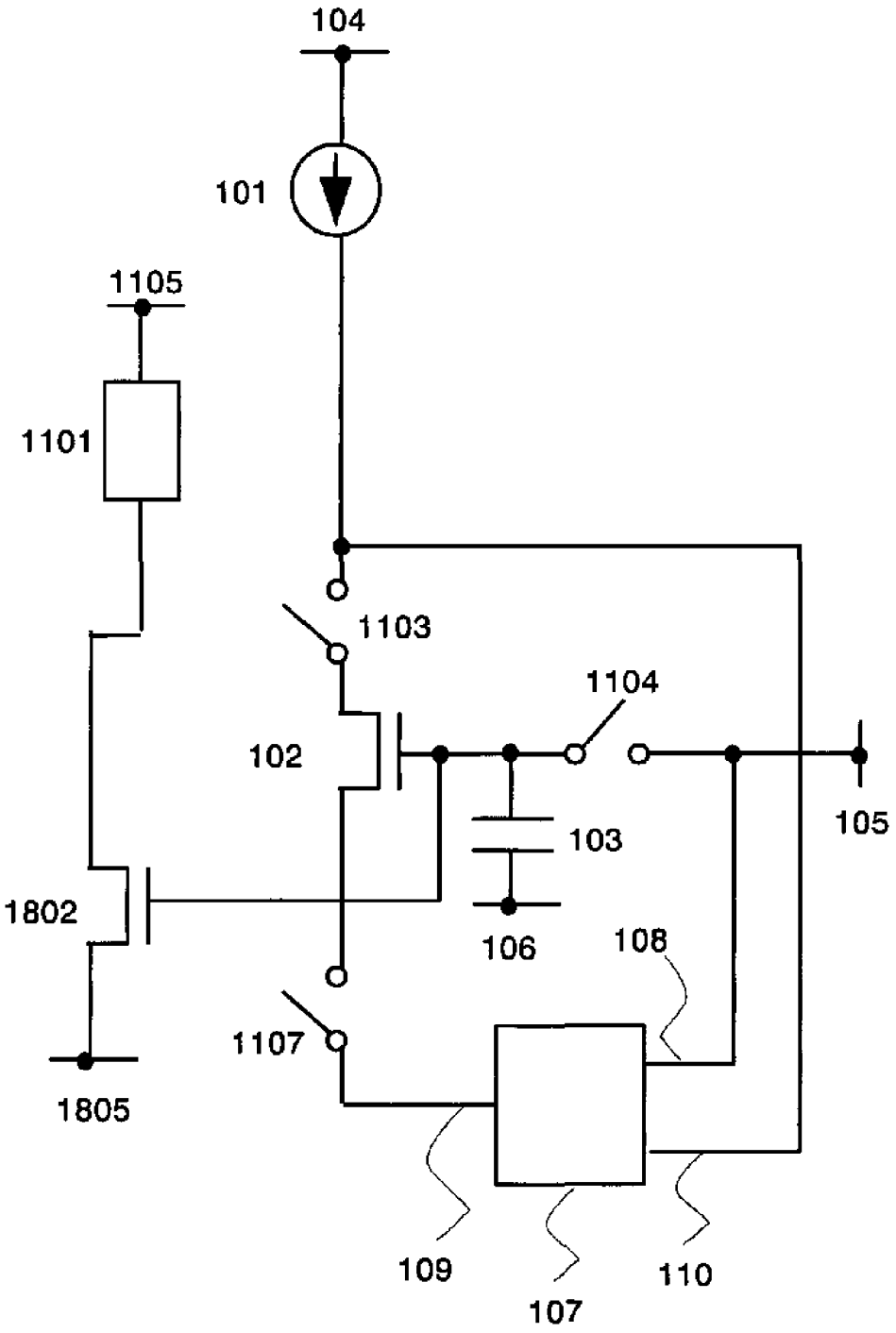
FIG. 18 shows a structure of a semiconductor device of the invention.

Next, FIG. 18 shows a configuration diagram in which a current is supplied to the load 1101 by using a transistor other than the current source transistor. A gate terminal of the current transistor 1802 is connected to the gate terminal of the current source transistor 102. Thus, the current transistor 1802 can supply a current in accordance with the gate potential of the current source transistor 102. In addition, when the W/L of the current source transistor 102 and the current transistor 1802 is adjusted, the amount of current supplied to the load 1101 can be changed. For example, when the W/L of the current transistor 1802 is small, the amount of current supplied to the load 1101 is reduced, and thereby the amount of Idata can be increased. As a result, writing of current can be carried out quickly. However, when there are variations in current characteristics of the current source transistor 102 and the current transistor 1802, influences thereof are inevitable.

Figure 19:
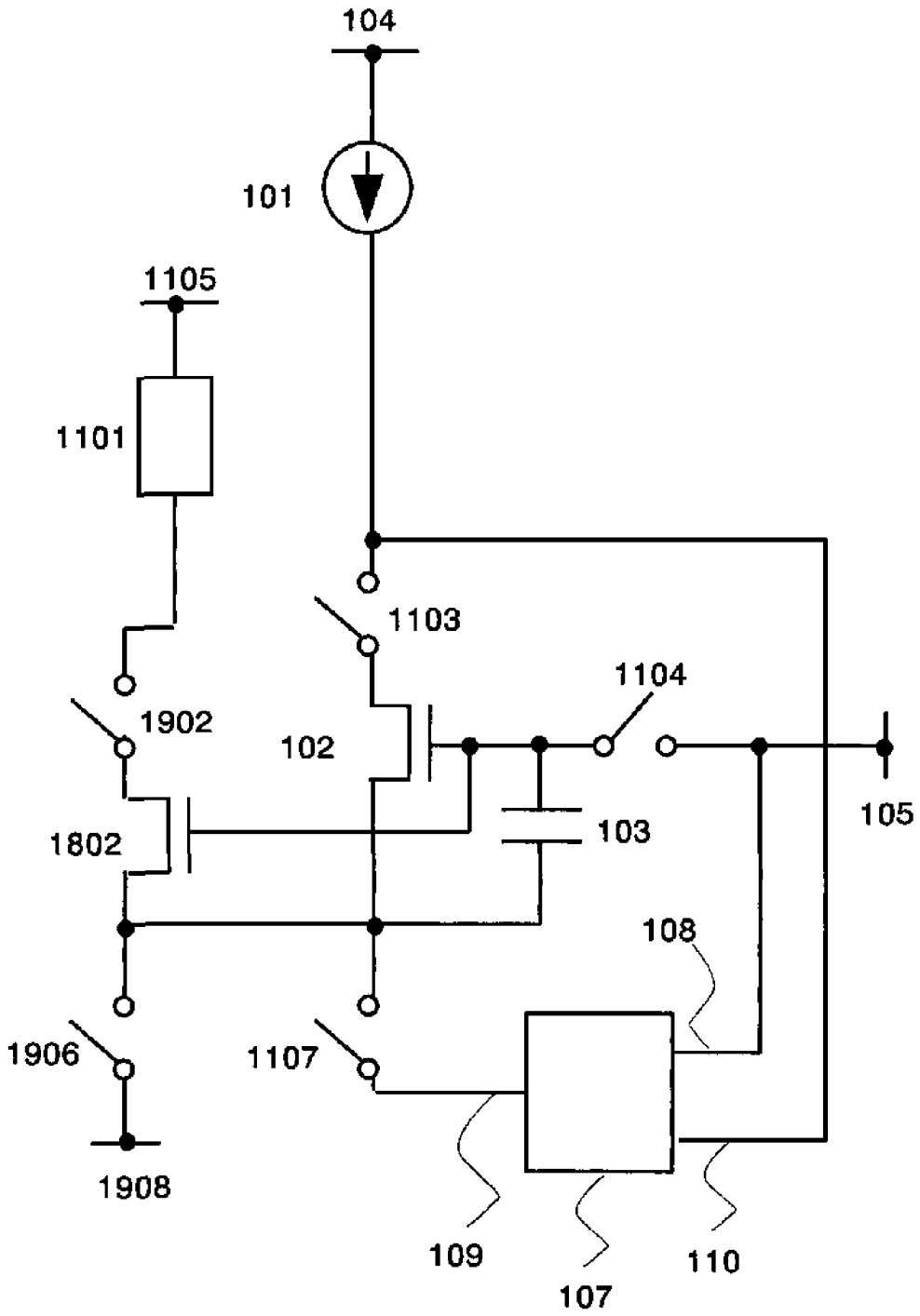
FIG. 19 shows a structure of a semiconductor device of the invention.
Figure 20:
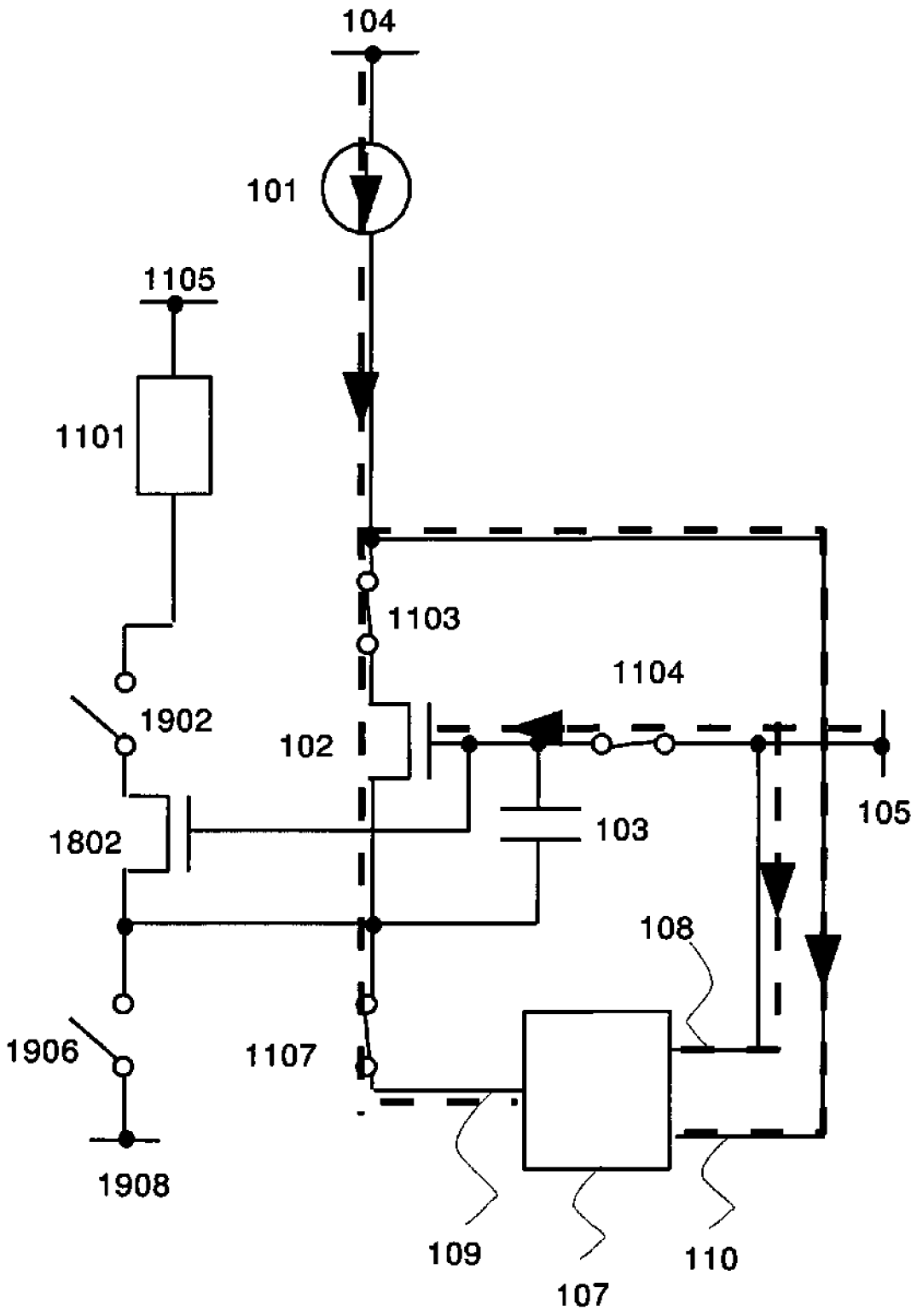
FIG. 20 shows an operation of a semiconductor device of the invention.
Figure 21:
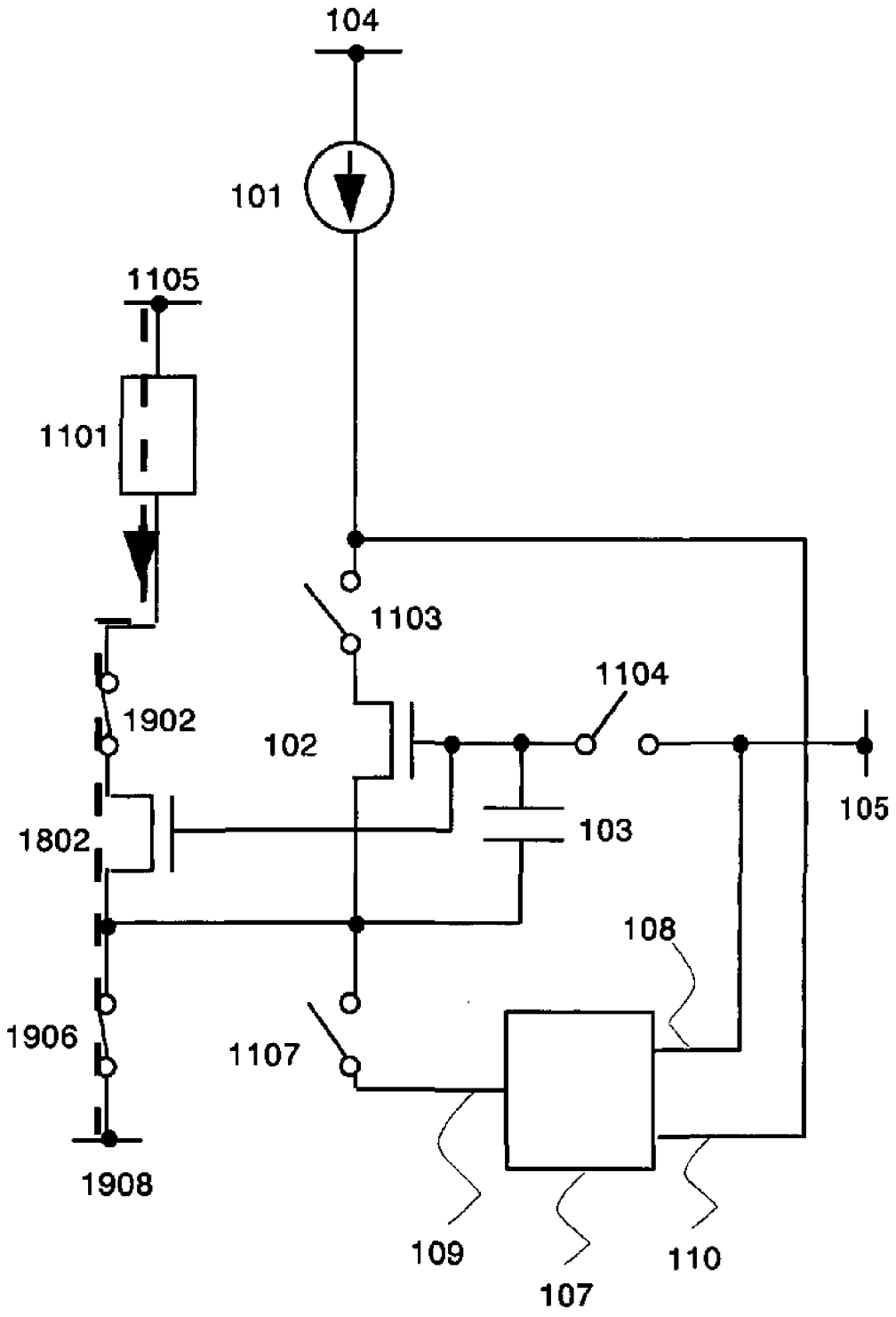
FIG. 21 shows an operation of a semiconductor device of the invention.
Figure 22:
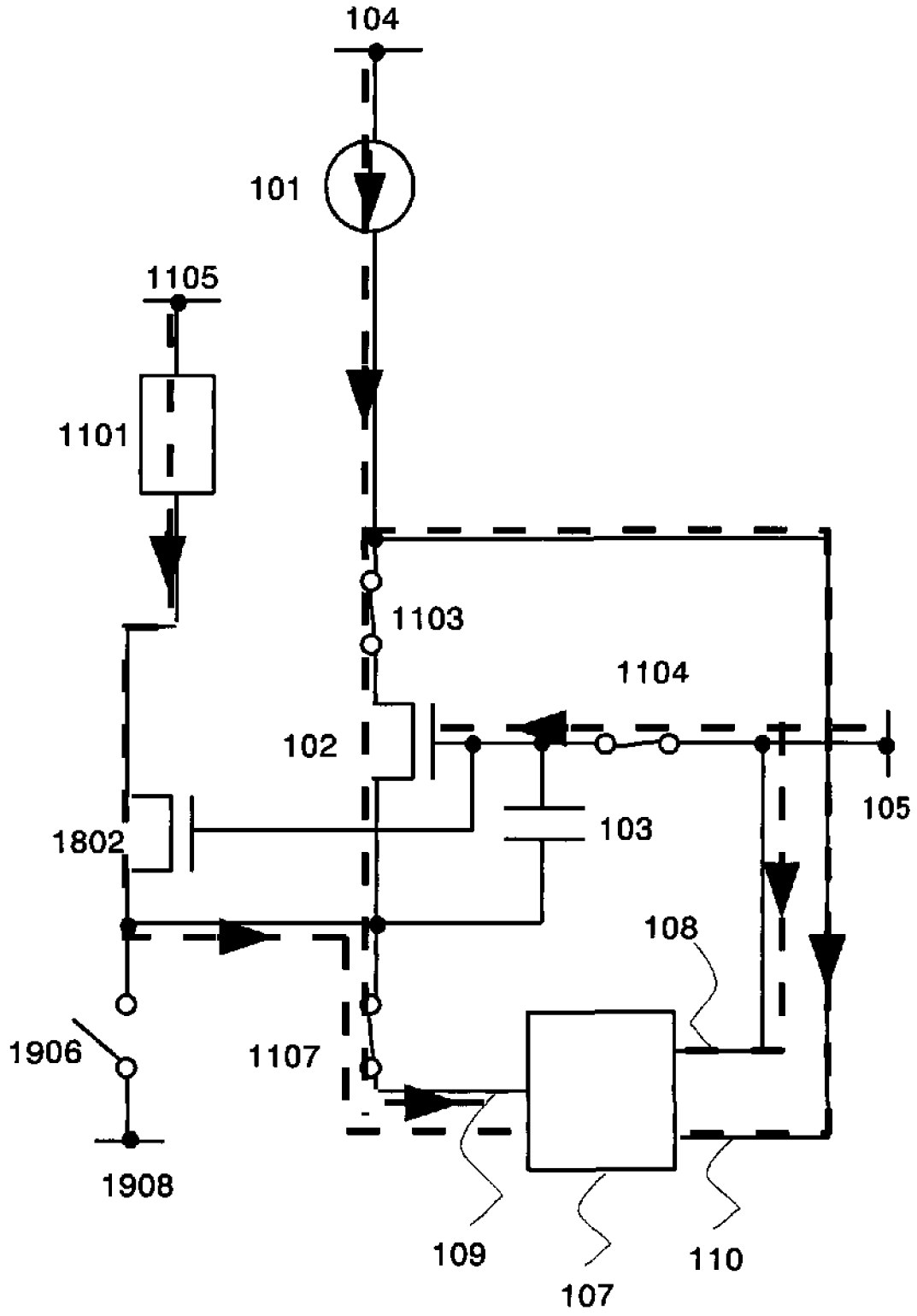
FIG. 22 shows an operation of a semiconductor device of the invention.

In order that the gate-source voltages of the current source transistor 102 and the current transistor 1802 in writing and setting a current are equal to those in outputting a current, a switch 1906 and a wiring 1908 may be connected to each other as shown in FIG. 19. Operations of FIG. 19 are shown in FIGS. 20 and 21. FIG. 20 shows an operation in writing and setting a current whereas FIG. 21 shows an operation in outputting a current. Note that a switch 1902 has a function to prevent an unnecessary current from flowing when a current being written and set, and to prevent incorrect setting. Therefore, in the case where when writing and setting a current, a current flows as shown in FIG. 22 and the setting can be carried out correctly, the switch 1902 may be omitted as shown in FIG. 22.

It is to be noted that wirings may be connected to each other as long as a normal operation can be performed. Thus, in FIG. 19 and FIG. 22, the wiring 105 may be connected to the wiring 1908.

Figure 23:
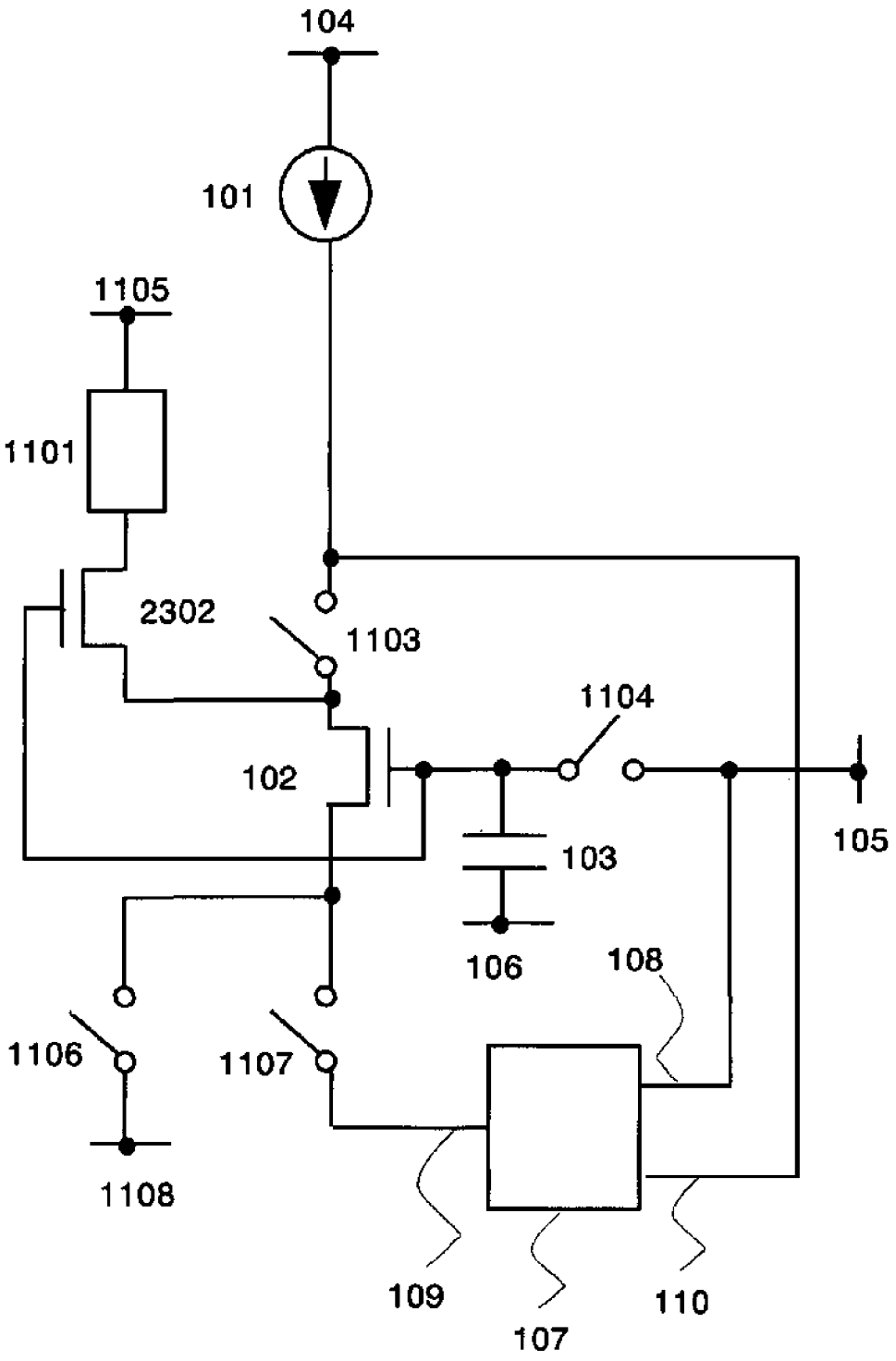
FIG. 23 shows a structure of a semiconductor device of the invention.

FIG. 23 shows a configuration diagram in which a current is supplied to the load 1101 by using another transistor as well as the current source transistor 102. In the case of the current Idata being supplied from the current source circuit 101, when the current leaks to the load 1101 or a current leaks from the load 1101, a proper current cannot be set. The current is controlled by the switch 1102 in the case of FIG. 11, while it is controlled by a multi-transistor 2302 in the case of FIG. 23. A gate terminal of the multi-transistor 2302 is connected to the gate terminal of the current source transistor 102. Therefore, when the switches 1103 and 1104 are on and the current source transistor 102 operates in a saturation region, the multi-transistor 2302 is off. Thus, it does not adversely affect when the current Idata is supplied from the current source circuit 101. On the other hand, when a current is supplied to the load 1101, the current source transistor 102 and the multi-transistor 2302 whose gate terminals are connected to each other operate as a multi-gate transistor. Accordingly, a current smaller than the Idata is supplied to the load 1101. Since the amount of current supplied to the load becomes smaller, the amount of Idata can be increased. As a result, writing of current can be carried out quickly. When there are variations in current characteristics of the current source transistor 102 and the multi-transistor 2302, influences thereof are inevitable. However, a current is supplied to the load 1101 by using also the current source transistor 102, thus influences of the variations can be suppressed.

Figure 24:
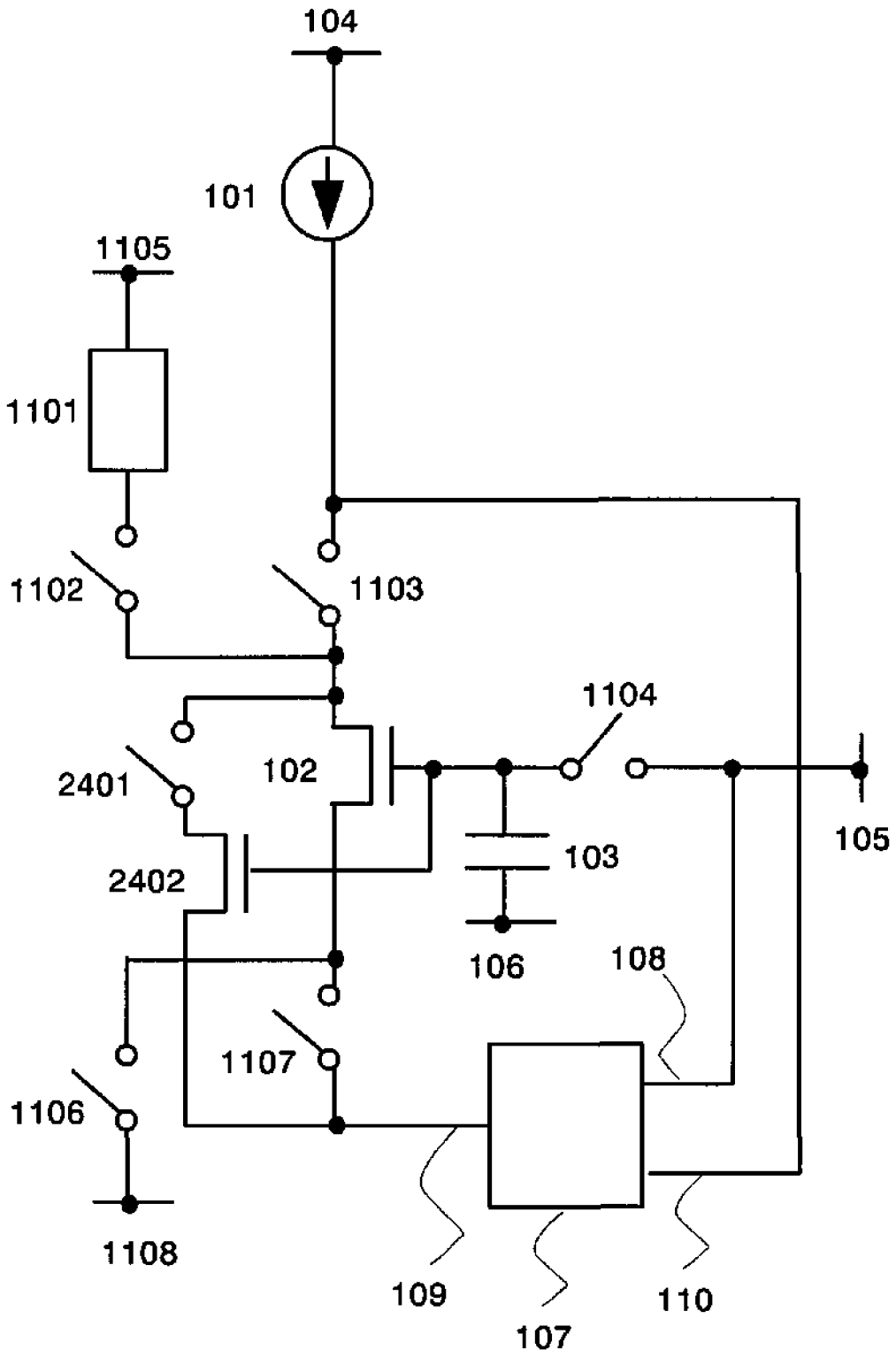
FIG. 24 shows a structure of a semiconductor device of the invention.

FIG. 24 shows a configuration for increasing the current Idata supplied from the current source circuit 101 in a different manner than the one shown in FIG. 18 or 23. In FIG. 24, a parallel transistor 2402 is connected in parallel with the current source transistor 102. Therefore, when a current is supplied from the current source circuit 101, a switch 2401 is turned on. Meanwhile, in the case of a current being supplied to the load 1101, the switch 2401 is turned off. According to this, the current supplied to the load 1101 becomes smaller, and thereby the current Idata supplied from the current source circuit 101 can be increased.

In that case, however, variations of the parallel transistor 2402 and the current source transistor 102 have an effect. Thus, in the case of FIG. 24, when a current is supplied from the current source circuit 101, the amount of the current may vary. That is, a large current is supplied first and the switch 2401 is turned on in accordance with the current. Then, a current flows into the parallel transistor 2402 and writing of current can be carried out quickly. In other words, this corresponds to a precharge operation. Subsequently, the current supplied from the current source circuit 101 is reduced, and the switch 2401 is turned off. Thus, the current is supplied and written to the current source transistor 102 only. According to this, influences of variations can be prevented. Then, the switch 1102 is turned on and a current is supplied to the load 1101.

Figure 25:
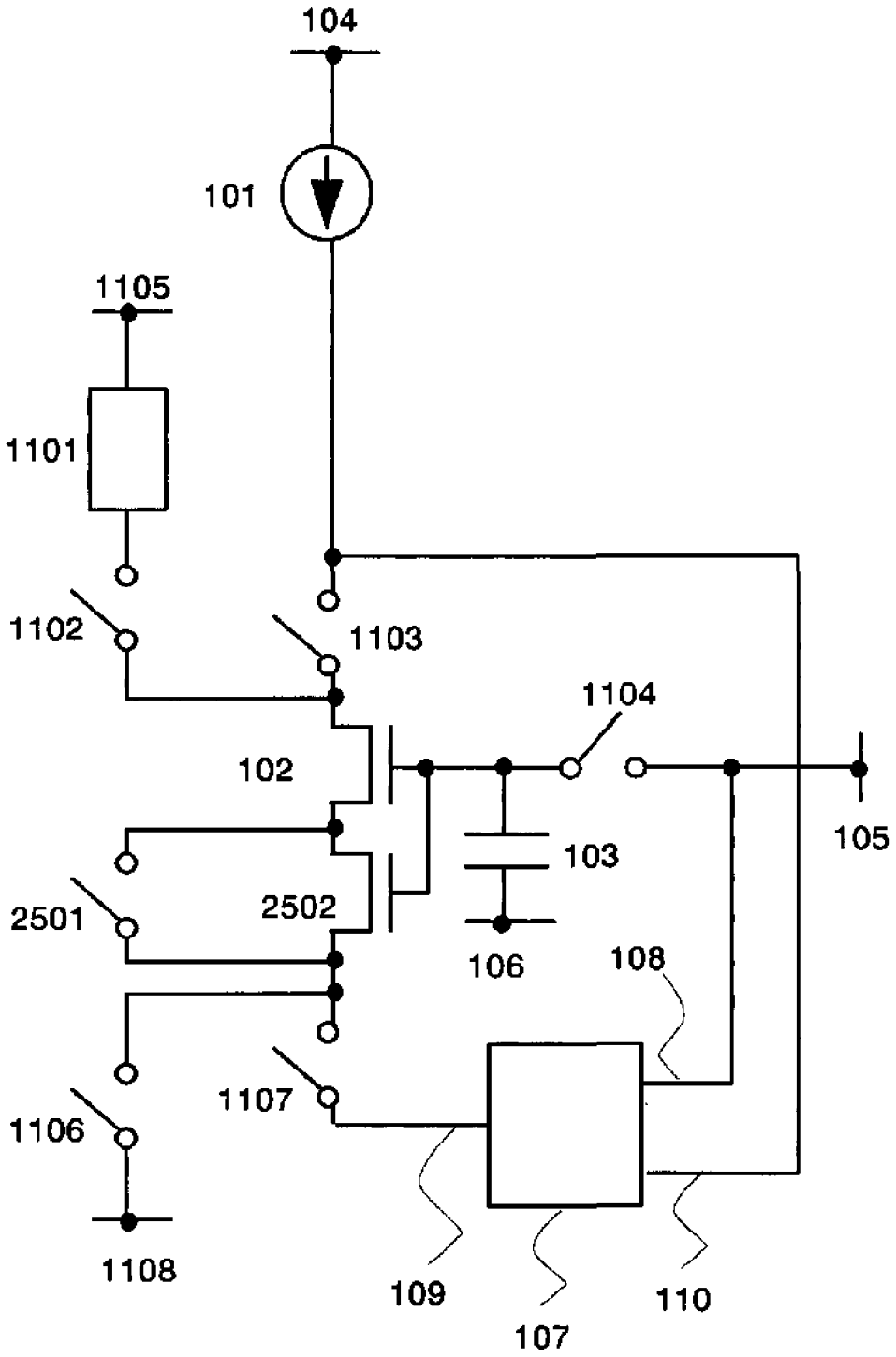
FIG. 25 shows a structure of a semiconductor device of the invention.

In FIG. 24, the transistor is added in parallel with the current source transistor. FIG. 25 shows a configuration diagram in which a transistor is added in series. In FIG. 25, a series transistor 2502 is connected in series with the current source transistor 102. Therefore, when a current is supplied from the current source circuit 101, a switch 2501 is turned on, and thereby a source and a drain of the series transistor 2002 are short-circuited. When a current is supplied to the load 1101, the switch 2501 is turned off. Thus, the current source transistor 102 and the series transistor 2502 whose gate terminals are connected to each other operate as a multi-gate transistor. Accordingly, the gate length L is increased and the amount of current flowing into the load 1101 is reduced, and thereby the current Idata supplied from the current source circuit 101 can be increased.

In that case, however, variations of the series transistor 2502 and the current source transistor 102 have an effect. Thus, in the case of FIG. 25, when a current is supplied from the current source circuit 101, the amount of the current may vary. That is, a large current is supplied first and the switch 2501 is turned on in accordance with the current. Then, a current flows only into the current source transistor 102 and writing of current can be carried out quickly. In other words, this corresponds to a precharge operation. Subsequently, the current supplied from the current source circuit 101 is reduced, and the switch 2501 is turned off. Thus, the current is supplied and written to the current source transistor 102 and the series transistor 2502. According to this, influences of variations can be prevented. Then, the switch 1102 is turned on and a current is supplied to the load 1101 by the current source transistor 102 and the series transistor 2502 that constitute a multi-gate transistor.

It is to be noted that various configurations shown in FIGS. 11 to 25 may be combined to obtain another configuration.

Figure 26:
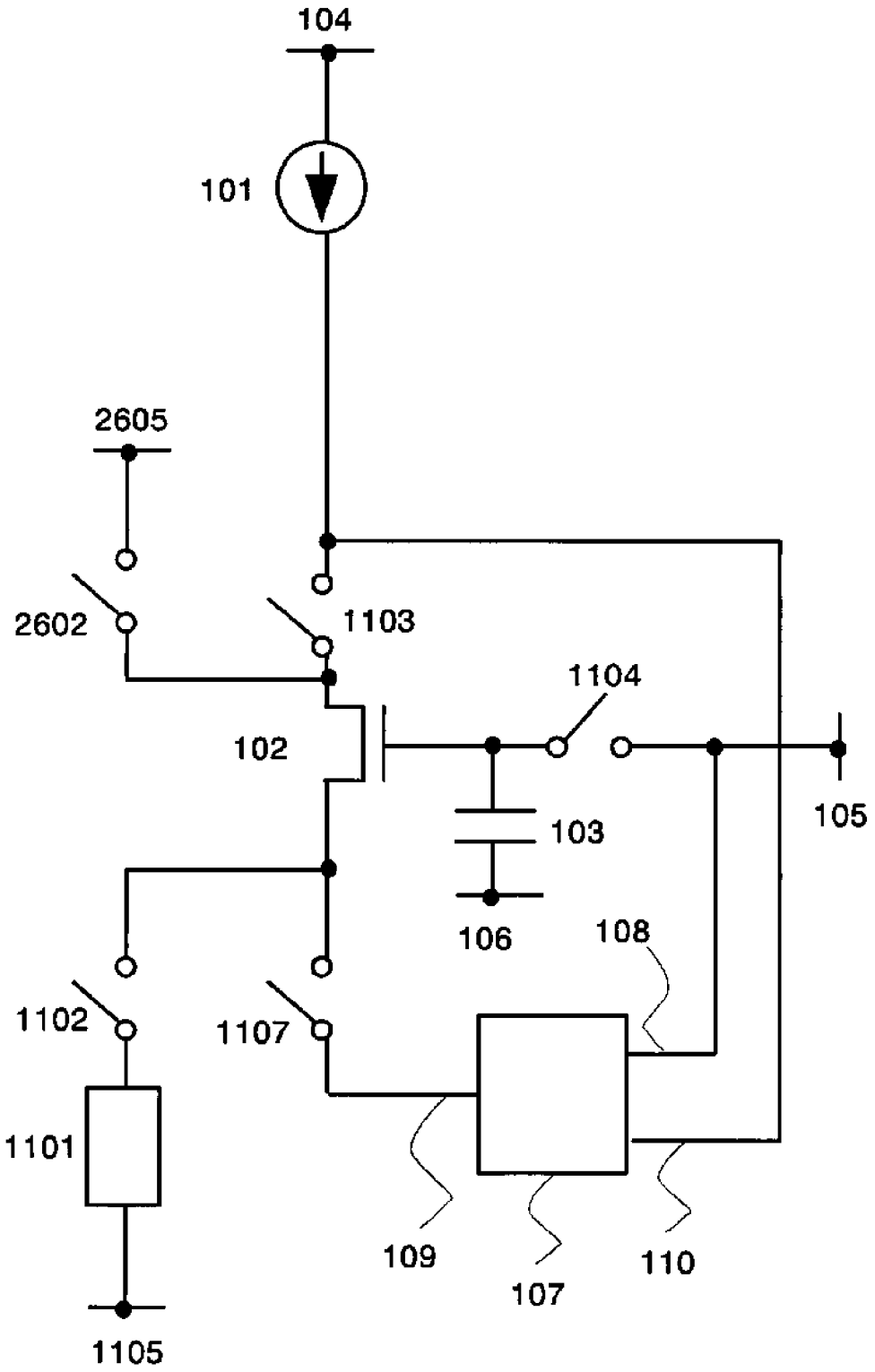
FIG. 26 shows a structure of a semiconductor device of the invention.

Although the current source circuit 101 and the load 1101 are switched over in FIGS. 11 to 25, the invention is not limited to this. For example, the current source circuit 101 and a wiring may be switched over. FIG. 26 shows a configuration corresponding to FIG. 11, in which the current source circuit 101 and a wiring are switched over. An operation of FIG. 26 is described hereinafter. First, the current Idata is supplied from the current source circuit 101 to the current source transistor 102, and the switches 1103, 1104 and 1107 are turned on in the case of a current being set. Then, the current source transistor 102 operates as a current source circuit, and the switches 1103, 1104 and 1107 are turned off while switches 2602 and 1102 are turned on in the case of a current being supplied to the load. In this manner, when the switches 1103 and 2602 are turned on/off, the current source circuit 101 and a wiring 2605 are switched over.

In the case of the current Idata being supplied from the current source circuit 101 to the current source transistor 102, the switch 1102 is turned off and a current is prevented from flowing into the load 1101, though the invention is not limited to this. When the current Idata is supplied from the current source circuit 101 to the current source transistor 102, a current may flow into the load 1101. In that case, the switch 1102 may be omitted.

The capacitor element 103 holds the gate potential of the current source transistor 102. It is more desirable that the wiring 106 be connected to the source terminal of the current source transistor 102 in order to hold the gate-source voltage.

Note that FIG. 26 shows a configuration diagram corresponding to FIG. 11, in which the current source circuit 101 and the load 1101 are switched over, though the invention is not limited to this. A configuration in which the current source circuit 101 and the load 1101 are switched over can be achieved in any one of the configurations shown in FIGS. 11 to 25.

It is to be noted that although the switches are arranged in each part in the configurations described above, the arrangement is not limited to the foregoing. The switches may be disposed anywhere as long as they operate normally.

Figure 27:
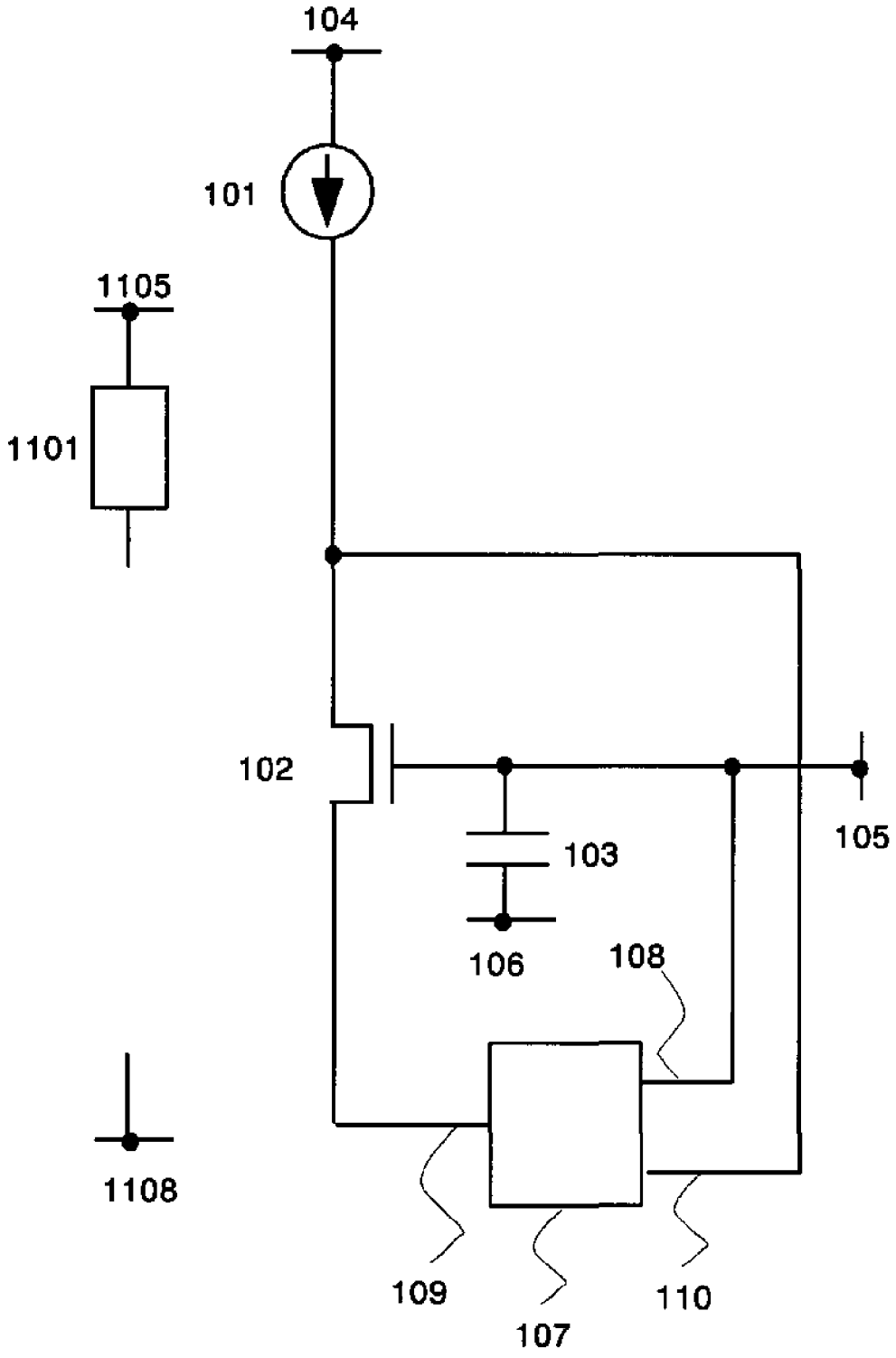
FIG. 27 shows an operation of a semiconductor device of the invention.
Figure 28:
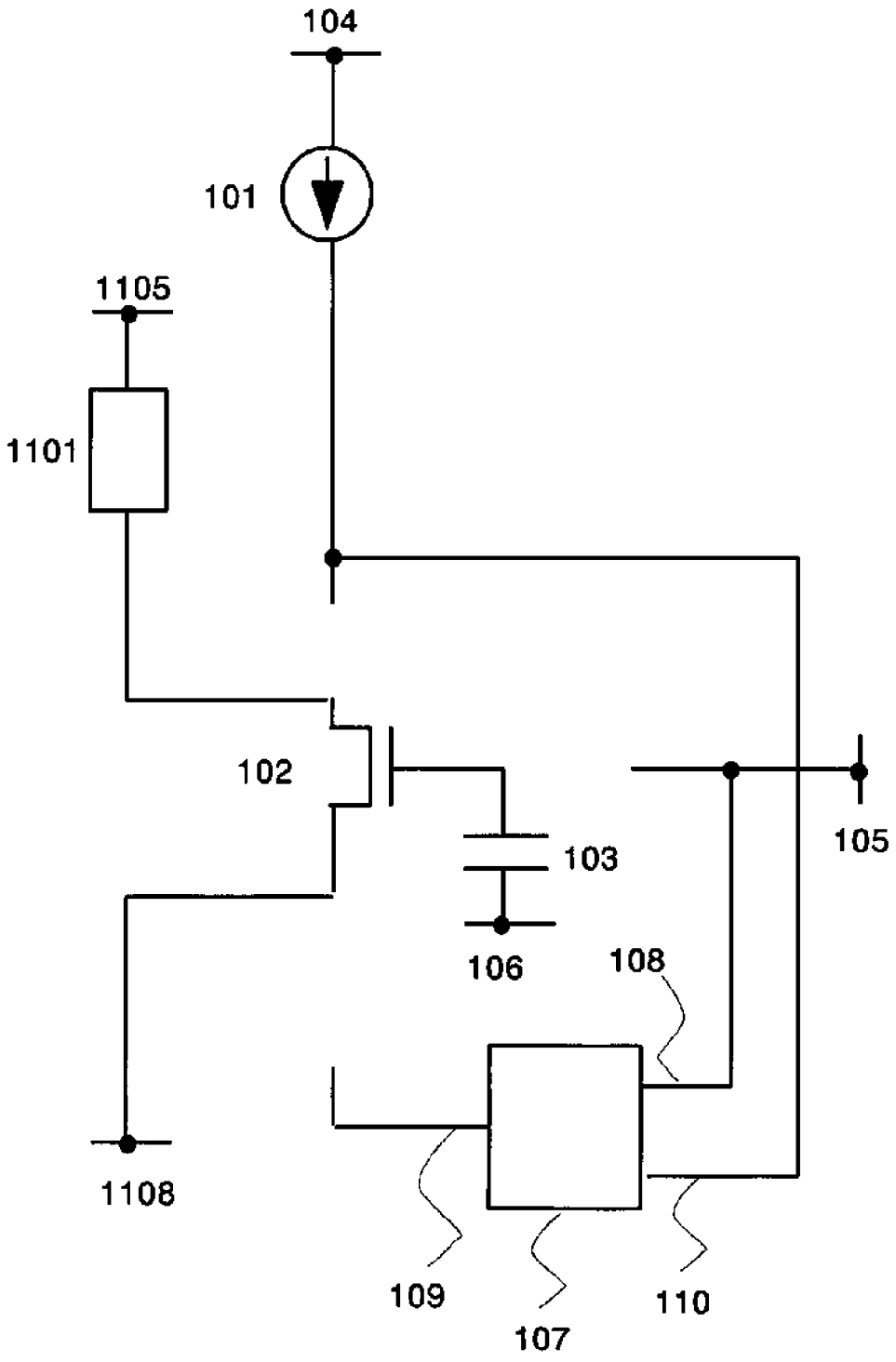
FIG. 28 shows an operation of a semiconductor device of the invention.
Figure 29:
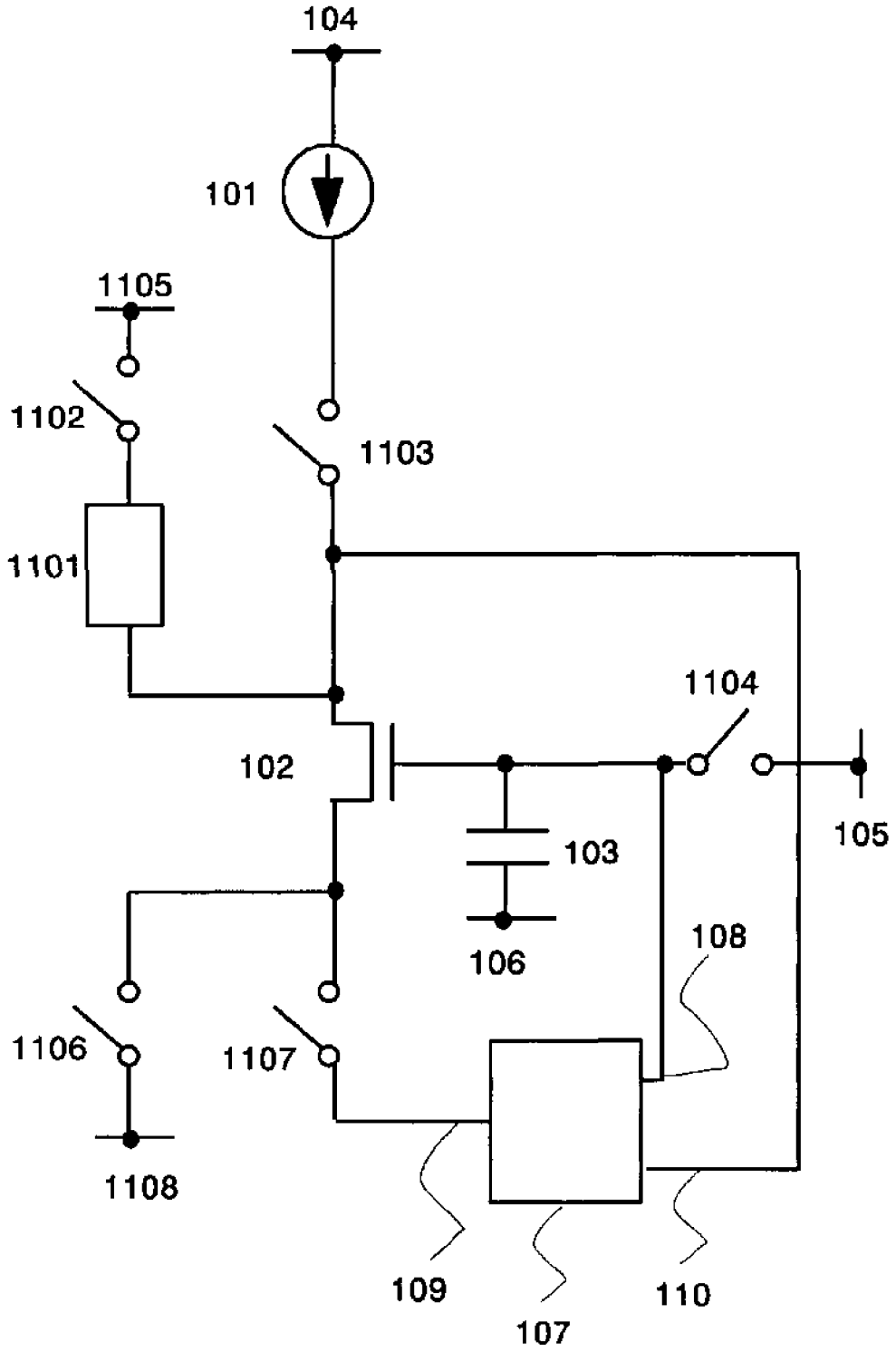
FIG. 29 shows a structure of a semiconductor device of the invention.

In the case of the configuration shown in FIG. 11, for instance, the connection as shown in FIG. 27 may be adopted when the current Idata is supplied from the current source circuit 101 to the current source transistor 102, while the connection as shown in FIG. 28 may be adopted when the current source transistor 102 operates as a current source circuit and a current is supplied to the load 1101. Thus, the configuration shown in FIG. 11 may be connected as shown in FIG. 29. The arrangement of the switches 1102, 1103 and 1104 is modified in FIG. 29, though a normal operation can be performed.

Figure 30:
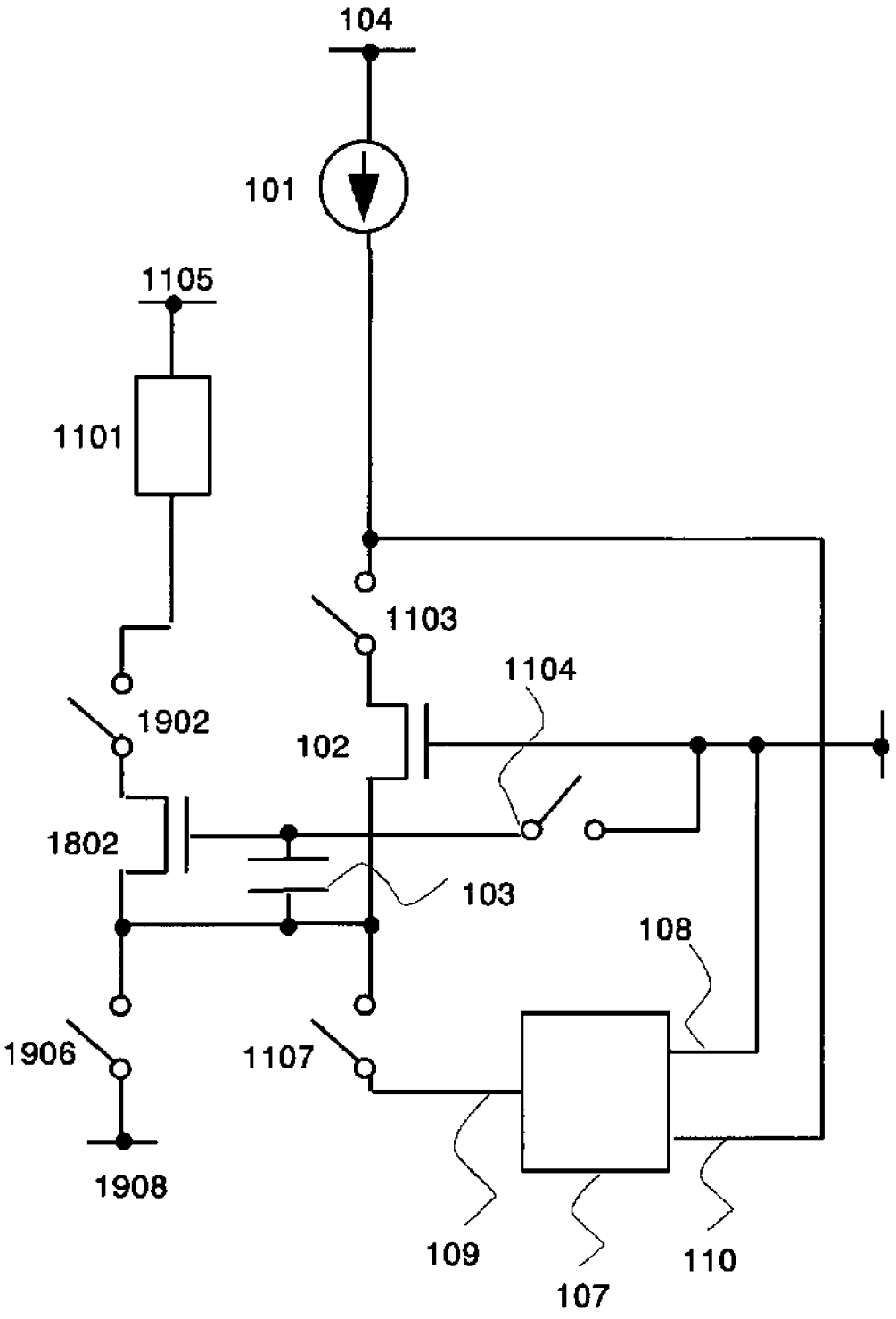
FIG. 30 shows a structure of a semiconductor device of the invention.

Similarly, the configuration shown in FIG. 19 may be connected as shown in FIG. 30. The arrangement of the switch 1104 is modified in FIG. 30, though a normal operation can be performed.

Note that the switches shown in FIG. 11 and the like may be any one of electrical ones and mechanical ones as long as a current flow can be controlled. They may be transistors, diodes, or logic circuits made of combinations thereof. When a transistor being used as a switch, since it operates only as a switch, the polarity (conductivity type) of the transistor is not particularly restricted. However, in the case of an off current being desirable to be small, it is desirable to use a transistor having the polarity less in the off current. As a transistor less in the off current, there is the one in which an LDD region is disposed, and the like. Furthermore, when a transistor functioning as a switch operates in a state where a potential of a source terminal thereof is close to a low potential side power source (Vss, Vgnd, 0 V and the like), an n-channel type is desirably used. On the contrary, when a transistor operates in a state where a potential of the source terminal is close to a high potential side power source (Vdd and the like), a p-channel type is desirably used. The reason for this is that since the absolute value of a gate-source voltage can be made larger, the transistor can efficiently operate as a switch. With both an n-channel type and a p-channel type, a CMOS type switch may be formed.

Although various examples are shown above, the invention is not limited to this. The current source transistor and various transistors operating as current sources may be disposed in various configurations. In addition, wirings may be connected to each other within a range a normal operation can be performed. Therefore, the invention can be applied to any configuration as long as a similar operation can be performed.

It is to be noted that this embodiment mode is described with reference to the configurations shown in Embodiment Modes 1 and 2. However, the invention is not limited to this and various changes and modifications are possible unless such changes and modifications depart from the scope of the invention. Therefore, the descriptions in Embodiment Modes 1 and 2 can be applied to this embodiment mode.

Embodiment Mode 4

The configurations each including one current source circuit and one current source transistor are described above. Described in this embodiment mode is the case where a plurality of current source transistors and the like are disposed.

Figure 31:
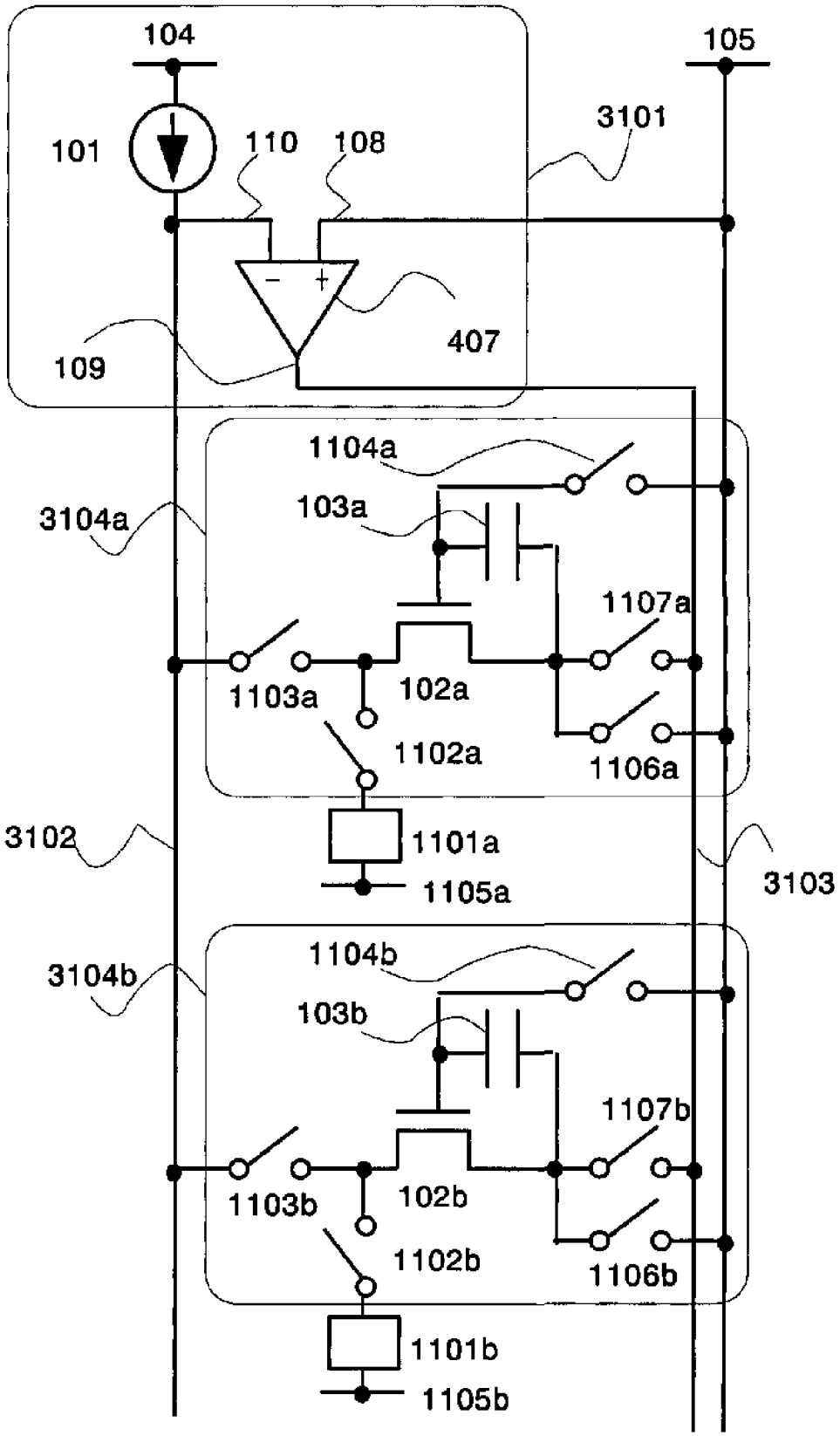
FIG. 31 shows a structure of a semiconductor device of the invention.

FIG. 31 shows a configuration corresponding to FIG. 12, in which a plurality of current source transistors are disposed. In FIG. 31, one current source circuit 101 and one operational amplifier 407 are disposed for a plurality of current source transistors 102*a* and 102*b*. A plurality of current source circuits or a plurality of operational amplifiers may be disposed for a plurality of current source transistors. However, since the circuit area increases, one current source circuit 101 and one operational amplifier 407 are preferably disposed. Though, the amplifier circuit (source follower circuit 907) in FIG. 9 is constituted by two transistors in many cases, thus, a plurality of amplifier circuits (source follower circuits) may be disposed for a plurality of current source transistors.

A configuration of FIG. 31 is described next. First, the current source circuit 101 and the operational amplifier 407 are disposed, which are collectively called a resource circuit 3101 hereinafter. The resource circuit 3101 is connected to a current line 3102 connected to the current source circuit 101 and a voltage line 3103 connected to an output terminal of the operational amplifier 407. The current line 3102 and the voltage line 3103 are connected to a plurality of unit circuits 3104*a* and 3104*b*. The unit circuit 3104*a* includes the current source transistor 102*a*, a capacitor element 103*a*, switches 1102*a*, 1103*a*, 1104*a*, 1106*a*, and 1107*a*, and the like. The unit circuit 3104*a* is connected to a load 1101*a* connected to a wiring 1105*a*. The unit circuit 3104*b* has a similar configuration to the unit circuit 3104*a*. The two unit circuits are connected herein for simplicity, though the invention is not limited to this. The number of unit circuits may be determined arbitrarily.

As for operations, since a plurality of unit circuits are connected to one current line 3102 and one voltage line 3103, each unit circuit is selected and a current and a voltage are sequentially supplied thereto from the resource circuit 3101 through the current line 3102 and the voltage line 3103. For example, the operation is carried out such that the switches 1103*a*, 1104*a* and 1107*a* are turned on first to input a current and a voltage to the unit circuit 3104*a*, and switches 1103*b*, 1104*b* and 1107*b* are turned on next to input a current and a voltage to the unit circuit 3104*b*.

These switches can be controlled by a digital circuit such as a shift register, a decoder circuit, a counter circuit, and a latch circuit.

In the case where the loads 1101*a*, 1101*b* and the like are display elements such as EL elements, the unit circuit and the load constitute one pixel, and the resource circuit 3101 corresponds to (a part of) a signal line driver circuit that supplies a signal to a pixel connected to a signal line (current line 3102 and voltage line 3103). In other words, FIG. 31 shows one column of pixels and (a part of) a signal line driver circuit. In that case, a current output from the current source circuit 101 corresponds to an image signal. When this image signal current is changed in an analog manner or a digital manner, the proper amount of current can be supplied to each of the loads 1101*a* and 1101*b* (display element such as EL element). At this time, the switches 1103*a*, 1104*a* and 1107*a*, the switches 1103*b*, 1104*b* and 1107*b*, and the like are controlled by a gate line driver circuit.

Further, in the case of the current source circuit 101 in FIG. 31 being (a part of) a signal line driver circuit, the current source circuit 101 is required to output a current accurately without being influenced by variations in current characteristics and size of transistors. Accordingly, the current source circuit 101 in (a part of) the signal line driver circuit is constituted by a circuit including a transistor that functions similarly to the current source transistors 102, 202, 302, and 10002, and a current can be supplied from another current source circuit to the current source transistor in (a part of) the signal line driver circuit. In other words, when the loads 1101*a*, 1101*b* and the like in FIG. 31 are a signal line, a pixel connected to the signal line, and the like, the unit circuits 3104*a* and 3104*b* constitute (a part of) the signal line driver circuit, and the resource circuit 3101 is (a part of) a current source circuit that supplies a signal to a current source transistor (current source circuit) in the signal line driver circuit connected to the current line 3102. That is, FIG. 31 shows a plurality of signal lines, (a part of) a signal line driver circuit, and (a part of) a current source circuit that supplies a current to the signal line driver circuit.

In such a case, a current output from the current source circuit 101 corresponds to a current supplied to a signal line and a pixel. Therefore, in the case of, for instance, a current corresponding to a current output from the current source circuit 101 being supplied to a signal line and a pixel connected to the signal line, the current output from the current source circuit 101 corresponds to an image signal. When this image signal current is changed in an analog manner or a digital manner, the proper amount of current can be supplied to each load (a signal line and a pixel connected to the signal line). At this time, the switches 1103*a*, 1104*a* and 1107*a*, the switches 1103*b*, 1104*b* and 1107*b*, and the like are controlled by a circuit (shift register, latch circuit and the like) that is a part of the signal line driver circuit.

It is to be noted that the circuit or the like (shift register, latch circuit or the like) for controlling the switches 1103*a*,

1104*a* and 1107*a* and the switches 1103*b*, 1104*b* and 1107*b* is disclosed in International Publication WO 03/038796, International Publication WO 03/038797, and the like. The invention can be implemented in combination with the descriptions thereof.

Alternatively, in the case of a predetermined amount of current being output from the current source circuit 101, a switch or the like being used for controlling whether to supply the current, and a current corresponding thereto being supplied to a signal line and a pixel, the current output from the current source circuit 101 corresponds to a signal current for supplying a predetermined amount of current. The switch for determining whether to supply a current to a signal line and a pixel is controlled in a digital manner to control the amount of current supplied to the signal line and the pixel, and thereby the proper amount of current can be supplied to each load (signal line and pixel). In that case, the switches 1103*a*, 1104*a* and 1107*a*, the switches 1103*b*, 1104*b* and 1107*b*, and the like are controlled by a circuit (shift register, latch circuit or the like) that is a part of a signal line driver circuit. At this time, however, a driver circuit (shift register, latch circuit or the like) is needed for controlling the switch that determines whether to supply a current to a signal line and a pixel. Accordingly, the driver circuit (shift register, latch circuit or the like) for controlling the switch is required as well as a driver circuit (shift register, latch circuit or the like) for controlling the switches 1103*a*, 1104*a* and 1107*a*, the switches 1103*b*, 1104*b* and 1107*b*, and the like. These driver circuits may be provided separately. For example, a shift register for controlling the switches 1103*a*, 1104*a* and 1107*a*, and the switches 1103*b*, 1104*b* and 1107*b* may be provided independently. Instead, the driver circuit (shift register, latch circuit or the like) for controlling the switch and the driver circuit (shift register, latch circuit or the like) for controlling the switches 1103*a*, 1104*a* and 1107*a*, the switches 1103*b*, 1104*b* and 1107*b*, and the like may be shared partially or entirely. For instance, one shift register may be used for controlling both the switches, or an output (image signal) of a latch circuit and the like may be used in a driver circuit (shift register, latch circuit or the like) for controlling the switch that determines whether to supply a current to a signal line and a pixel.

It is to be noted that the driver circuit (shift register, latch circuit or the like) for controlling the switch that determines whether to supply a current to a signal line and a pixel and the driver circuit (shift register, latch circuit or the like) for controlling the switches 1103*a*, 1104*a* and 1107*a*, the switches 1103*b*, 1104*b* and 1107*b*, and the like are disclosed in International Publication WO 03/038793, International Publication WO 03/038794, International Publication WO 03/038795 and the like. The invention can be implemented in combination with the descriptions thereof.

Figure 32:
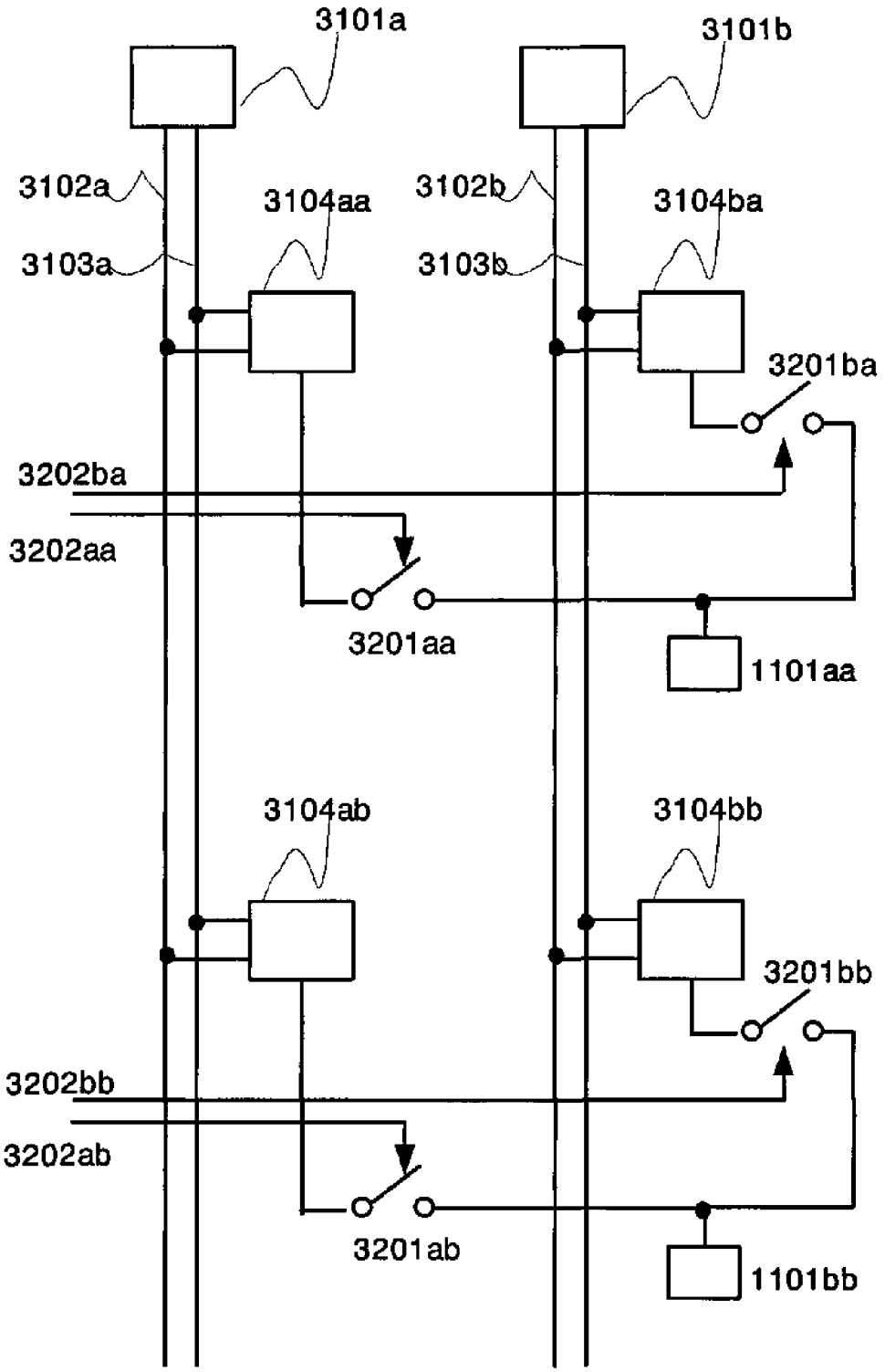
FIG. 32 shows a structure of a semiconductor device of the invention.

FIG. 31 shows the case in which the current source transistors 102*a* and 102*b* are disposed for the loads 1101*a* and 1101*b* respectively. Next, the case in which a plurality of current source transistors are disposed for one load is shown in FIG. 32. Two unit circuits are connected to one load herein for simplicity, though the invention is not limited to this. Three or more unit circuits may be connected or a single unit circuit may be connected. The amount of current flowing into a load 1101*aa* can be controlled by turning on/off a switch 3201*aa* and a switch 3201*ba*. In the case of, for instance, a current value (Iaa) output from a unit circuit 3104*aa* being different from a current value (Iba) output from a unit circuit 3104*ba*, four different amounts of current flowing into the load 1101*aa* can be controlled by turning on/off each the switch 3201*aa* and the switch 3201*ba*. For example, when Iba=2*Iaa is satisfied, the amount of current can be controlled by two bits. Therefore, in the case where the switch 3201*aa* and the switch 3201*ba* are turned on/off by digital data corresponding to each bit, a digital to analog conversion can be achieved by using the configuration shown in FIG. 32. Thus, in the case of the loads 1101*aa* and 1101*bb* being signal lines, (a part of) a signal line driver circuit can be obtained by using the configuration shown in FIG. 32. In this case, a digital image signal can be converted into an analog image signal current. The switch 3201*aa* and the switch 3201*ba* can be turned on/off by an image signal. Accordingly, the switch 3201*aa* and the switch 3201*ba* can be controlled by a circuit (latch circuit) and the like for outputting an image signal.

The switch 3201*aa* and the switch 3201*ba* may be turned on/off over time. For example, in a certain period, the switch 3201*aa* is turned on while the switch 3201*ba* is turned off, a current is set so as to be input from a resource circuit 3101*b* to the unit circuit 3104*ba* and output with accuracy, and a current is supplied from the unit circuit 3104*aa* to the load 1101*aa*. In another period, the switch 3201*aa* is turned off while the switch 3201*ba* is turned on, a current is set so as to be input from a resource circuit 3101*a* to the unit circuit 3104*aa* and output with accuracy, and a current is supplied from the unit circuit 3104*ba* to the load 1101*aa*. In this manner, the switches may be operated by switching over time.

Figure 33:
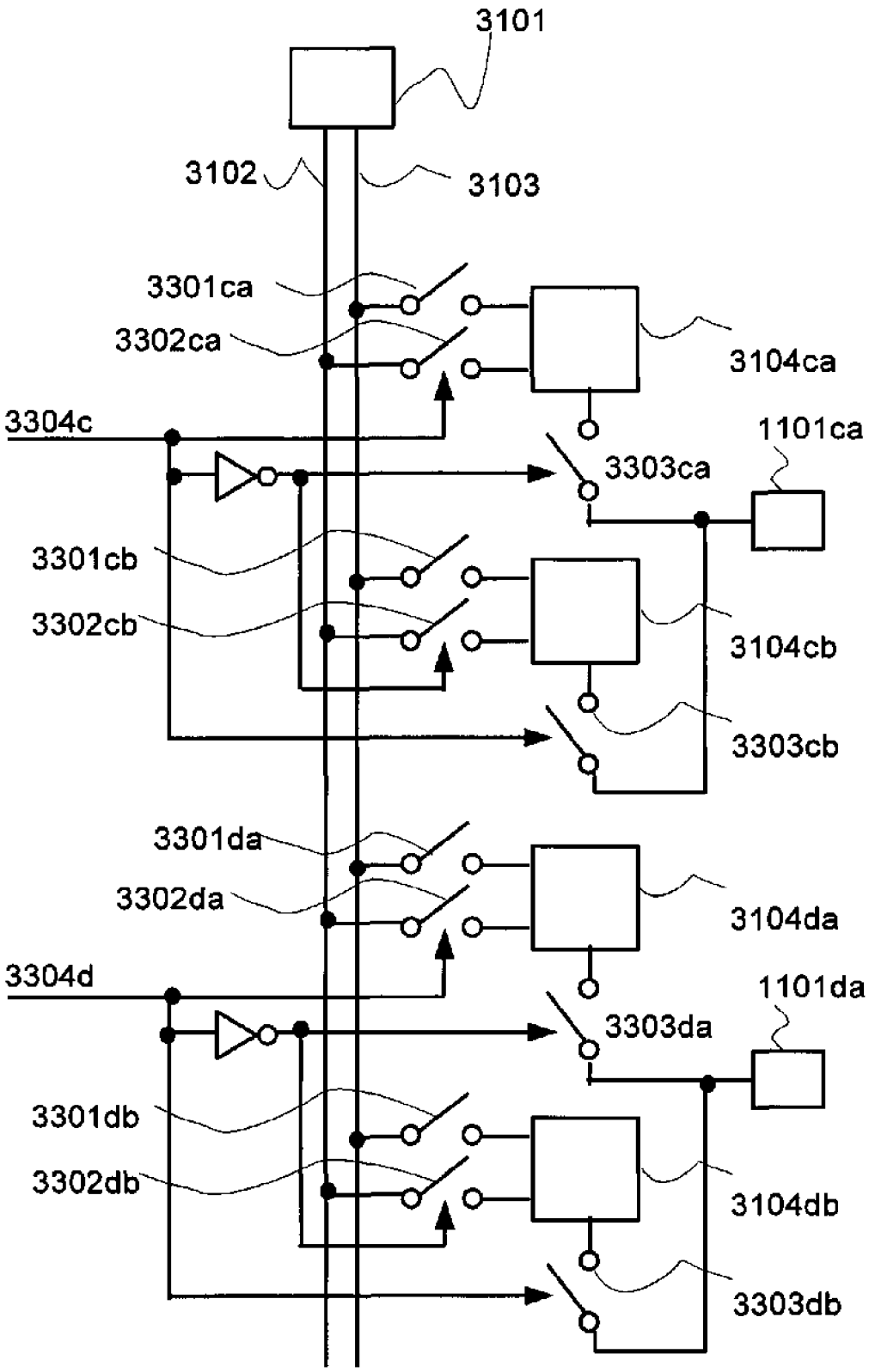
FIG. 33 shows a structure of a semiconductor device of the invention.

In FIG. 32, the two resource circuits 3101*a* and 3101*b* are used for supplying a current to the unit circuits 3104*aa*, 3104*ba*, 3104*ab*, and 3104*bb*. FIG. 33 shows the case in which the one resource circuit 3101 is used for supplying a current to unit circuits 3104*ca*, 3104*cb*, 3104*da*, and 3104*db*.

It is supposed that, for example, in the case of a wiring 3304*c* being an H signal, switches 3301*ca*, 3302*ca* and 3303*cb* are turned on while switches 3303*ca*, 3301*cb* and 3302*cb* are turned off. Then, the unit circuit 3104*ca* becomes capable of being supplied with a current from the resource circuit 3101 whereas the unit circuit 3104*cb* becomes capable of supplying a current to a load 1101*ca*. On the contrary, in the case of the wiring 3304*c* being an L signal, the unit circuit 3104*cb* becomes capable of being supplied with a current from the resource circuit 3101 whereas the unit circuit 3104*ca* becomes capable of supplying a current to the load 1101*ca*. Further, the wiring 3304*c*, a wiring 3304*d* and the like may be selected in sequence by a signal. In this manner, the operation of a unit circuit may be switched over time.

In the case of the loads 1101*ca* and 1101*da* being signal lines, (a part of) a signal line driver circuit can be obtained by using the configuration shown in FIG. 33. In addition, the wiring 3304*c*, the wiring 3304*d* and the like may be controlled by a shift register and the like.

Although in this embodiment mode, the configuration including a plurality of current source transistors is shown with reference to the configuration in FIG. 12, the invention is not limited to this. The similar configuration can be achieved with reference to another configuration than the one shown in FIG. 12.

It is to be noted that this embodiment mode is described with reference to the configurations shown in Embodiment Modes 1, 2 and 3. However, the invention is not limited to this and various changes and modifications are possible unless such changes and modifications depart from the scope of the invention. Therefore, the descriptions in Embodiment Modes 1, 2 and 3 can be applied to this embodiment mode.

Embodiment Mode 5

Described in this embodiment mode is the case in which the invention is applied to a pixel including a display element.

Although this embodiment mode will be described with reference to the configurations shown in FIG. 1 (FIGS. 11, 2 and 5) and FIG. 3 (FIG. 8), the invention is not limited to this. This embodiment mode can be applied to the various configurations shown in Embodiment Modes 1 to 4.

Figure 34:
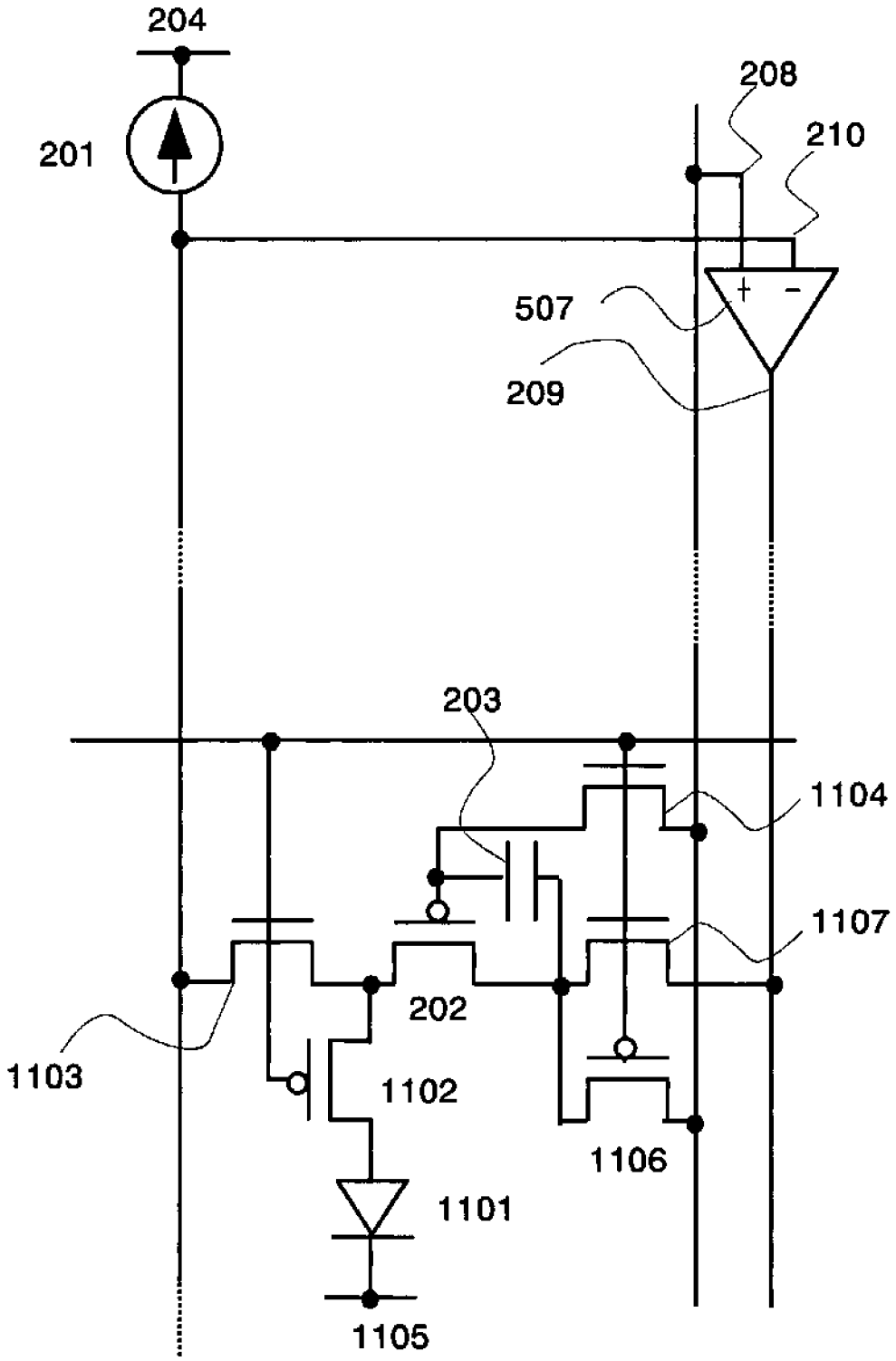
FIG. 34 shows a structure of a semiconductor device of the invention.
Figure 35:
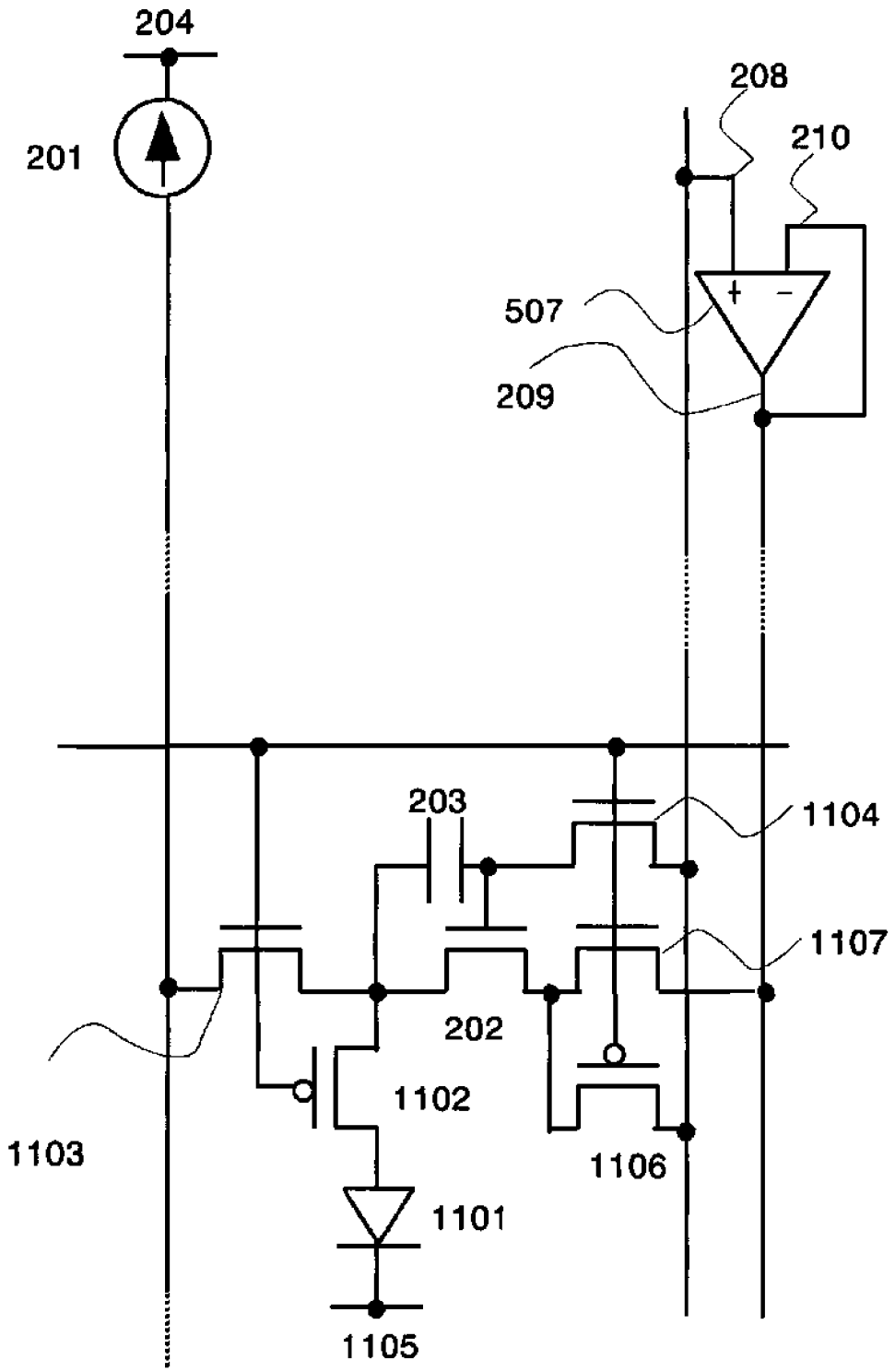
FIG. 35 shows a structure of a semiconductor device of the invention.

FIGS. 34 and 35 each shows a configuration in which the current source circuit 201 supplies a signal current as an image signal. The direction of current flow is the same in FIG. 34 and FIG. 35, though the polarity of the current source transistor 202 is different. Therefore, the connection is different between in FIG. 34 and FIG. 35. Note that an EL element is taken as an example of the load 1101 herein.

When a signal current supplied as an image signal by the current source circuit 201 is an analog value, images can be displayed with analog gray scale. When a signal current is a digital value, images can be displayed with digital gray scale. In order to achieve multi-level gray scale, digital gray scale may be combined with a time gray scale method or an area gray scale method.

It is to be noted that the time gray scale method is not described in no more details herein, and it may be carried out in accordance with Japanese Patent Application No. 2001-5426, Japanese Patent Application No. 2001-343933 and the like.

One gate line is shared to control each of the switches 1102, 1104, 1106, and 1107 by adjusting the polarity of transistors. According to this, the aperture ratio can be improved, though respective gate lines may be disposed. In particular, when adopting the time gray scale method, a period in which a current is not supplied to the load 1101 (EL element) is needed. In that case, another wiring may be provided as a gate line for controlling the switch 1102 that can stop supplying a current to the load 1101 (EL element).

Figure 36:
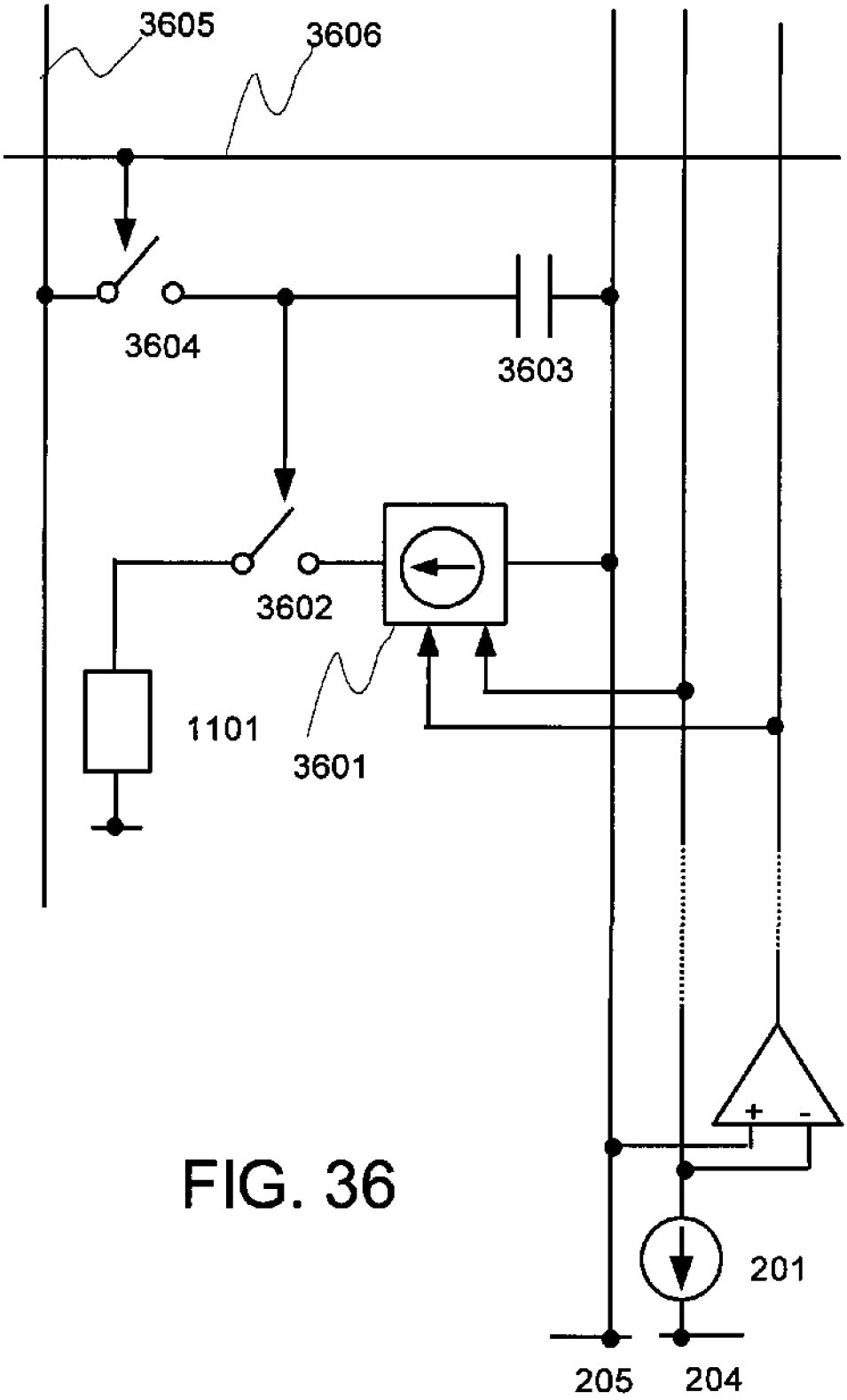
FIG. 36 shows a structure of a semiconductor device of the invention.

FIG. 36 shows a configuration of a pixel including a sub-current source circuit 3601, in which images are displayed in accordance with whether a current supplied by the sub-current source circuit 3601 flows or not. When a selective gate line 3606 being selected, a switch 3604 is turned on and a digital image signal (a voltage value in general) is input from a signal line 3605 to a capacitor element 3603. It is to be noted that the capacitor element 3603 can be omitted when gate capacitance of a transistor is used instead. A switch 3602 is turned on/off by the stored digital image signal. The switch 3602 controls whether a current supplied by the current source circuit 3601 flows to the load 1101 or not. As a result, images can be displayed.

In order to achieve multi-level gray scale, the time gray scale method and the area gray scale method may be adopted in combination.

Although only the one sub-current source circuit 3601 and the one switch 3602 are disposed in FIG. 36, the invention is not limited to this. A plurality of pairs of current source circuit and switch may be disposed to control whether a current from each current source circuit flows or not, and the sum of the current may flow to the load 1101.

Figure 37:
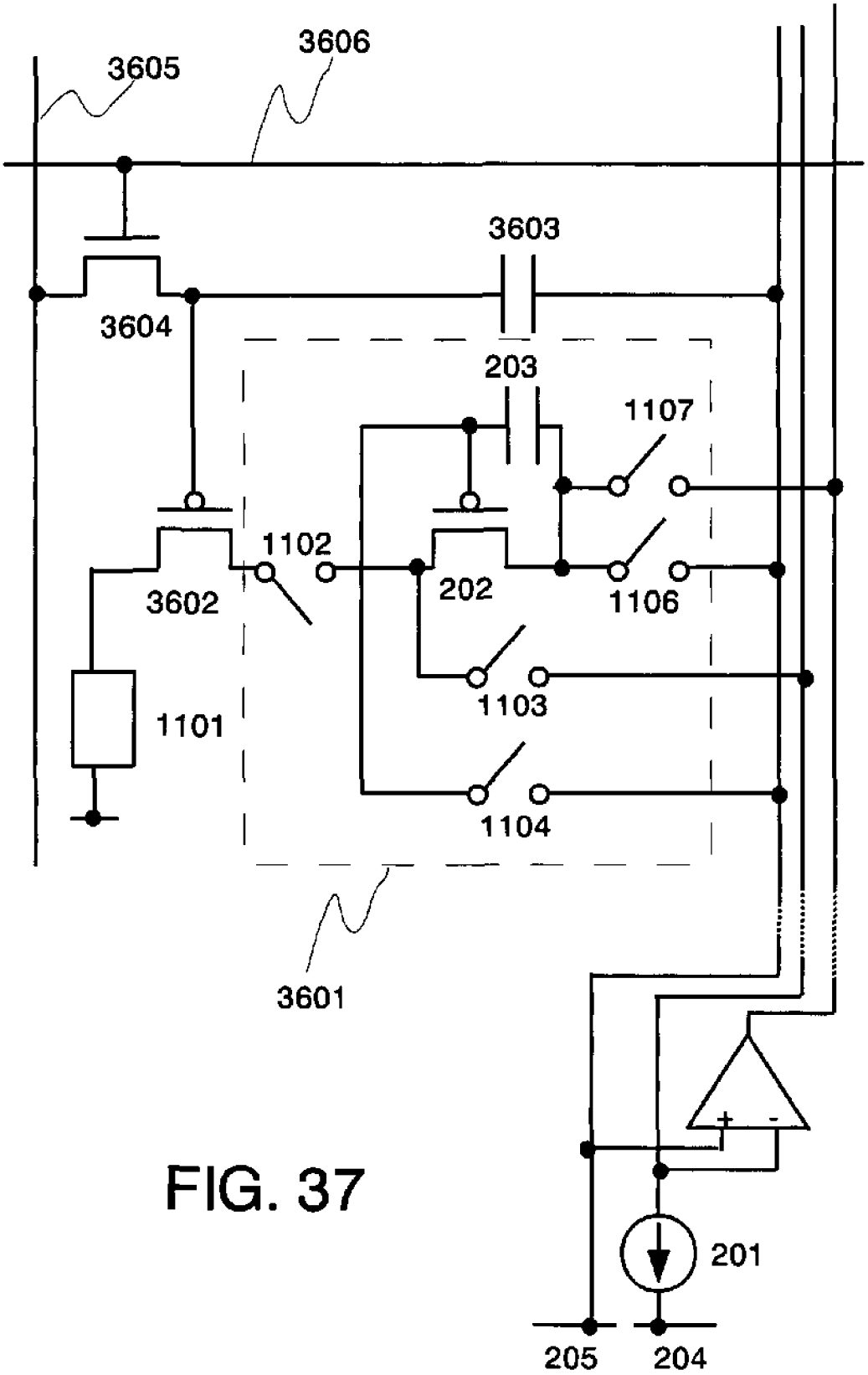
FIG. 37 shows a structure of a semiconductor device of the invention.

Next, a specific configuration example of FIG. 36 is shown in FIG. 37. The configuration shown in FIG. 1 (FIG. 11, FIG. 2 and FIG. 5) is adopted herein for a current source transistor. A current is supplied from the current source circuit 201 to the current source transistor 202 and the capacitor element 3603, and the gate terminal of the current source transistor 202 is set to a proper voltage. Then, the switch 3602 is turned on/off in accordance with an image signal input from the signal line 3605 to supply a current to the load 1101, and thereby images are displayed.

It is to be noted that this embodiment mode is described with reference to the configurations shown in Embodiment Modes 1 to 4. However, the invention is not limited to this and various changes and modifications are possible unless such changes and modifications depart from the scope of the invention. Therefore, the descriptions in Embodiment Modes 1 to 4 can be applied to this embodiment mode.

Embodiment Mode 6

Described in this embodiment mode are configurations and operations of a display device, a signal line driver circuit and the like. The circuit of the invention can be applied to a part of a signal line driver circuit and a pixel.

Figure 38:
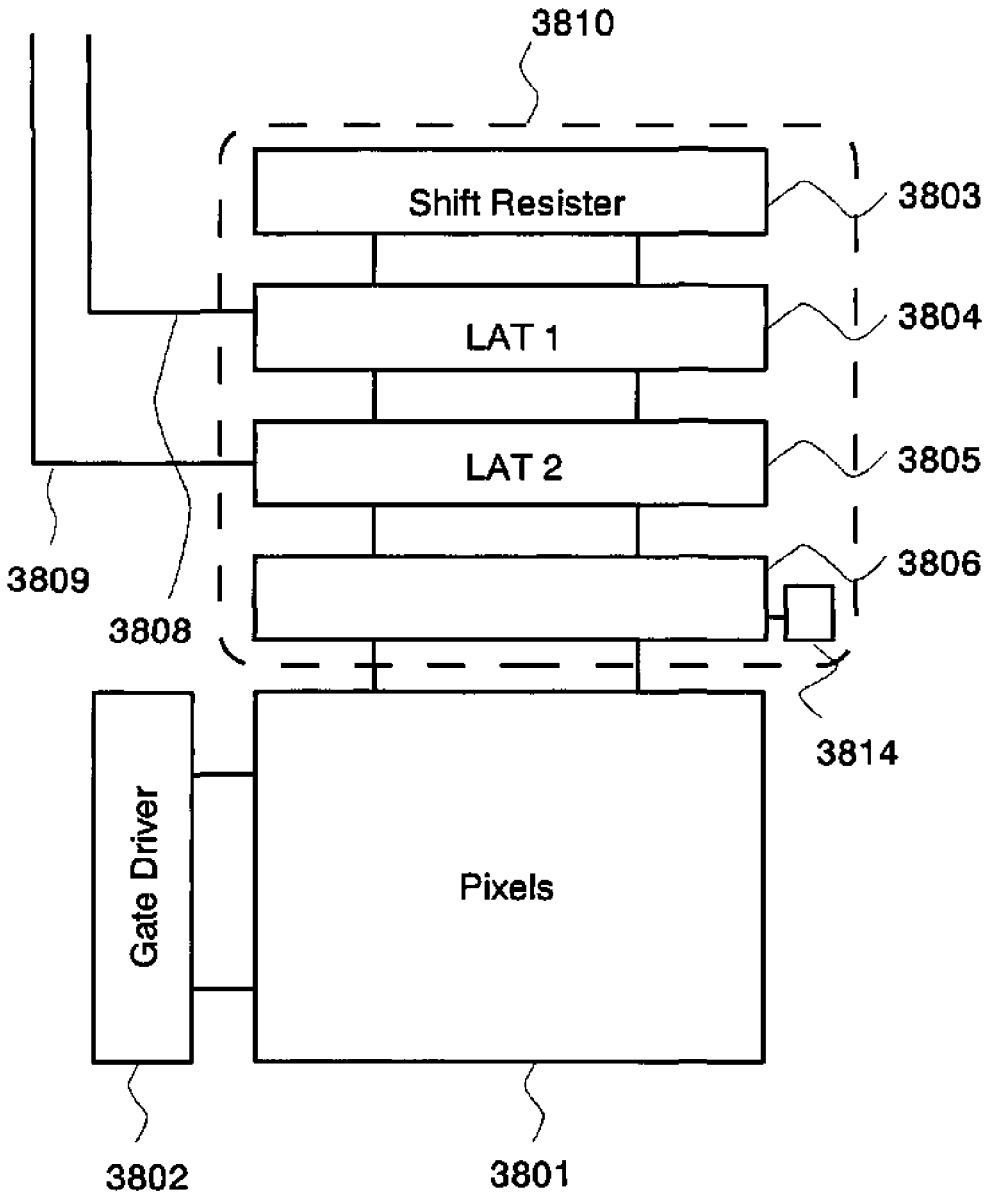
FIG. 38 shows a structure of a display device of the invention.

A display device comprises, as shown in FIG. 38, a pixel array 3801, a gate line driver circuit 3802 and a signal line driver circuit 3810. The gate line driver circuit 3802 sequentially outputs a selective signal to the pixel array 3801. The signal line driver circuit 3810 sequentially outputs a video signal to the pixel array 3801. In the pixel array 3801, a state of light is controlled depending on a video signal to display images. A video signal input from the signal line driver circuit 3810 to the pixel array 3801 is a current in many cases. In other words, a state of a display element and an element for controlling the display element that are disposed in each pixel changes in accordance with a video signal (current) input from the signal line driver circuit 3810. As a display element disposed in each pixel, an EL element, an element used for FED (Field Emission Display) and the like are taken as an example.

It is to be noted that a plurality of gate line driver circuits 3802 may be disposed as well as a plurality of signal line driver circuits 3810.

The signal line driver circuit 3810 can be divided into plural parts. It can be roughly divided, for instance, into a shift register 3803, a first latch circuit (LAT1) 3804, a second latch circuit (LAT2) 3805, and a digital to analog converter circuit 3806. The digital to analog converter circuit 3806 may have a function to convert a voltage to a current as well as a function to perform gamma correction. That is, the digital to analog converter circuit 3806 has a circuit for outputting a current (video signal) to a pixel, namely a current source circuit, to which the invention can be applied.

As shown in FIG. 36, depending on a pixel configuration, a digital voltage signal for a video signal and a controlling current for a current source circuit in a pixel are input to the pixel in some cases. In that case, the digital to analog converter circuit 3806 does not have a digital to analog conversion function but has a function to convert a voltage to a current, and has a circuit for outputting the current to a pixel as a controlling current, namely a current source circuit to which the invention can be applied.

Furthermore, a pixel includes a display element such as an EL element, and a circuit for outputting a current (video signal) to the display element, namely a current source circuit to which the invention can be applied.

An operation of the signal line driver circuit 3810 is briefly described. The shift register 3803 is constituted by a plurality of columns of flip flop circuits (FF) and the like, to which a clock signal (S-CLK), a start pulse (SP) and an inverted clock signal (S-CLKb) are input. In accordance with the timing of these signals, a sampling pulse is output in sequence.

The sampling pulse output from the shift register 3803 is input to the first latch circuit (LAT1) 3804. In accordance with the timing of the sampling pulse, the first latch circuit (LAT1) 3804 holds a video signal in each column, which has been input from a video signal line 3808. It is to be noted that in the case of the digital to analog converter circuit 3806 being disposed, the video signal is a digital value. The video signal at this time is a voltage in many cases.

In the case of the first latch circuit 3804 and the second latch circuit 3805 being circuits capable of holding an analog value, the digital to analog converter circuit 3806 can be omitted in many cases. In that case, the video signal may be a current. Further, in the case of data output to the pixel array 3801 being binary data, that is, a digital value, the digital to analog converter circuit 3806 can be omitted in many cases.

When the holding of video signals is completed until the last column in the first latch circuit (LAT1) 3804, a latch pulse (Latch Pulse) is input from a latch control line 3809 during a horizontal flyback period, and the video signals held in the first latch circuit (LAT1) 3804 are transferred to the second latch circuit (LAT2) 3805 at a time. Then, the video signals held in the second latch circuit (LAT2) 3805 are input to the digital to analog converter circuit 3806 per each row. Signals output from the digital to analog converter circuit 3806 are input to the pixel array 3801.

During a period in which the video signals held in the second latch circuit (LAT2) 3805 are input to the digital to analog converter circuit 3806 and then to the pixel 3801, the shift register 3803 outputs a sampling pulse newly. That is, the two operations are carried out at the same time. According to this, a line sequential driving becomes possible. These operations are repeated thereafter.

In the case of a current source circuit included in the digital to analog converter circuit 3806 being a circuit that performs a set operation and an output operation, that is, a circuit to which a current is input from another current source circuit and which is capable of outputting a current without being influenced by variations in characteristics of transistors, a circuit for supplying a current to the current source circuit is required. In that case, a reference current source circuit 3814 is disposed.

Note that configurations of the signal line driver circuit and the like are not limited to the ones shown in FIG. 38.

Figure 39:
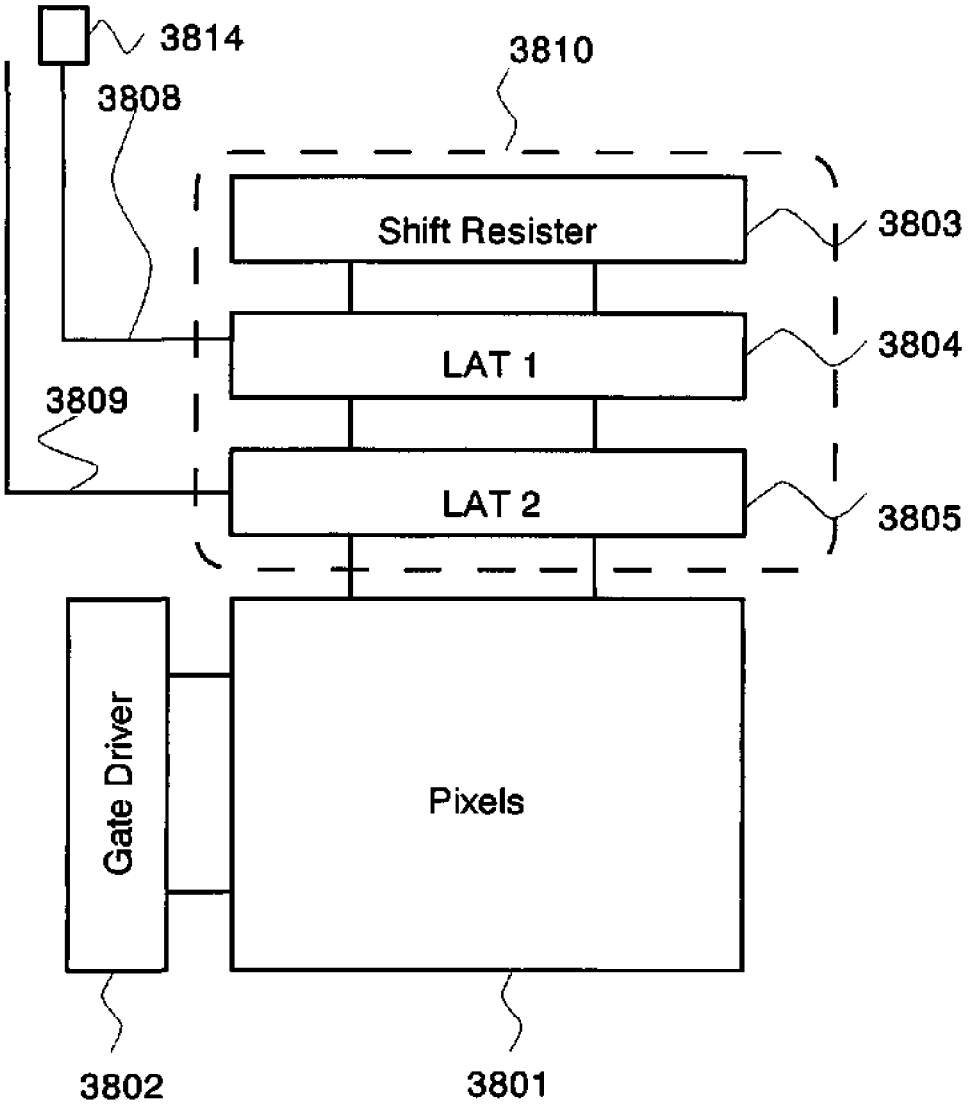
FIG. 39 shows a structure of a display device of the invention.

For example, in the case of the first latch circuit 3804 and the second latch circuit 3805 being circuits capable of holding an analog value, as shown in FIG. 39, a video signal (analog current) may be input from the reference current source circuit 3814 to the first latch circuit (LAT1) 3804. Further, in FIG. 39, the second latch circuit 3805 is omitted in some cases. In that case, the first latch circuit 3804 often includes more current source circuits.

In such a case, the invention can be applied to a current source circuit in the digital to analog converter circuit 3806 shown in FIG. 38. The digital to analog converter circuit 3806 comprises a lot of unit circuits, and the reference current source circuit 3814 includes the current source circuit 101 and the amplifier circuit 107.

The invention can also be applied to a current source circuit in the first latch circuit (LAT1) 3804 shown in FIG. 39. The first latch circuit (LAT1) 3804 comprises a lot of unit circuits, and the reference current source circuit 3814 includes the current source circuit 101.

Furthermore, the invention can be applied to a pixel (current source circuit included therein) in the pixel array 3801 shown in FIG. 38 and FIG. 39. The pixel array 3801 comprises a lot of unit circuits, and the signal line driver circuit 3810 includes the current source circuit 101 and the amplifier circuit 107.

Figure 40:
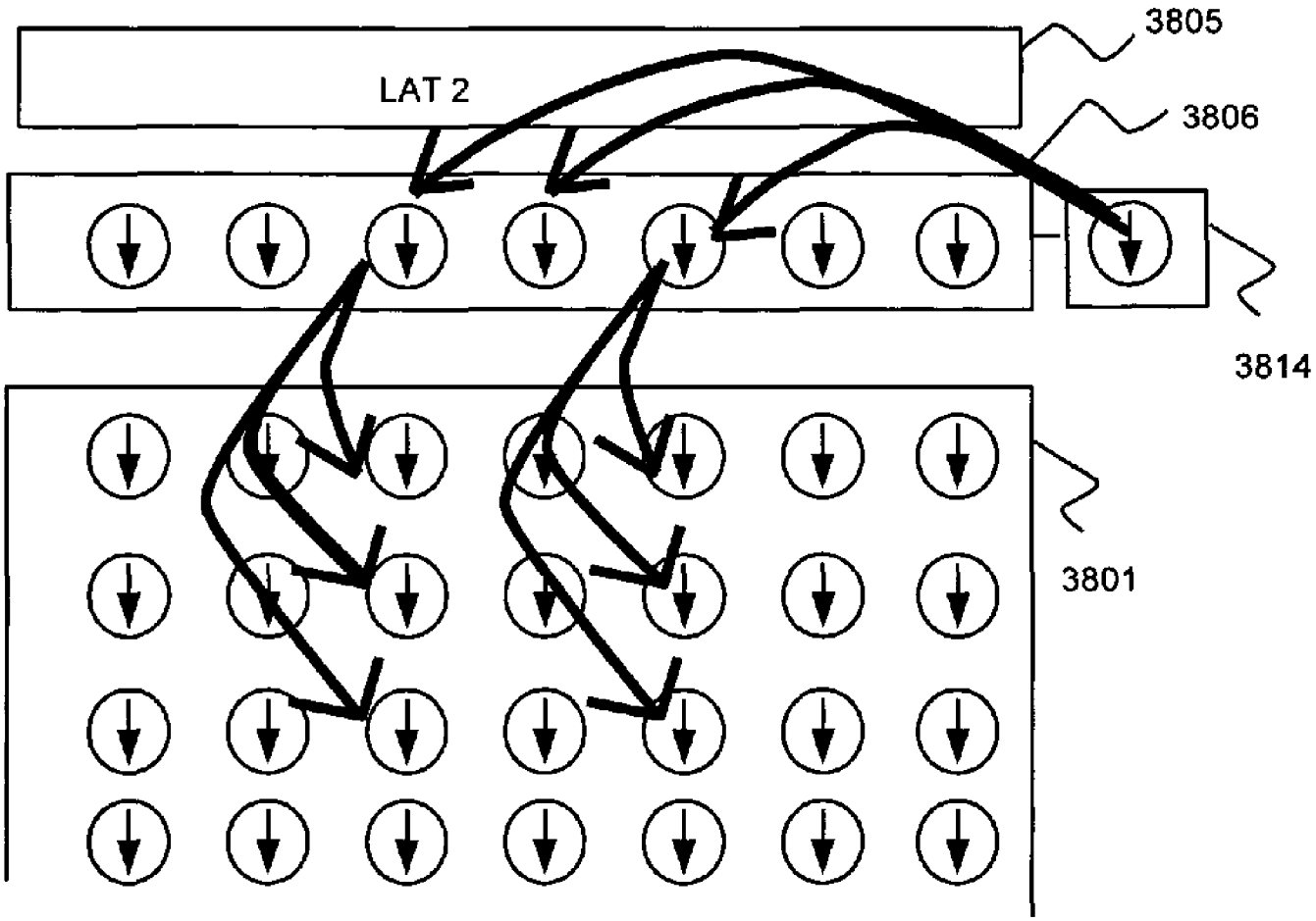
FIG. 40 shows an operation of a display device of the invention.
Figure 41:
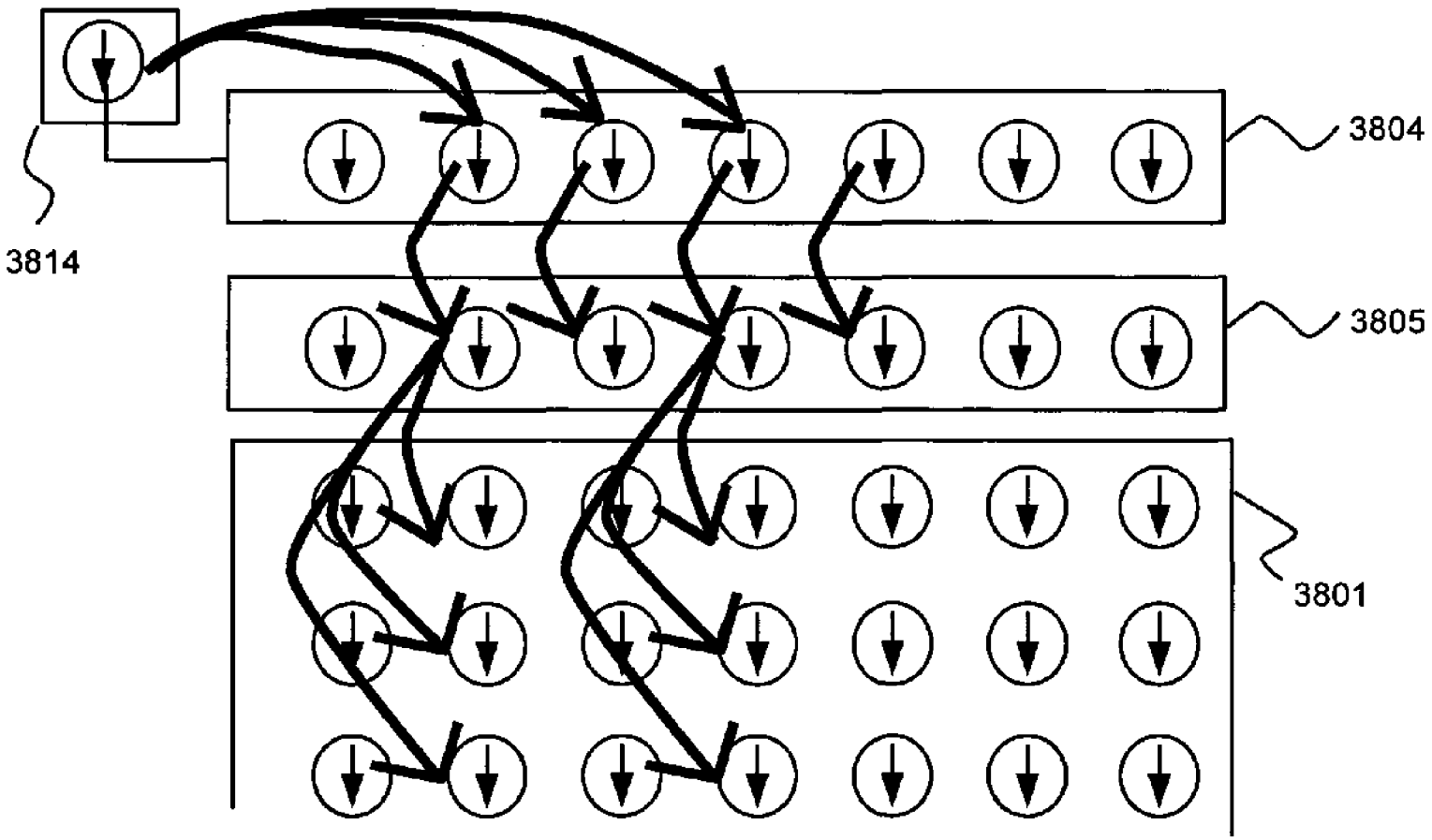
FIG. 41 shows an operation of a display device of the invention.
Figure 42:
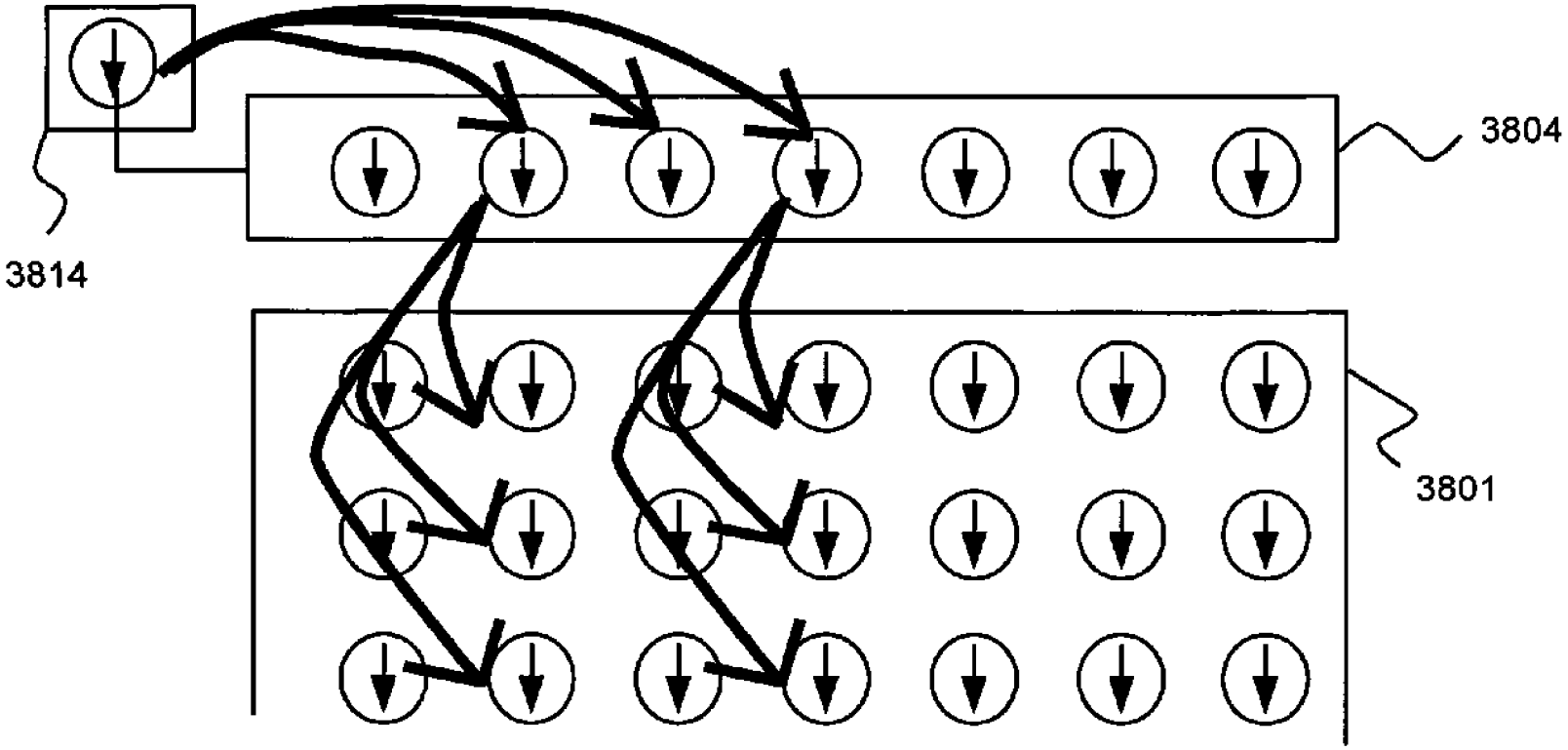
FIG. 42 shows an operation of a display device of the invention.

That is, circuits each for supplying a current are disposed throughout a circuit. Such current source circuit is required to output a current with accuracy. Therefore, another current source circuit is used for setting a transistor to output a current with accuracy. The another current source circuit is also required to output a current with accuracy. Thus, as shown in FIGS. 40 to 42, a basic current source circuit is disposed in a certain area, then current source transistors are set in sequence. According to this, a current source circuit can output a current with accuracy, to which the invention can be applied.

As set forth above, any type of transistor may be used for the transistor in the invention and the transistor may be formed on any type of substrate. Accordingly, the circuits shown in FIG. 38, FIG. 39 and the like may be formed entirely on a glass substrate, a plastic substrate, a single crystalline substrate, an SOI substrate or other substrates. Alternatively, a part of the circuits shown in FIG. 38, FIG. 39 and the like may be formed on a substrate, and the other part of the circuits shown in FIG. 38, FIG. 39 and the like may be formed on another substrate. In other words, not all the circuits shown in FIG. 38, FIG. 39 and the like are required to be formed on the same substrate. In FIG. 38, FIG. 39 and the like, for example, the pixel 3801 and the gate line driver circuit 3802 may be formed on a glass substrate by using TFTs, the signal line driver circuit 3810 (or a part of the same) may be formed on a single crystalline substrate, and an IC chip thereof may be connected by COG (Chip On Glass) to be disposed on the glass substrate. Alternatively, the IC chip may be connected to the glass substrate by TAB (Tape Auto Bonding) or by using a printed substrate.

It is to be noted that this embodiment mode is described with reference to the configurations shown in Embodiment Modes 1 to 5. Therefore, the descriptions in Embodiment Modes 1 to 5 can be applied to this embodiment mode.

Embodiment Mode 7

The invention can be applied to an electronic circuit constituting a display portion of an electronic appliance. Such an electronic appliance includes a video camera, a digital camera, a goggle type display (head mounted display), a navigation system, an audio reproducing device (an in-car audio system, an audio component set, and the like), a laptop personal computer, a game player, a portable information terminal (a mobile computer, a mobile phone, a portable game player, an electronic book, and the like), an image reproducing device provided with a recording medium (specifically, a device that reproduces a recording medium such as a Digital Versatile Disc (DVD) and includes a display capable of displaying the reproduced images), and the like. That is, the invention can be applied to an electronic circuit constituting a display portion of these appliances (for instance, a pixel, a signal line driver circuit for driving the pixel, and the like). Specific examples of these electronic appliances are shown in FIGS. 43A to 43H.

Figure 43A:
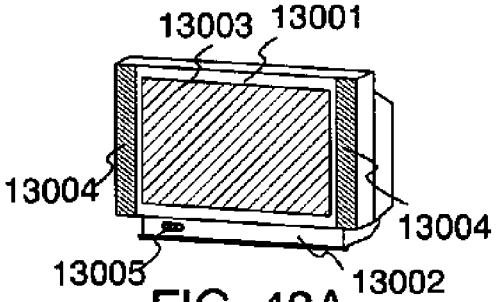
FIGS. 43A to 43H show electronic appliances to which the invention is applied.

FIG. 43A shows a light emitting device (the light emitting device means here a display device using a self-luminous type light emitting element for a display portion) that includes a housing 13001, a supporting base 13002, a display portion 13003, speaker portions 13004, a video input terminal 13005, and the like. The invention can be applied to an electronic circuit that constitutes the display portion 13003. Further, according to the invention, the light emitting device shown in FIG. 43A is completed. Since the light emitting device is a self-luminous type, it requires no backlight, and thereby the display portion thereof can be made thinner than a liquid crystal display. Note that the light emitting device refers to all display devices for displaying information, including ones for personal computers, for TV broadcasting reception, for advertisement and the like.

Figure 43B:
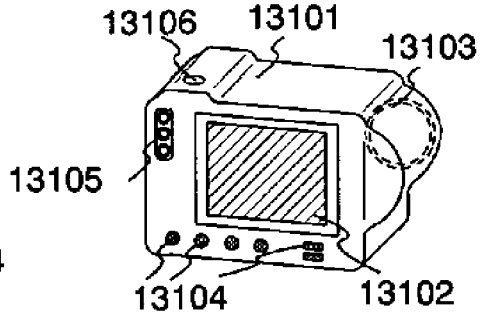

FIG. 43B shows a digital still camera that includes a main body 13101, a display portion 13102, an image receiving portion 13103, operating keys 13104, an external connecting port 13105, a shutter 13106, and the like. The invention can be applied to an electronic circuit that constitutes the display portion 13102. Further, according to the invention, the digital still camera shown in FIG. 43B is completed.

Figure 43C:
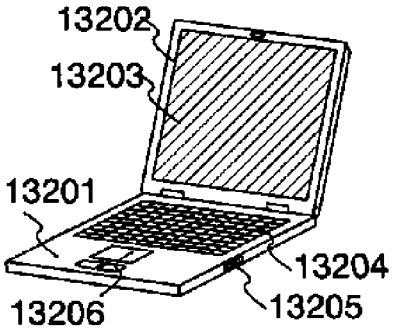

FIG. 43C shows a laptop personal computer that includes a main body 13201, a housing 13202, a display portion 13203, a keyboard 13204, an external connecting port 13205, a pointing mouse 13206, and the like. The invention can be applied to an electronic circuit that constitutes the display portion 13203. Further, according to the invention, the light emitting device shown in FIG. 43C is completed.

Figure 43D:
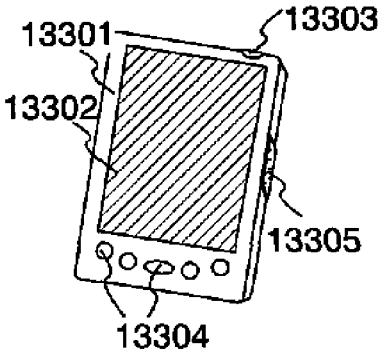

FIG. 43D shows a mobile computer that includes a main body 13301, a display portion 13302, a switch 13303, operating keys 13304, an infrared port 13305, and the like. The invention can be applied to an electronic circuit that constitutes the display portion 13302. Further, according to the invention, the mobile computer shown in FIG. 43D is completed.

Figure 43E:
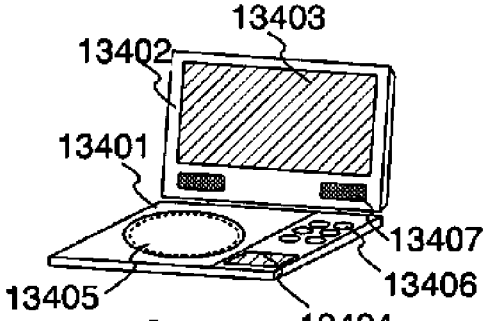

FIG. 43E shows a portable image reproducing device provided with a recording medium (specifically a DVD reproducing device), that includes a main body 13401, a housing 13402, a display portion A13403, a display portion B13404, a recording medium (such as a DVD) reading portion 13405, an operating key 13406, a speaker portion 13407, and the like. The display portion A13403 mainly displays image data whereas the display portion B13404 mainly displays character data. The invention can be applied to an electronic circuit that constitutes the display portions A13403 and B13404. It is to be noted that the image reproducing device provided with a recording medium includes a home game player and the like. Further, according to the invention, the DVD reproducing device shown in FIG. 43E is completed.

Figure 43F:
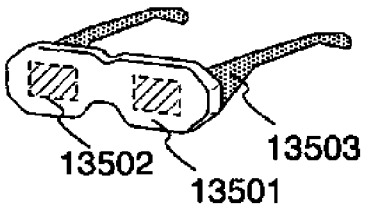

FIG. 43F shows a goggle type display (head mounted display) that includes a main body 13501, a display portion 13502, and an arm portion 13503. The invention can be applied to an electronic circuit that constitutes the display portion 13502. Further, according to the invention, the goggle type display shown in FIG. 43F is completed.

Figure 43G:
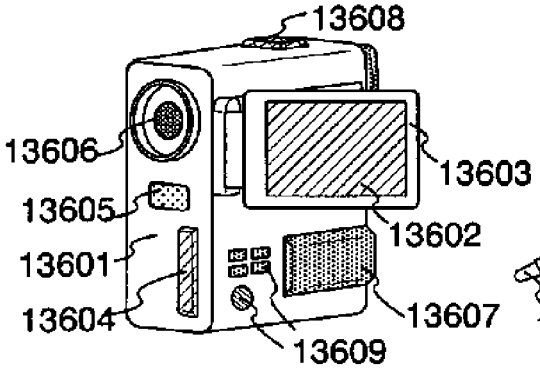

FIG. 43G shows a video camera that includes a main body 13601, a display portion 13602, a housing 13603, an external connecting port 13604, a remote control receiving portion 13605, an image receiving portion 13606, a battery 13607, an audio input portion 13608, operating keys 13609, and the like. The invention can be applied to an electronic circuit that constitutes the display portion 13602. Further, according to the invention, the video camera shown in FIG. 43G is completed.

Figure 43H:
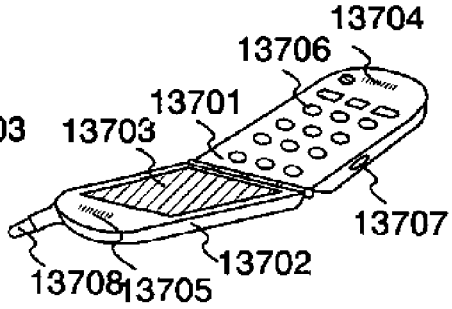
Figure 44:
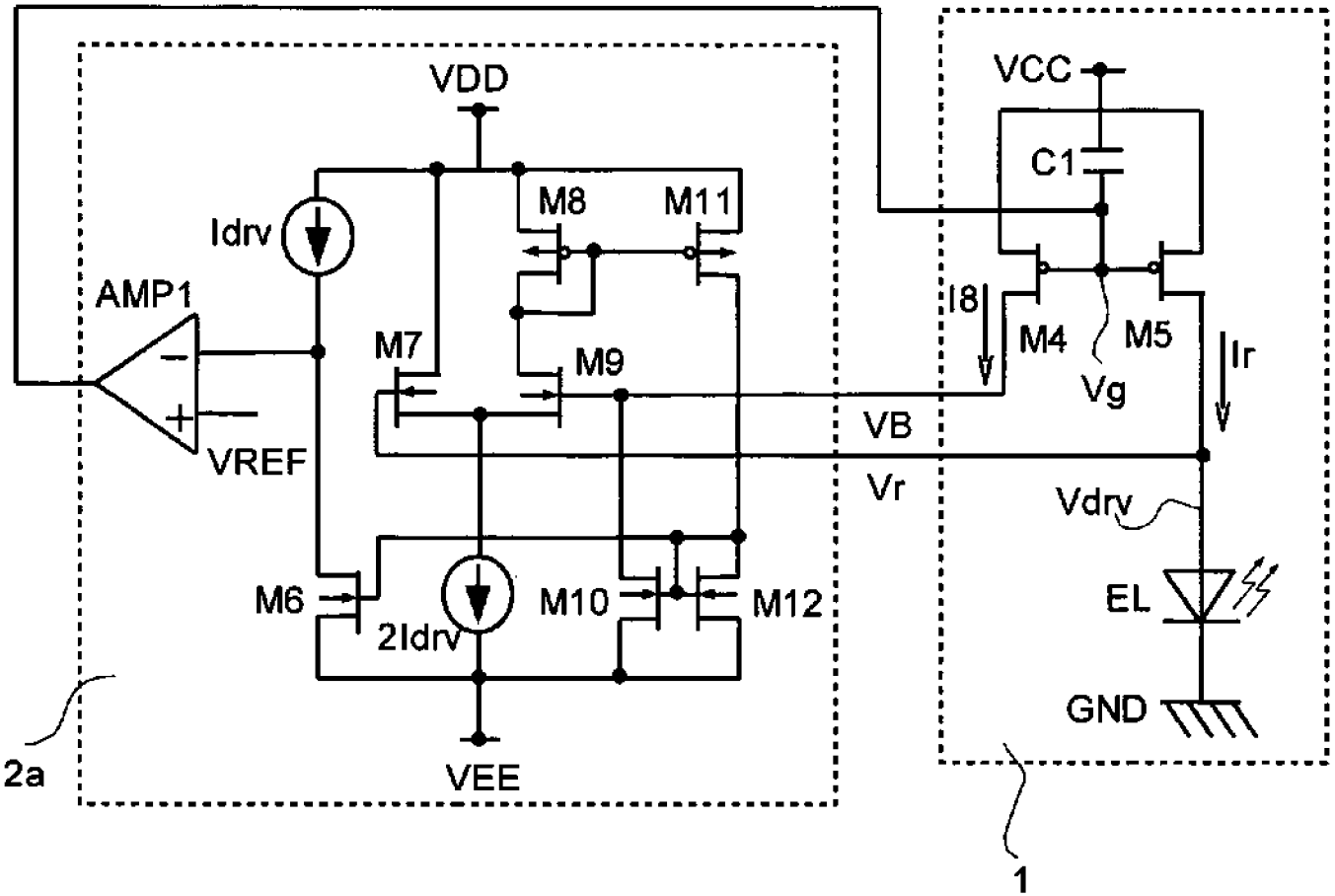
FIG. 44 shows an existing pixel configuration.

FIG. 43H shows a mobile phone that includes a main body 13701, a housing 13702, a display portion 13703, an audio input portion 13704, an audio output portion 13705, an operating key 13706, an external connecting port 13707, an antenna 13708, and the like. The invention can be applied to an electronic circuit that constitutes the display portion 13703. It is to be noted that current consumption of the mobile phone can be suppressed when the display portion 13703 displays white characters on a black background. Further, according to the invention, the mobile phone shown in FIG. 43H is completed.

When the luminance of the light emitting material is improved in the future, it can be used for a front type or rear type projector by magnifying and projecting light including output image data by a lens and the like.

The aforementioned electronic appliances are becoming to be more used for displaying data distributed through a telecommunication path such as Internet and a CATV (Cable Television System), and in particular used for displaying moving pictures data. A light emitting device is suitable for displaying moving pictures because a light emitting material can exhibit a remarkably high response.

Furthermore, since light emitting parts consume power in a light emitting device, data is desirably displayed so that the light emitting parts may occupy as an area small as possible. Accordingly, in the case of a light emitting device being used for a display portion that mainly displays character data, such as the one of a portable information terminal, particularly the one of a mobile phone or an audio reproducing device, it is preferably operated so that the character data emits light by using non-light emitting parts as background.

As set forth above, the application range of the invention is so wide that it can be applied to electronic appliances of all fields. In addition, the electronic appliances shown in this embodiment mode may include a semiconductor device with any one of the configurations shown in Embodiment Modes 1 to 4.

What is claimed is:

1. A semiconductor device comprising:

a current source circuit;

a transistor;

a capacitor; and an operational amplifier, wherein one of a source and a drain of the transistor is electrically connected to the current source circuit, wherein an inverting input terminal of the operational amplifier is electrically connected to the one of the source and the drain of the transistor such that the inverting input terminal of the operational amplifier is configured to be supplied with a potential of the one of the source and the drain of the transistor, wherein an output terminal of the operational amplifier is electrically connected to the other of the source and the drain of the transistor, and wherein a gate of the transistor is electrically connected to an electrode of the capacitor and electrically connected to a non-inverting input terminal of the operational amplifier.

2. The semiconductor device according to claim 1, further comprising:

a first switch;

a second switch;

a third switch;

a fourth switch;

a fifth switch; and a load, wherein the one of the source and the drain of the transistor is electrically connected to the current source circuit via the first switch, wherein the inverting input terminal of the operational amplifier is electrically connected to the one of the source and the drain of the transistor via the first switch, wherein the non-inverting input terminal of the operational amplifier is electrically connected to the gate of the transistor via the second switch, wherein the output terminal of the operational amplifier is electrically connected to the other of the source and the drain of the transistor via the third switch, wherein the gate of the transistor is electrically connected to the electrode of the capacitor, wherein the one of the source and the drain of the transistor is electrically connected to the load via the fourth switch, and wherein the other of the source and the drain of the transistor is electrically connected to a wiring via the fifth switch.

3. The semiconductor device according to claim 1, further comprising:

a first switch;

a second switch;

a third switch;

a fourth switch; and a load, wherein the one of the source and the drain of the transistor is electrically connected to the current source circuit via the first switch, wherein the inverting input terminal of the operational amplifier is electrically connected to the one of the source and the drain of the transistor via the first switch and the second switch, wherein the non-inverting input terminal of the operational amplifier is electrically connected to the gate of the transistor via the third switch, wherein the output terminal of the operational amplifier is electrically connected to the other of the source and the drain of the transistor, wherein the gate of the transistor is electrically connected to the electrode of the capacitor, and wherein the one of the source and the drain of the transistor is electrically connected to the load via the fourth switch.

4. A portable information terminal comprising the semiconductor device according to claim 1 and an operating key.

5. A semiconductor device comprising:

a current source circuit;

a transistor;

a capacitor; and an operational amplifier, wherein one of a source and a drain of the transistor is electrically connected to the current source circuit, wherein an inverting input terminal of the operational amplifier is electrically connected to an output terminal of the operational amplifier, wherein the output terminal of the operational amplifier is electrically connected to the other of the source and the drain of the transistor, and wherein a gate of the transistor is electrically connected to an electrode of the capacitor and electrically connected to a non-inverting input terminal of the operational amplifier.

6. A portable information terminal comprising the semiconductor device according to claim 5 and an operating key.

7. A display device comprising:

a current source circuit;

an operational amplifier; and a pixel comprising:

a display element;

a transistor; and a capacitor, wherein one of a source and a drain of the transistor is electrically connected to the current source circuit, wherein an inverting input terminal of the operational amplifier is electrically connected to the one of the source and the drain of the transistor, wherein an output terminal of the operational amplifier is electrically connected to the other of the source and the drain of the transistor, wherein a gate of the transistor is electrically connected to a first electrode of the capacitor and electrically connected to a non-inverting input terminal of the operational amplifier, wherein a second electrode of the capacitor is electrically connected to the other of the source and the drain of the transistor, and wherein the one of the source and the drain of the transistor is electrically connected to the display element.

8. The display device according to claim 7, further comprising:

a first switch;

a second switch;

a third switch;

a fourth switch; and a fifth switch, wherein the one of the source and the drain of the transistor is electrically connected to the current source circuit via the first switch, wherein the inverting input terminal of the operational amplifier is electrically connected to the one of the source and the drain of the transistor via the first switch, wherein the non-inverting input terminal of the operational amplifier is electrically connected to the gate of the transistor via the second switch, wherein the output terminal of the operational amplifier is electrically connected to the other of the source and the drain of the transistor via the third switch, wherein the gate of the transistor is electrically connected to the first electrode of the capacitor, wherein the one of the source and the drain of the transistor is electrically connected to the display element via the fourth switch, and wherein the other of the source and the drain of the transistor is electrically connected to a wiring via the fifth switch.

9. A portable information terminal comprising the display device according to claim 7 and an operating key.

10. A display device comprising:

a current source circuit;

an operational amplifier; and a pixel comprising:

a display element;

a transistor; and a capacitor, wherein one of a source and a drain of the transistor is electrically connected to the current source circuit, wherein an inverting input terminal of the operational amplifier is electrically connected to an output terminal of the operational amplifier, wherein the output terminal of the operational amplifier is electrically connected to the other of the source and the drain of the transistor, wherein a gate of the transistor is electrically connected to a first electrode of the capacitor and electrically connected to the non-inverting input terminal of the operational amplifier, wherein a second electrode of the capacitor is electrically connected to the one of the source and the drain of the transistor, and wherein the one of the source and the drain of the transistor is electrically connected to the display element.

11. The display device according to claim 10, further comprising:

a first switch;

a second switch;

a third switch;

a fourth switch; and a fifth switch, wherein the one of the source and the drain of the transistor is electrically connected to the current source circuit via the first switch, wherein the non-inverting input terminal of the operational amplifier is electrically connected to the gate of the transistor via the second switch, wherein the inverting input terminal of the operational amplifier is electrically connected to the output terminal of the operational amplifier, wherein the output terminal of the operational amplifier is electrically connected to the other of the source and the drain of the transistor via the third switch, wherein the one of the source and the drain of the transistor is electrically connected to the display element via the fourth switch, and wherein the other of the source and the drain of the transistor is electrically connected to a wiring via the fifth switch.

12. A portable information terminal comprising the display device according to claim 10 and an operating key.

* * * * *